US011367362B2

(12) United States Patent
McCann et al.

(10) Patent No.: US 11,367,362 B2
(45) Date of Patent: Jun. 21, 2022

(54) DYNAMIC TURBULENCE ENGINE CONTROLLER APPARATUSES, METHODS AND SYSTEMS

(71) Applicant: DTN, LLC, Omaha, NE (US)

(72) Inventors: Donald McCann, Overland Park, KS (US); James H. Block, Minneapolis, MN (US); Daniel W. Lennartson, Burnsville, MN (US)

(73) Assignee: DTN, LLC, Omaha, NE (US)

( * ) Notice: Subject to any disclaimer, the term of this patent is extended or adjusted under 35 U.S.C. 154(b) by 0 days.

(21) Appl. No.: 15/427,917

(22) Filed: Feb. 8, 2017

(65) Prior Publication Data

US 2017/0243496 A1 Aug. 24, 2017

Related U.S. Application Data

(63) Continuation of application No. 14/758,770, filed as application No. PCT/US2013/078546 on Dec. 31, 2013, now Pat. No. 9,607,520.

(Continued)

(51) Int. Cl.
*G08G 5/00* (2006.01)

(52) U.S. Cl.
CPC ..... *G08G 5/0091* (2013.01); *G08G 5/0013* (2013.01); *G08G 5/0021* (2013.01); *G08G 5/0034* (2013.01); *G08G 5/0039* (2013.01)

(58) Field of Classification Search
CPC .. G08G 5/0091; G08G 5/0013; G08G 5/0021; G08G 5/0034; G08G 5/0039
See application file for complete search history.

(56) References Cited

U.S. PATENT DOCUMENTS 6,516,652 B1 2/2003 May et al.
2004/0044445 A1 3/2004 Burdon
(Continued)

FOREIGN PATENT DOCUMENTS

EP 2 490 199 A2 8/2012

OTHER PUBLICATIONS

"Examination Report received for Canada Patent Application No. 2,896,761, dated Dec. 2, 2021."
(Continued)

*Primary Examiner* — Rodney A Butler
(74) *Attorney, Agent, or Firm* — Kutak Rock LLP; Brian L. Main

(57) ABSTRACT

The DYNAMIC TURBULENCE ENGINE CONTROLLER APPARATUSES, METHODS AND SYSTEMS ("DTEC") transform weather, terrain, and flight parameter data via DTEC components into turbulence avoidance optimized flight plans. In one implementation, the DTEC comprises a processor and a memory disposed in communication with the processor and storing processor-issuable instructions to receive anticipated flight plan parameter data, obtain terrain data based on the flight plan parameter data, obtain atmospheric data based on the flight plan parameter data, and determine a plurality of four-dimensional grid points based on the flight plan parameter data. The DTEC may then determine a non-dimensional mountain wave amplitude and mountain top wave drag, an upper level non-dimensional gravity wave amplitude, and a buoyant turbulent kinetic energy. The DTEC determines a boundary layer eddy dissipation rate, storm velocity, and eddy dissipation rate from updrafts, maximum updraft speed at grid point equilibrium level and storm divergence while the updraft speed is above the equilibrium level and identify storm top. The DTEC determines storm overshoot and storm drag, Doppler speed,
(Continued)

eddy dissipation rate above the storm top, and determine eddy dissipation rate from downdrafts. The DTEC then determines the turbulent kinetic energy for each grid point and identifies an at least one flight plan based on the flight plan parameter data and the determined turbulent kinetic energy.

25 Claims, 19 Drawing Sheets

Related U.S. Application Data

(60) Provisional application No. 61/919,796, filed on Dec. 22, 2012, provisional application No. 61/747,905, filed on Dec. 31, 2012, provisional application No. 61/748,046, filed on Dec. 31, 2012, provisional application No. 61/747,885, filed on Dec. 31, 2012, provisional application No. 61/748,009, filed on Dec. 31, 2012.

(56) References Cited

U.S. PATENT DOCUMENTS

2006/0059024 A1 3/2006 Bailey et al.
2010/0152931 A1 6/2010 Lacombe
2012/0218127 A1 8/2012 Croen
2013/0080043 A1 3/2013 Ballin et al.
2013/0226452 A1 8/2013 Watts

OTHER PUBLICATIONS

"Donald W. McCann et al: "An improvement in clear-air turbulence forecasting based on spontaneous imbalance theory: the ULTURB algorithm", Meteorological Applications, vol. 19, No. 1, Mar. 23, 2012 (Mar. 23, 2012), pp. 71-78, XP055325060, ISSN: 1350-4827,", DOI: 1 0.1 002/met.260.
Donald W. McCann: "Diagnosing and forecasting aircraft turbulence wit steepening mountain waves", Jan. 1, 2006 (Jan. 1, 2006 ), pp. 77-92, XP05541 0150.
"Examination Report received for Canada Patent Application No. 2,896,761, dated Apr. 16, 2021".
"Extended European Search Report for European Application No. 13867296.9 dated Feb. 7, 2017".
"Final Office Action Received for European Patent Office Application No. 13867757.0, dated Oct. 6, 2017.".
"Final Office Action for U.S. Appl. No. 14/758,774 dated Dec. 7, 2016".
"First Examination Report Received for Australian Application No. 2014368887 dated Nov. 7, 2018".
"Non Final Office Action received for U.S. Appl. No. 15/379,293, dated Jul. 25, 2018, 17 pages".
"Summons to attend oral proceedings pursuant to Rule 115(1) EPC received for European Application No. 13867757.0, dated Jul. 18, 2018, 13 Pages.".

MWAVE grid output 8 01

MWAVE integrated with INTTURB 8 02

INTTURB integrated with VVTURB2 8 03

Finalized output of full turbulence integration 8 04

Terrain Height
10 01

X Direction Asymmetry in Terrain Height
10 02

Y Direction Asymmetry in Terrain Height
10 03

RAP Forecast Streamlines
over 3 hour period 11 01

Lighthill-Ford Radiation computed
for RAP forecast flow 11 02

ULTURB Forecast in EDR for RAP forecast flow 11 03

DYNAMIC TURBULENCE ENGINE CONTROLLER APPARATUSES, METHODS AND SYSTEMS

PRIORITY CLAIM

This application is a Continuation of U.S. nonprovisional patent application Ser. No. 14/758,770, filed Jun. 30, 2015, entitled "Dynamic Turbulence Engine Controller Apparatuses, Methods and Systems,"; which is National Stage Entry of and claims priority under 35 U.S.C. §§ 365 and 371 to PCT application serial no. PCT/US2013/078546, filed Dec. 31, 2013 and entitled "DYNAMIC TURBULENCE ENGINE CONTROLLER APPARATUSES, METHODS AND SYSTEMS," which claims benefit under 35 U.S.C. § 119 to: U.S. provisional patent application Ser. No. 61/747,905, filed Dec. 31, 2012, entitled "Dynamic Turbulence Platform Apparatuses, Methods and Systems,"; U.S. provisional patent application Ser. No. 61/748,046, filed Dec. 31, 2012, entitled "Dynamic Airfoil Platform Manager Apparatuses, Methods and Systems,"; United States provisional patent application Ser. No. 61/747,885, filed Dec. 31, 2012, entitled "Dynamic Turbulence Engine Apparatuses, Methods and Systems,"; U.S. provisional patent application Ser. No. 61/748,009, filed Dec. 31, 2012, entitled "Dynamic Turbulence Manager Apparatuses, Methods and Systems," and U.S. provisional patent application Ser. No. 61/919,796, filed Dec. 22, 2013, entitled "Dynamic Storm Environment Engine Apparatuses, Methods and Systems,". The entire contents of the aforementioned applications are expressly incorporated by reference herein.

This application for letters patent document discloses and describes inventive aspects that include various novel innovations (hereinafter "disclosure") and contains material that is subject to copyright, mask work, and/or other intellectual property protection. The respective owners of such intellectual property have no objection to the facsimile reproduction of the disclosure by anyone as it appears in published Patent Office file/records, but otherwise reserve all rights.

BACKGROUND

A variety of weather monitoring systems, including ground-based and satellite-based observations, are used to provide weather reports and forecasts.

BRIEF DESCRIPTION OF THE DRAWINGS

The accompanying appendices and/or drawings illustrate various non-limiting, example, inventive aspects in accordance with the present disclosure.

The leading number of each reference number within the drawings indicates the figure in which that reference number is introduced and/or detailed. As such, a detailed discussion of reference number 101 would be found and/or introduced in FIG. 1. Reference number 201 is introduced in FIG. 2, etc.

DETAILED DESCRIPTION

Dynamic Turbulence Engine Controller (DTEC)

Figure 1A:
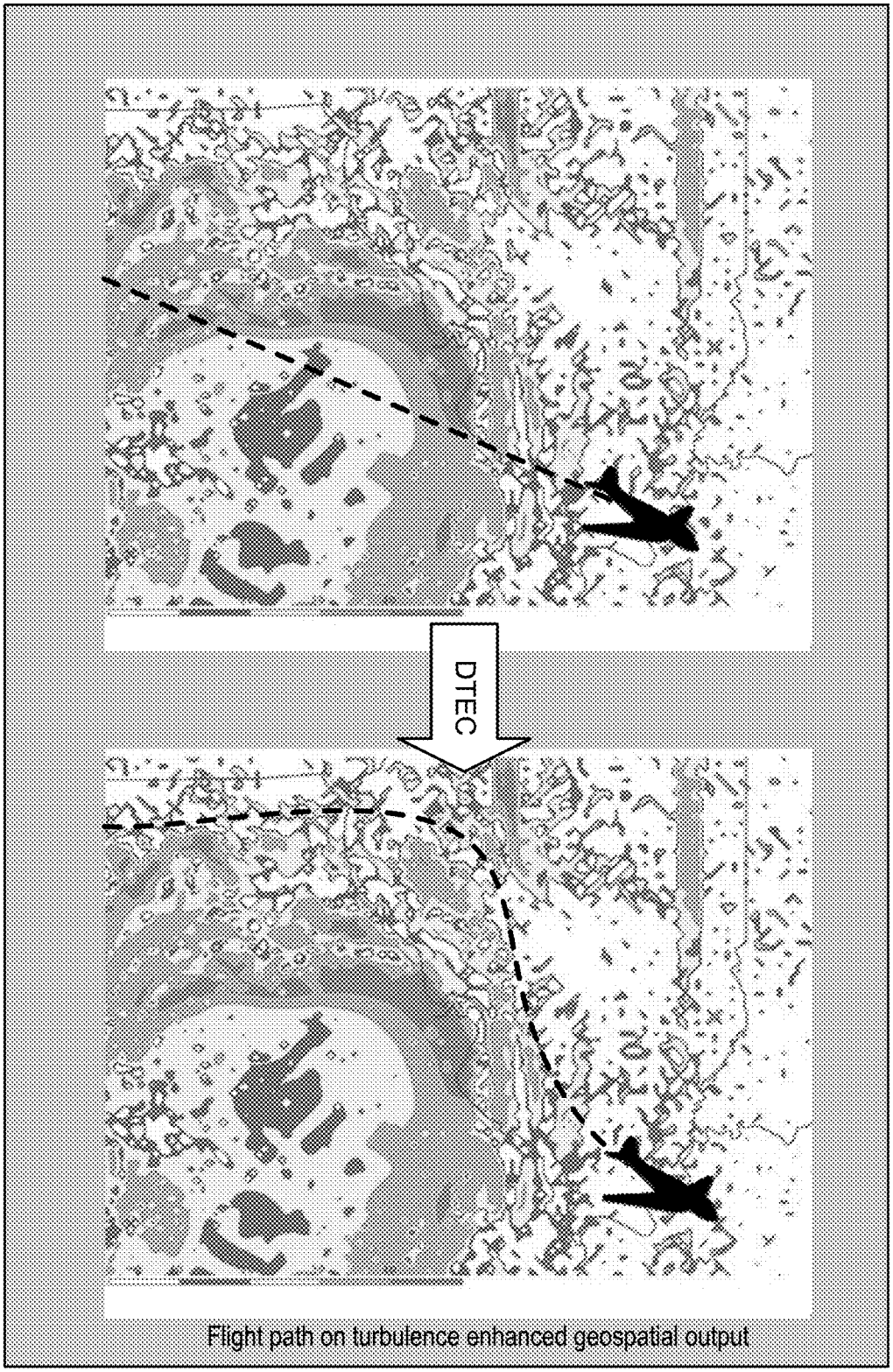
FIG. 1A provides an overview of an aspect of the DTEC.

In some embodiments, the DYNAMIC TURBULENCE ENGINE CONTROLLER ("DTEC") as disclosed herein transforms weather, terrain, and flight parameter data via DTEC components into turbulence avoidance optimized flight plans. In one implementation, the DTEC comprises a processor and a memory disposed in communication with the processor and storing processor-issuable instructions to receive anticipated flight plan parameter data, obtain terrain data based on the flight plan parameter data, obtain atmospheric data based on the flight plan parameter data, and determine a plurality of four-dimensional grid points based on the flight plan parameter data. The DTEC may then determine a non-dimensional mountain wave amplitude and mountain top wave drag, an upper level non-dimensional gravity wave amplitude, and a buoyant turbulent kinetic energy. The DTEC determines a boundary layer eddy dissipation rate, storm velocity, and eddy dissipation rate from updrafts, maximum updraft speed at grid point equilibrium level and storm divergence while the updraft speed is above the equilibrium level and identify storm top. The DTEC determines storm overshoot and storm drag, Doppler speed, eddy dissipation rate above the storm top, and determine eddy dissipation rate from downdrafts. The DTEC then determines the turbulent kinetic energy for each grid point and, as illustrated in FIG. 1A, identifies an at least one enhanced flight plan based on the flight plan parameter data and the determined turbulent kinetic energy.

Turbulence forecasting methods may focus on discrete areas of turbulence, such as clear air turbulence (CAT) or thunderstorm regions, and rely primarily on pilot reports (PIREPS) and other subjective/observational data for determining turbulent airspace regions. The DTEC as disclosed herein utilizes unique predictive components and determinations of turbulence in four-dimensional space-time and utilizes these predictive models to generate a comprehensive forecasting map display and/or overlay that is not merely the visual combination of disparate turbulence projections, but is a multi-hazard calculated integration of enhanced turbulent regions, providing an accurate, multi-dimensional model of turbulence over a specified spatial/temporal area.

Figure 1B:
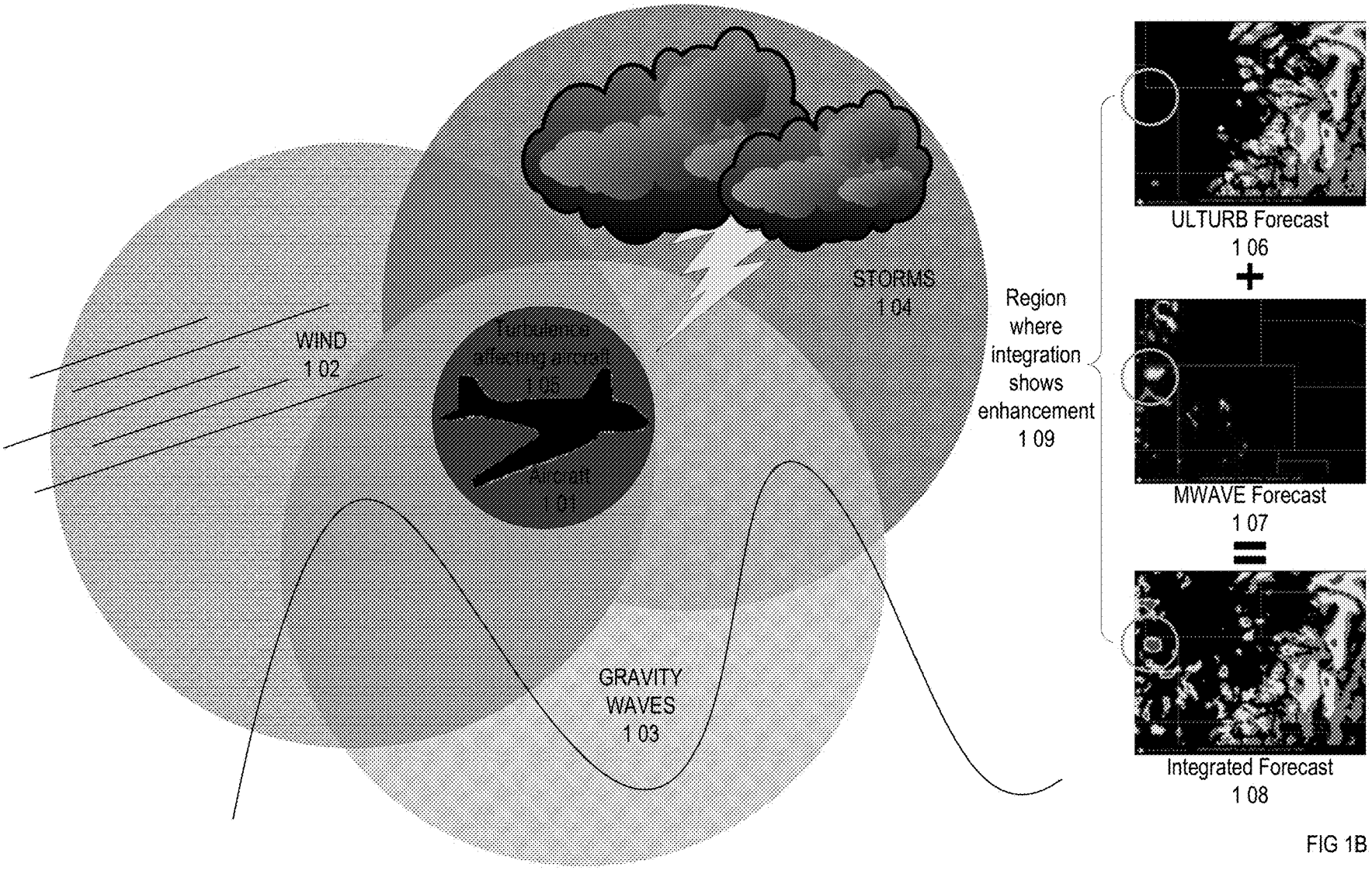
FIG. 1B provides an overview diagram illustrating example enhanced turbulence regions affecting aircraft and an example output of integrated turbulence output in some embodiments of the DTEC.

The term "turbulence" as a haphazard secondary motion caused by the eddies of a fluid system has often been treated as a singular event in casual connotation, caused by passage through an entropic weather system or by proximity to shifting air flow patterns. This definition is commonly perpetuated by many turbulence forecast platforms that focus on a specific type of turbulence, such as CAT, without accounting for additional turbulence factors, nor how multi-hazards conflagrate into not just a series of turbulence events, but an enhanced system which continues to flux. In FIG. 1B, wind 102, thunderstorms 103, and gravity waves 103 (the interaction of media, such as the ocean and the atmosphere caused by energy transfer, on which gravity acts as a restoring force) can all be turbulence contributors to a region of three-dimensional space over a specified time. An aircraft 101 traveling through this region may experience multiple turbulence hazards 105. A turbulence forecast display that indicates only CAT with gravity wave interference may display a low hazard area into which an aircraft may be moving. Similarly a weather prediction display may also fail to factor in the additional risk of CAT. In one embodiment of the disclosed DTEC, a CAT component producing color-coded terminal display of turbulence hazard over a specified area (where clear may indicate no turbulence, green may indicate low turbulence hazard, yellow may indicate medium turbulence hazard, and red may indicate high turbulence hazard) 106 may be integrated with a mountain wave forecasting component which produces a similar color-coded terminal display 107, resulting in an integrated display where the resulting hazard matrix 108 may not be an overlay of the individual turbulence predictions, but an enhanced turbulence forecast where individual areas of low or no hazard turbulence may now indicated high hazard turbulence 109. In some embodiments, multiple turbulence overlay displays may be available showing individuated turbulence forecasts without enhancement. In some embodiments of the disclosure, only enhanced turbulence forecast displays may be available. In some embodiments of the disclosure, users may be able to switch between individuated turbulence forecasts and enhanced turbulence forecasts.

Figure 3:
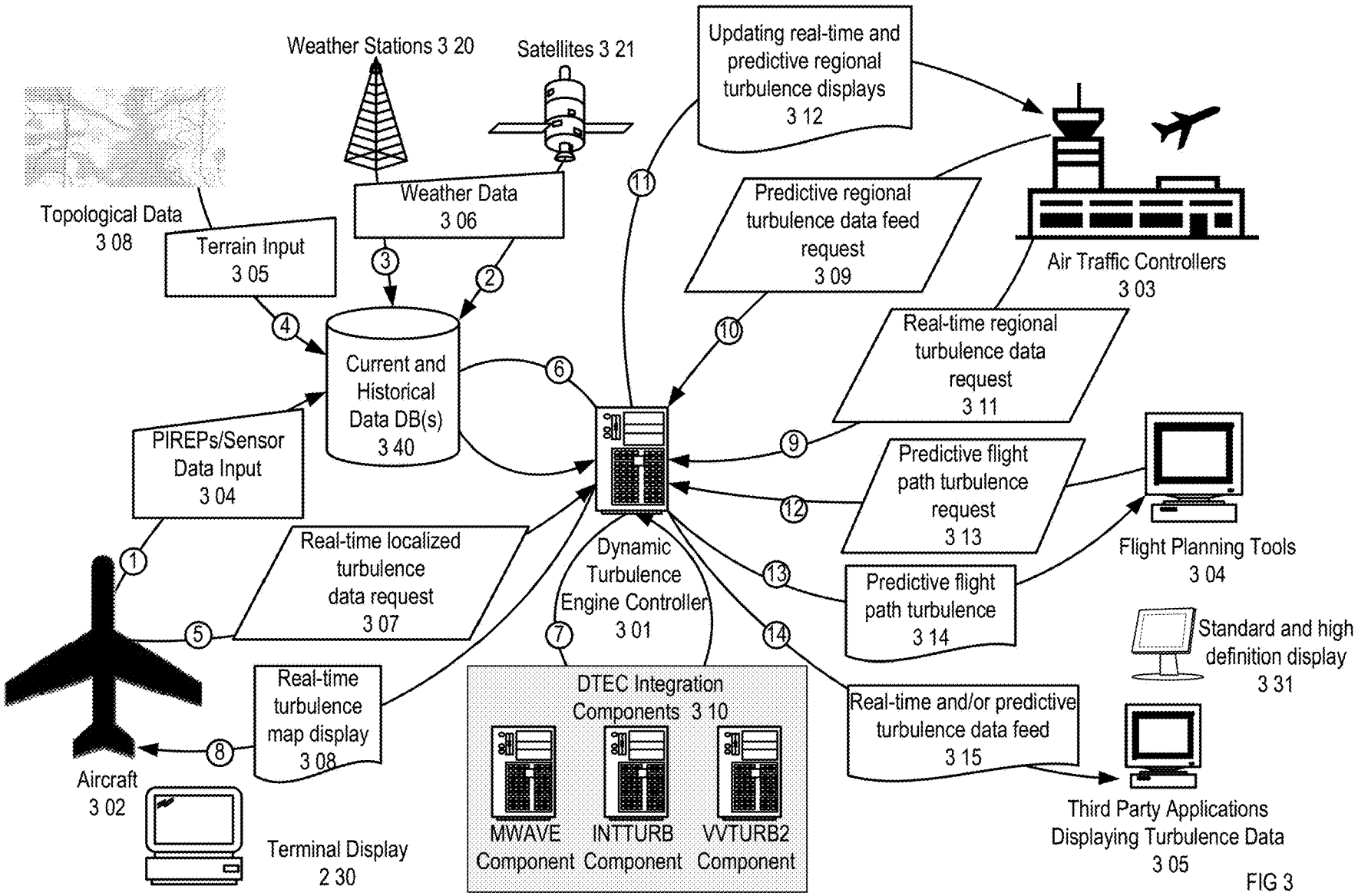
FIG. 3 shows a data flow diagram illustrating an example of a DTEC utilizing both external and internal data repositories for input while accepting inputs and data requests and outputting both predictive and (near) real-time data in some embodiments of the DTEC.

In some embodiments of the disclosure, the DTEC 201 may be available to aircraft 202, air traffic controllers 203, flight planning tools and software 204, third party applications 205 where turbulence feed incorporation is contributing, and the like. FIG. 3 shows that in some embodiments of the disclosure, PIREPS and sensor data of aircraft in real-time turbulence conditions 204*a* may send data to the DTEC to be incorporated into the DTEC aggregate data analysis. Similarly in some embodiments of the disclosure, additional/other sources of input may be weather stations 220 and satellites 221 which may provide numerical weather forecast model data 206 to the DTEC. In one embodiment, an array of sensors both local and remote may be periodically polled by the aircraft itself, directly by the DTEC, and/or the like. The polled array of sensors may include, for example, sensors for measuring altitude, heading, speed, pitch, temperature, barometric pressure, fuel consumption, fuel remaining for flight, number of passengers, aircraft weight, and/or the like. In some embodiments of the DTEC, additional/other sources of input may be topological data which may provide terrain characteristic data 205 to the DTEC. In some embodiments of the DTEC, the receipt of this input may occur prior to requests to the DTEC for turbulence forecasting. In some embodiments of the DTEC, the receipt of this input may be ongoing during requests to the DTEC for turbulence forecasting. In some embodiments of the DTEC, receipts of input may be both before requests to the DTEC for turbulence forecasting and ongoing during forecasting requests. In some embodiments, an aircraft 202 may request (near) real-time localized turbulence data 207, an air traffic control system 203 may request predictive regional turbulence data as an updating feed 209 and/or a (near) real-time regional turbulence data request 211, a flight-planning tool or software may request predictive turbulence within a flight path region or along a flight path course 213. In some embodiments, the DTEC may direct such requests through a turbulence integration component, e.g., 210, where DTEC components such as MWAVE component, INTTURB component, and VVTURB2 component process input into eddy dissipation rate (EDR) values and render them for terminal 230, standard/high-definition 231, and/or displays of the like. An example real-time turbulence request 211, substantially in the form of an HTTP(S) POST message including XML-formatted data, is provided below:

```
POST /realtime_turbulence_request.php HTTP/1.1
Host: www.dtec.com
Content-Type: Application/XML
Content-Length: 667
<?XML version = "1.0" encoding = "UTF-8"?>
<realtime_turbulence_request>
  <timestamp>2025-12-12 15:22:43</timestamp>
  <message_credentials_type=" api_key">
    <auth_key>h767kwjiwnfe456#niimidrtsxbi</auth_key>
  </message_credentials>
  <realtime_turbulence_component_params>
    <sensors_local count="2">
      <sensor_location sensor_type="airframe_integrated_gps">
        <lat val="5.4545" />
        <lon val="23.6354" />
    </sensor_location>
    <sensor_speed sensor_type="pitot_tube" location="starboard_wing>
        <reading t="0" val="554" unit="km-hr" />
        <reading t="-20" val="520" unit="km-hr" />
        <reading t="-60" val="488" unit="km-hr" />
      </sensor_speed>
    </sensors_local>
    <sensors_remote count="2">
      <sensor_temperature>
        <reading location="current" alt="2000m" val="20"
        unit="C" \>
        <reading location="flightPath+20km" alt="2000m"
        val="18" unit="C" \>
        <reading location="flightPath+100km" alt="2000m"
        val="22" unit="C" \>
        <reading lat="45.5454" lon="22.565" alt="0m" val="27"
        unit="C" \>
      </sensor_temperature>
      <sensor_windspeed>
        <source type="NOAA_national_weather_forecast"
        when="instantaneous">
          <reading lat="45.548" lon="21.889" speed="22"
          direction="SSW" />
```

-continued

```
            <reading lat="45.448" lon="21.789" speed="18"
            direction="SW" />
            <reading lat="45.348" lon="21.689" speed="18"
            direction="SSW" />
          </source>
        </sensor_windspeed>
      </sensors_remote>
      <input_currentFlightRoutePlan>
        <track num="1" heading="092deg" dist="52km"
        alt="9144m" \>
        <track num="2" heading="092deg" dist="135km"
        alt="10200m" \>
        <track num="3" heading="075deg" dist="200km"
        alt="7144m" \>
        ...
        <track num="n" heading="092deg" dist="52km"
        alt="9144m" \>
      </input_currentFlightRoutePlan>
      <input_terrain source="flight_plan_software_map">
        <terrain_grid size="5x5" unit="10km">
          <1_1 groundAboveSeaLevel="400m" />
          <1_2 groundAboveSeaLevel="320m" />
          <1_3 groundAboveSeaLevel="380m" />
          <1_4 groundAboveSeaLevel="390m" />
          <1_5 groundAboveSeaLevel="460m" />
          <2_1 groundAboveSeaLevel="410m" />
          <n_n groundAboveSeaLevel="285m" />
          ...
        </terrain_grid>
      </input_terrain>
      <component_request>
        <generate val="predictive_flight_turbulance" />
        <generate val="turbulence_map" />
      </component_request>
    </realtime_turbulence_component_params>
</realtime_turbulence_request>
```

In some embodiments, the DTEC may return a real-time/near real-time turbulence map 208 terminal display to an aircraft, a predictive and updating regional data feed 212 to an air traffic controller, a predictive flight path turbulence 214 display to a flight-planning tool/software, a turbulence data feed 215 to a third party application displaying turbulence data, and/or the like. An example predictive flight path turbulence response 214, substantially in the form of an HTTP(S) POST message including XML-formatted data, is provided below:

```
POST /predictive_flight_path_turbulence_response.php HTTP/1.1
Host: www.flightplanningserver.com
Content-Type: Application/XML
Content-Length: 667
<?XML version = "1.0" encoding = "UTF-8"?>
<predictive_flight_path_turbulence_response>
  <timestamp>2025-12-12 15:22:43</timestamp>
  <message_credentials type=" api_key">
    <auth_key>h767kwjiwnfe456#niimidrtsxbi</auth_key>
  </message_credentials>
  <predictive_flight_path_turbulance>
    <flightPath_option num="1" type="current_path">
      <track num="1" heading="092deg" dist="52km"
      alt="9144m" \>
        <predicted_turbulent_kenrgy val="1.19"/>
      </track>
      <track num="2" heading="092deg" dist="135km"
      alt="10200m" \>
        <predicted_turbulent_kenrgy_val="1.30" />
      </track>
      <track num="3" heading="075deg" dist="200km"
      alt="7144m" \>
        <predicted_turbulent_kenrgy val="0.89" />
      </track>
      ...
    </flightPath_option>
    <flightPath_option num="2" type="minimum_turbulance">
      <track_num="1" heading="088deg" dist="48km"
      alt="9144m" \>
        <predicted_turbulent_kenrgy val="0.45" />
      </track>
      <track num="2" heading="097deg" dist="135km"
      alt="10200m" \>
        <predicted_turbulent_kenrgy val="0.68" />
      </track>
      <track num="3" heading="060deg" dist="180km"
      alt="7144m" \>
        <predicted_turbulent_kenrgy val="0.49" />
      </track>
      ...
    </flightPath_option>
    <flightPath_option num="3" type=
    "minimum_route_deviation">
      <track num="1" heading="089deg" dist="42km"
      alt="9000m" \>
        <predicted_turbulent_kenrgy val="1.02" />
      </track>
      <track num="2" heading="097deg" dist="135km"
      alt="10200m" \>
        <predicted_turbulent_kenrgy val="1.20" />
      </track>
      <track num="3" heading="077deg" dist="200km"
      alt="7144m" \>
        <predicted_turbulent_kenrgy val="0.87" />
      </track>
      ...
    </flightPath_option>
  </predictive_flight_path turbulance>
</predictive_flight_path_turbulence_response>
```

Figure 2:
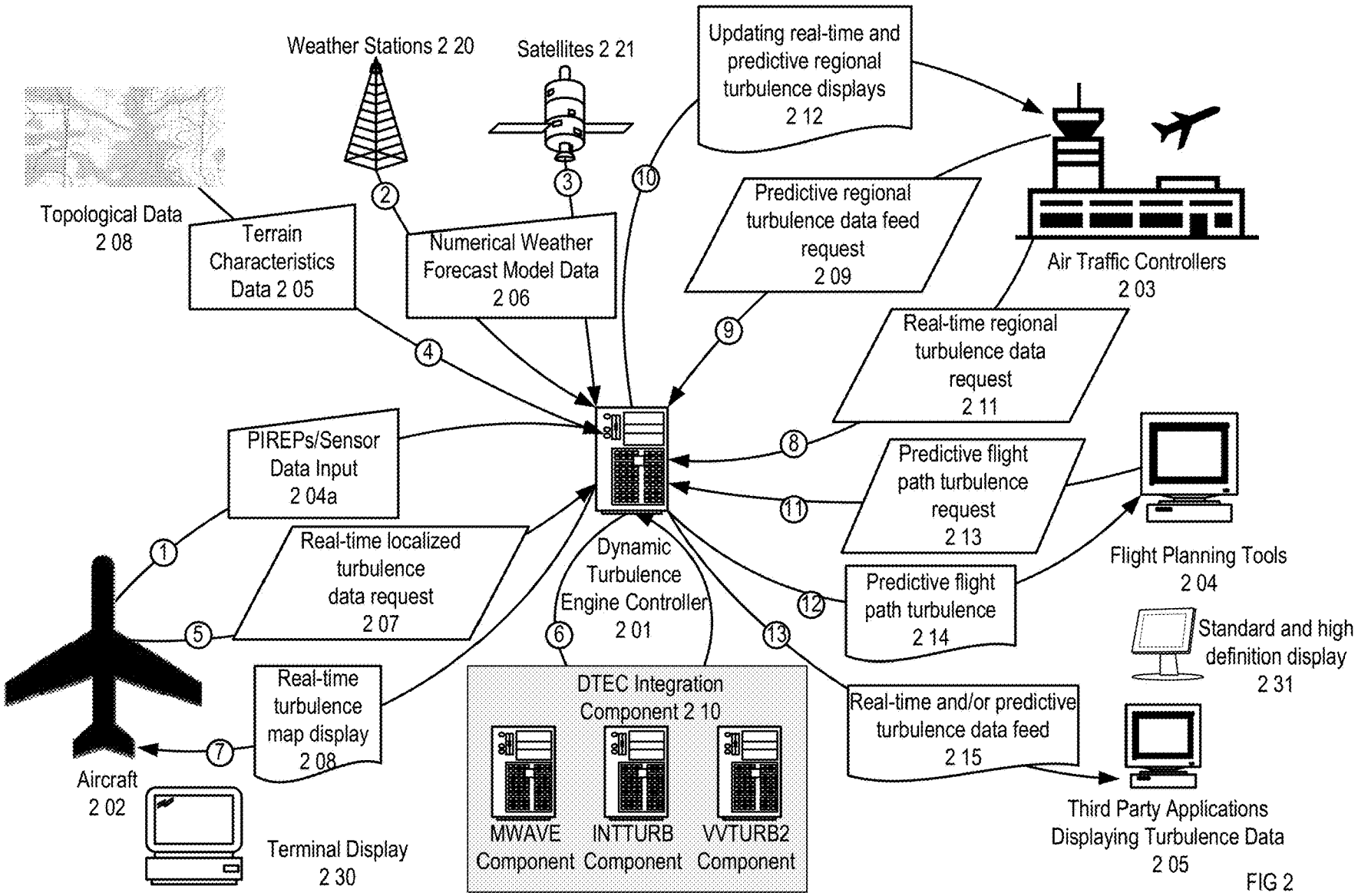
FIG. 2 shows a data flow diagram illustrating an example of a DTEC accepting inputs and data requests and outputting both predictive and (near) real-time data in some embodiments of the DTEC.

FIG. 3 shows an alternate embodiment of DTEC data flow in which input is gathered through like sources 304, 320, 321, 308, such as in FIG. 2 and these inputs may be stored in various current and historical databases systems 340 which in some embodiments of the disclosure may be integrated with the DTEC. In some embodiments of the disclosure, the database systems storing turbulence input may be separate from, but accessible to, the DTEC. Similar parties 302, 303, 304, as in FIG. 2 may request data from the DTEC which may access the database systems for input values in addition to directing the requests through its integration component 310. As in FIG. 2, the DTEC may return these requests with turbulence forecasts in a variety of formats to requesting parties.

Figure 4A:
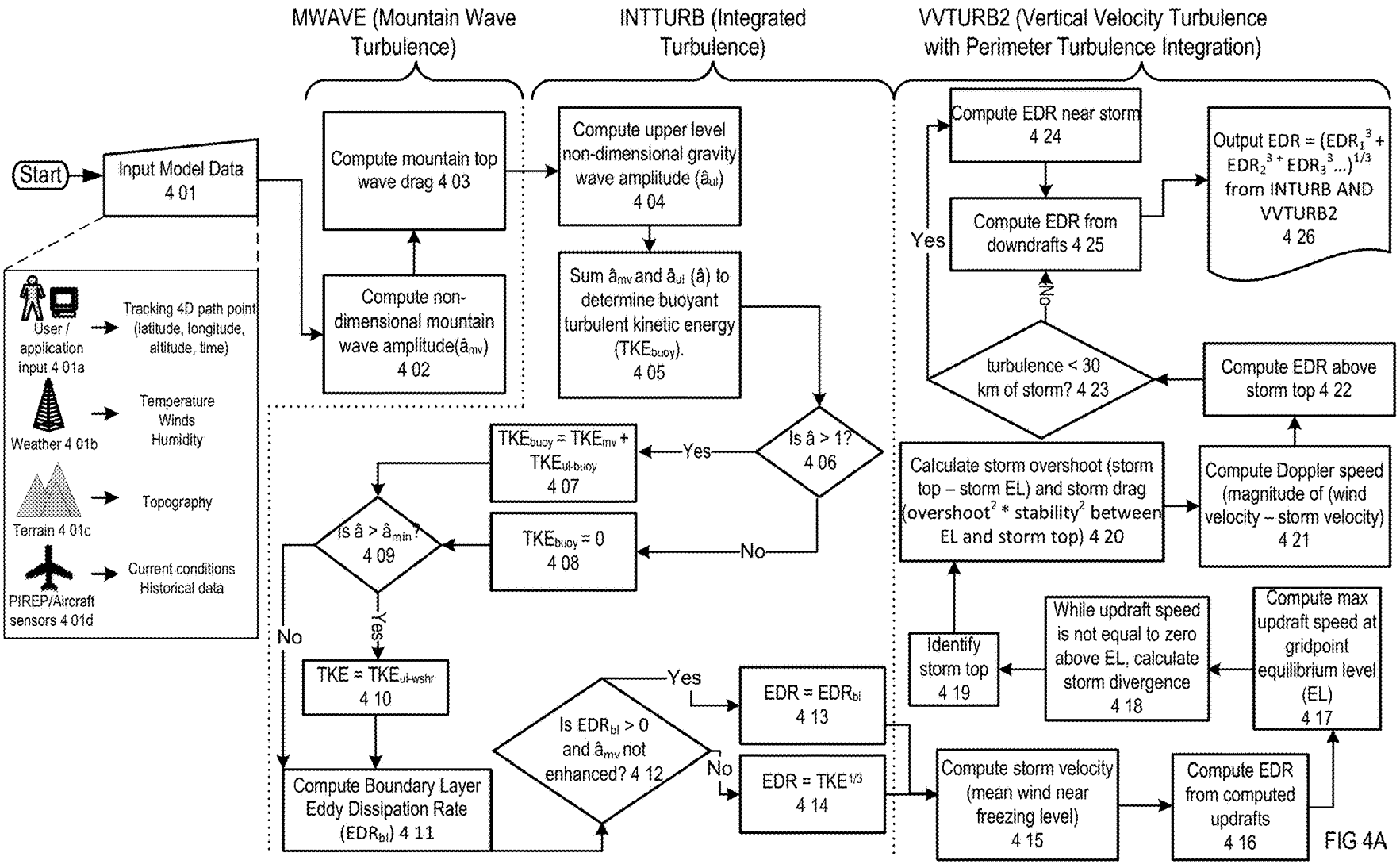
FIG. 4A demonstrates a logic flow diagram illustrating example DTEC turbulence calculation integration component, accepting input and outputting grid point enhanced turbulence data in some embodiments of the DTEC.

In FIG. 4A, one embodiment of the DTEC's turbulance integration component is put forth. Beginning with turbulence data input 401 as derived from such sources as user application input 401*a*, weather 401*b*, terrain 401*c*, PIREPs/aircraft sensors 401*d*, and/or the like, which may provide the DTEC with four-dimensional grid points (three-dimensional space plus time), temperature, winds, humidity, topography, current turbulent conditions, historical conditions, and/or the like, the DTEC may first process the input through a mountain wave turbulence component (MWAVE). The system computes the non-dimensional mountain wave amplitude ($\hat{a}_{mv}$) 402 and computes the mountain top wave drag 403. The following example code fragment shows one embodiment of a methodology for such processing:

```
C
C* a is the non-dimensional wave amplitude (at mountain top)
C
  a (i,m,n) = stab0*h(m,n)/spd0
  h0 (m,n) = a(i,m,n)
C
C* ddrct is the wind and mountain top wind direction difference
C
```

-continued

```
  ddrct = ABS (drct-drct0(m,n))
  IF ( (ddrct .lt. 90.0) .or. (ddrct .gt. 270.0) ) THEN
C
C* a above the mountain top is adjusted for stability, wind,
C* and density changes.
C
     a (i,m,n) = stab*h(m,n)/spd/COS(ddrct*DTR)*
     + SQRT(pnu0(m,n)/(pmodel*stab*spd) )
  ELSE
     a (i,m,n) = 0.0
  END IF
C
C* maximum a is 2.5
C
  IF ( a(i,m,n) .gt. 2.5 ) a(i,m,n) = 2.5
C
C* Find max 'a' below h0max.
C
  IF (ll .lt. nlyrs) THEN
     amax0 = a(ll,m,n) - (zsdg (ll,m,n)-h0max) /
     + (zsdg(ll,m,n)-zsdg(ll+1,m,n))*
     + (a(ll,m,n)-a(ll+1,m,n))
     lll = ll
     DO i = ll,1,-1
        IF ( (a (i,m,n) .ne. RMISSD) and.
        + (a(i,m,n) .gt. amax0) ) THEN
           lll = i-1
           amax0 = a(i,m,n)
        END IF
     END DO
C
C* 'a' is increased at all levels below max 'a'.
C
     DO i = lll,1,-1
        IF (a (i,m,n) .ne. RMISSD) THEN
           a (i,m,n) = amax0
           enhc (i,m,n) = 1.0
        END IF
     END DO
  END IF
C
C* Find .75 vertical wavelength (and 1.75, 2.75, 3.75).
C
  zrefl = (nn + .75) *lambda (m,n) + elv(m,n)
  ll = 1
  DO i = 1,nlyrs
  IF ( zsdg(i,m,n) .lt. zrefl ) ll = i
  END DO
  IF (ll .lt. nlyrs) THEN
  ar = a(ll,m,n) - (zsdg(ll,m,n)-zrefl)/
  + (zsdg(ll,m,n)-zsdg(ll+1,m,n))*
  + (a(ll,m,n)-a(ll+1,m,n))
C
C* Find .50 vertical wavelength (and 1.50, 2.50, 3.75).
C
  zhalf = (nn + .50)*lambda(m,n) + elv(m,n)
  lll = 1
  DO i = 1,ll
IF ( zsdg(i,m,n) .lt. zhalf ) lll = i
  END DO
  ahalf = a(lll,m,n) - (zsdg(lll,m,n)-zhalf)/
  + (zsdg(lll,m,n)-zsdg(lll+1,m,n))*
  + (a(lll,m,n)-a(lll+1,m,n))
C
C* 'a' is increased by reflected 'a' if layered
C* favorably.
C
  IF ( ( ahalf .lt. ar ).and.( ahalf .lt. 0.85 ) ) THEN
        rcoeff = (ar-ahalf)**2/(ar+ahalf)**2
  refl = rcoeff*ar
  havrfl = .true.
  DO i = ll, 1, -1
        IF ( (a(i, m, n) .ne. RMISSD) .and.
        + (havrfl) ) THEN
           arfl = a(i,m,n) + refl
           a (i,m,n) = arfl
           IF ( a (i,m,n) .gt. 2.5 ) a(i,m,n) = 2.5
              enhc (i,m,n) = 1.0
        END IF
```

-continued

```
  END DO
C
C* Compute mountain top wave drag
C
  drag (m,n) = PI/4.0*h(m,n)*pnu0(m,n)
```

In some embodiments of the DTEC, output obtained from the MWAVE component may then be directed into an integrated turbulence calculation component (INTTURB), which will compute upper level non-dimensional gravity wave amplitude ($\hat{a}_{ul}$) 404, and sum $\hat{a}_{mv}$ and $\hat{a}_{ul}$ into ($\hat{a}$) to determine buoyant turbulent kinetic energy ($TKE_{buoy}$) 405. If $\hat{a}$ is greater than 1 406, then $TKE_{buoy}=TKE_{mv}+TKE_{ul\text{-}buoy}$ 407. Otherwise, $TKE_{buoy}=0$ 408. If a greater than $\hat{a}_{min}$ 409, then $TKE=TKE_{ul\text{-}wshr}$ 410. The boundary layer eddy dissipation rate (EDR) is computed 411 and if $EDR_{bl}$ is greater than zero and $\hat{a}_{mv}$ is not enhanced 412, then the $EDR=EDR_{bl}$ 413, else the EDR is the $TKE^{1/3}$ 414.

The following example code fragment shows one embodiment of a methodology for processing of the INTTURB determination request:

```
C* Non-dimensional L-F amplitude is square root of L-F radiation
C* divided by constant. Constant is for 20km resolution grids
C* and is proportionally scaled to resolution of current grid.
C
  ahatlf = SQRT(ABS(lfrad)/cc*gdd/20000.)
C
C
C* ahat is sum of lf and mw ahats
C
  ahat = ahatlf + ahatmw(i)
C
C* Maximum ahat = 2.5
C
  IF ( ahat .gt. 2.5 ) ahat = 2.5
  IF ( ahat .gt. 1.0 ) THEN
C
C* mountain wave tke is proportional to drag.
C
  tkemw = drag(i)*.0004
C
C* Reduce mw drag above this level
C
  IF ( nhnc(i) .eq. 0.0 )
     + drag(i) = drag(i)*((2.5-ahat)/1.5)
     tkebuoy = kh*(ahat-1.0)*bvsq(i) + km*wshrsq(i)
     + + tkemw
  IF (ahat .lt. 1.0) THEN tkebuoy = 0.0
  tke = km*wshrsq(i)*(1.0 + SQRT(rich)*ahat)**2
  + -kh*bvsq(i)
C
C* Compute layer stability and wind shear
C
  thtamn = ( thta + sfcthta )/2.0
  bvsq = GRAVTY*thtadf/zdf/thtamn
  udf = u - sfcu
  vdf = v - sfcv
  wshrsq = ( udf*udf + vdf*vdf )/zdf/zdf
C
C* Compute tke with equation
C
  tke = km*wshrsq - kh*bvsq
C
C* If the < 0, we've reach top of boundary layer. Set topbl = T
C
  IF ( tke .lt. 0.0 ) THEN
     edrbl = 0.0
     topbl = .true.
  ELSE
     edrbl = tke***.333
  END IF
```

In some embodiments of the DTEC, output obtained from the MWAVE and INTTURB components may then be processed through a vertical velocity turbulence with perimeter turbulence integration component (VVTURB2). The storm velocity is computed 415, as is the EDR from computed updrafts 416. The maximum updraft speed at the grid point equilibrium level (EL) is computed 417. While the updraft speed is above the EL, the storm's divergence is calculated 418, after which the storm top is identified 419. Storm overshoot (the storm top minus the storm EL) and storm drag (the overshoot squared multiplied by the stability between the EL and storm up squared) are calculated 420. The magnitude of the wind velocity minus the storm velocity is calculated (known as the Doppler speed) 421. The EDR above the storm top is computed 422. If there is turbulence within a set distance or radius, by way of example thirty kilometers, of the storm 423, then the EDR near the storm is also computed 424. Otherwise, only the EDR from downdrafts is additionally computed 425. Finally, all EDRs computed from INTURB and VVTURB2 components are summed and converted to TKE 426.

The following exemplary code fragment shows one embodiment of a methodology for processing of the VVTURB2 component:

```
C
C* Compute mean wind near freezing level (estimate of
C* storm velocity)
C
  nlyrs = nlev - 1
  DO j = 1, nlyrs
    CALL ST_INCH ( INT(rlevel (j)) , clvl1, iret )
    CALL ST_INCH ( INT(rlevel (j+1)), clvl2, iret )
    pbar = (rlevel(j) + rlevel (j+1))/2.0
    IF ( pbar .gt. 400. ) THEN
        glevel = clvl2//':'//clvl1
          gvcord = 'PRES'
          gfunc = 'LAV(TMPC)'
        CALL DG_GRID ( timfnd, glevel, gvcord, gfunc, pfunc, t,
        + igx, igy, time, level, ivcord, parm, iret )
        gvcord = 'PRES'
        gfunc = 'UR(VLAV(WIND))'
        CALL DG_GRID ( timfnd, glevel, gvcord, gfunc, pfunc, u,
        + igx, igy, time, level, ivcord, parm, iret )
        ierr = iret + ierr
        gvcord = 'PRES'
        gfunc = 'VR(VLAV(WIND))'
        CALL DG_GRID ( timfnd, glevel, gvcord, gfunc, pfunc, v,
        + igx, igy, time, level, ivcord, parm, iret )
C
C* Find weighted average of winds in all layers in which
C* -5C < t < 5C, weighting layer closer to 0C the highest.
C
      DO i = 1, maxpts
        tabs = ABS (t (i))
        IF ( tabs .lt. 5.0 ) THEN
          ufrzl(i) = ufrzl(i) + (5.0 - tabs)*u(i)
          vfrzl(i) = vfrzl(i) + (5.0 - tabs)*v(i)
          tsum(i) = tsum(i) + (5.0 - tabs )
        END IF
      END DO
    END IF
  END DO
C* Compute edr from mean vertical velocity
C
  IF ( wmean .gt. 10.0 ) THEN
    edr (i) = (.035+.0016*(wmean-10.0))**.333
  ELSE
    edr (i) = (.0035*wmean)**.333
  END IF
  ELSE
    edr (i) = 0.0
  END IF
  IF (wwnd (i) .gt. maxvv (i)) THEN
      havtop(i) = .false.
```

-continued

```
      maxvv(i) = wwnd (i)
      el(i) = z(i)
      iii = 0
C
C* Divergence above EL is deceleration of the updraft divided by
C* thickness.
C
  ELSE IF ( .not. havtop(i) ) THEN
      divhi(i) = (vvbase(i) -wwnd(i))/tkns(i)
      bvsqtop(i) = bvsqtop(i) + bvsq(i)
      iii = iii + 1
  ELSE
      divhi(i) = 0.0
  END IF
C
C* Define storm top
C
  IF ( (maxvv(i) .gt. 1.0) .and. (wwnd(i) .lt. .1)
  + .and. (.not. havtop(i)) ) THEN
      havtop(i) = .true.
      stmtop(i) = z(i) - tkns(i)/2.0
      + - tkns(i)*vvbase(i)*vvbase(i)/wsq
      ovshoot (i) = stmtop(i) - el (i)
  IF ( iii .ne. 0 ) THEN
      bvsqtop(i) = bvsqtop(i)/iii
  ELSE
      bvsqtop(i) = 0.0
  END IF
C
C* Compute storm overshooting drag and storm top relative wind
C* (relative to freezing level wind)
C
  drag (i) = ovshoot(i)*ovshoot(i)*bvsqtop(i)
  dopu = u(i) - ufrzl(i)
  dopv = v(i) - vfrzl(i)
  dopspd = SQRT(dopu*dopu + dopv*dopv)
  pnu0(i) = dden(i)*SQRT(bvsq(i))*dopspd
  IF ( (wsq .le. 0.0) .and. havtop(i) ) THEN
      stab = SQRT(bvsq(i))
      dopu = u(i) - ufrzl(i)
      dopv = v(i) - vfrzl(i)
      dopspd = SQRT(dopu*dopu + dopv*dopv)
C
C* Compute EDR above storm top as a function of drag
C
  IF (ahat .ge. 1.0) THEN
      edrtop = (drag(i)*.0004)**.333
      edr(i) = MAX(edr(i), edrtop)
      drag(i) = drag(i)*((2.5-ahat)/1.5)
  END IF
C
C* Compute turbulence near storms if grid distance low enough.
C
  DO i = 1,maxpts
        IF (edr(i) .ne. RMISSD) THEN
          gdd = (gdx(i)+gdy(i))/2.0
          IF ( gdd .lt. 30000. .and. .not.havtop(i)) THEN
C
C* Compute tke near storm using Term 2C of L-F radiation
C* using same method as in ULTURB.
C
            IF ( MOD(i,igx) .eq. 1 ) THEN
              ddivdx = (divhi(i+1)-divhi(i))/gdx(i)
            ELSE IF ( MOD(i,igx) .eq. 0 ) THEN
              ddivdx = (divhi(i)-divhi(i-1))/gdx(i)
            ELSE
              ddivdx = (divhi(i+1)-divhi(i-1))/2.0/gdx(i)
            END IF
            IF ( i .le. igx ) THEN
              ddivdy = (divhi(i+igx)-divhi(i))/gdy(i)
            ELSE IF ( i .gt. (maxpts-igx) ) THEN
              ddivdy = (divhi(i)-divhi(i-igx))/gdy(i)
            ELSE
              ddivdy = (divhi(i+igx)-divhi(i-igx))/2.0/gdy(i)
            END IF
            crsdiv = -ff(i)*(u(i)*ddivdy - v(i)*ddivdx)
            ahat = SQRT(ABS(crsdiv)/cc)
            IF ( ahat .gt. 2.5 ) ahat = 2.5
            rich = bvsq(i)/wshrsq(i)
```

-continued

```
            IF ( rich .lt. 0.0 ) rich = 0.0
            IF ( rich .lt. 0.25 ) THEN
              amin = 0.0
            ELSE
              amin = 2.0 - 1.0/SQRT(rich)
            END IF
            IF ( ahat .gt. 1.0 ) THEN
              tkebuoy = kh*(ahat-1.0)*bvsq(i) + km*wshrsq(i)
            ELSE
              tkebuoy = 0.0
            END IF
            IF ( amin .ge. ahat ) THEN
              tke = tkebuoy
            ELSE
              tke = km*wshrsq(i)*(1.0 + SQRT(rich)*ahat)**2
              + - kh*bvsq(i)
          END IF
          IF ( tke .lt. 0.0 ) tke = 0.0
          edrnear = tk**.333
          edr(i) = MAX(edr(i),edrnear)
        END IF
      END IF
    END DO
C
C* Compute downdraft velocities (a function of the windex
C and how far below the freezing level) and downdraft edr
C
    fl = 304.8
    DO WHILE ( fl .le. 6097. )
        CALL ST_INCH ( INT(fl), glevel, iret )
        gvcord = 'HGHT'
        gfunc = 'EDR+2'
        CALL DG_GRID ( timfnd, glevel, gvcord, gfunc, pfunc, edr,
        + igx, igy, time, klevel, kvcord, parm, iret )
        DO i = 1, maxpts
          IF ( maxvv(i) .gt. 10. ) THEN
            IF ( fl .gt. sfcz(i) ) THEN
                wdown = windex(i)*(frzlz(i)-fl)/frzlz(i)
                IF ( wdown .gt. 10.0 ) THEN
                  edrdown = (.035+.0016*(wdown-10.0))**.333
                ELSE IF ( wdown .gt. 0.0 ) THEN
                  edrdown = (.0035*wdown)**.333
                ELSE
                  edrdown = 0.0
                END IF
                edr (i) = MAX (edr(i), edrdown)
          END IF
        END IF
    END DO
```

Figure 4B:
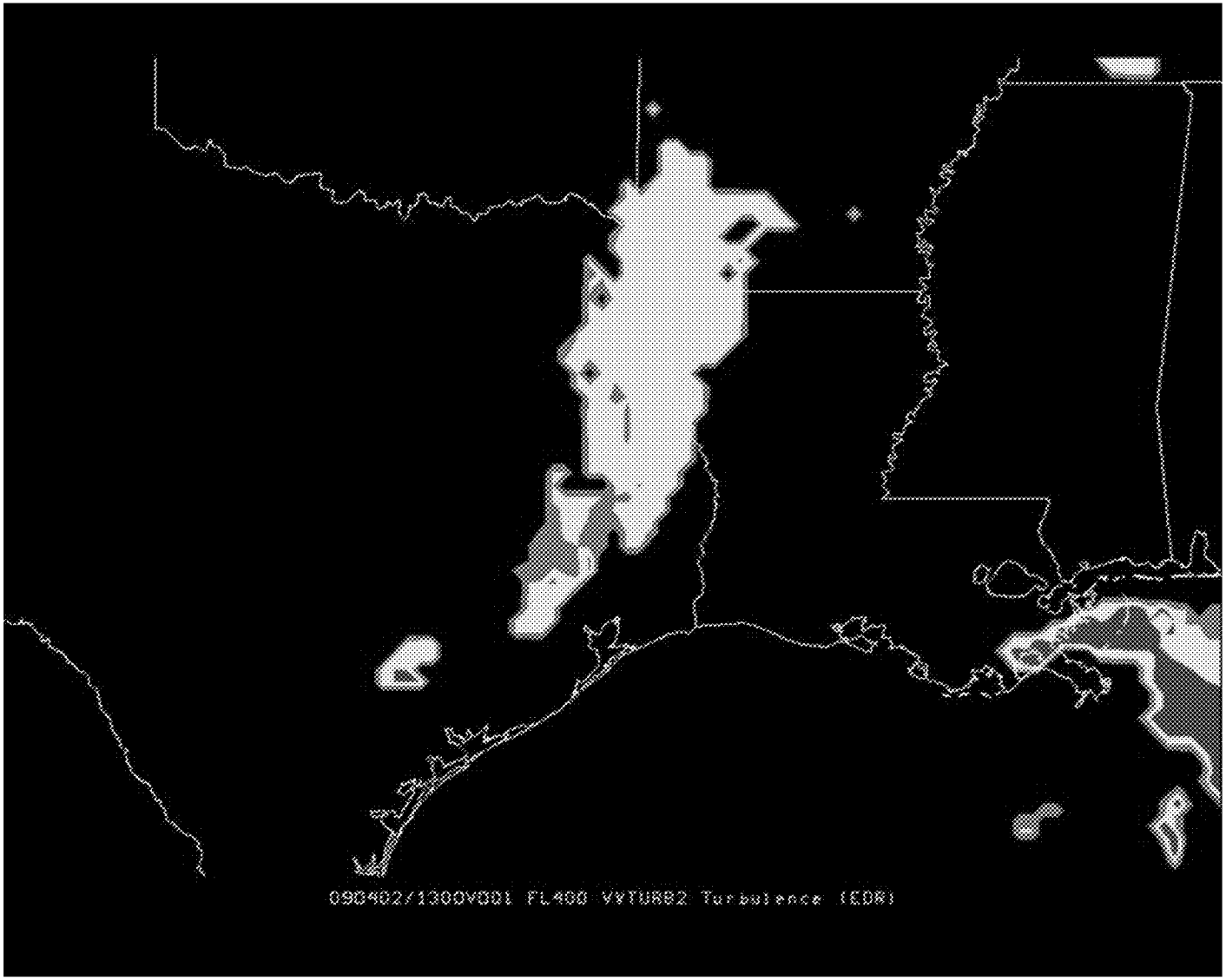
FIG. 4B provides example output from an enhanced above-storm turbulence determination.

The following code fragment shows an additional or alternative embodiment of component embodiments to address above-storm turbulence for some embodiments, an example image resulting for which is shown in FIG. 4B:

```
            C* Compute turbulence above storm top.
            C
                IF ( (wsq .le. 0.0) .and. havtop (i) ) THEN
                  stab = SQRT(bvsq(i))
                  dopu = u(i) - ufrzl(i)
                  dopv = v(i) - vfrzl(i)
                  dopspd = SQRT(dopu*dopu + dopv*dopv)
                  pnu = dden(i)*stab*dopspd
                  IF ( dopspd .eq. 0.0 ) THEN
                    ahat = 2.5
                  ELSE
                    ahat = ovshoot(i)*stab/dopspd*SQRT(pnu0(i)/pnu)
                  END IF
                  IF (ahat .gt. 2.5) ahat = 2.5
                  IF (ahat .ge. 1.0) THEN
                    edrtop = (drag(i)*.0004)**.333
```

-continued

```
                    edr(i) = MAX(edr(i), edrtop)
                    drag(i) = drag(i)*((2.5-ahat)/1.5)
                  END IF
                END IF
              END DO
            C
```

Figure 5:
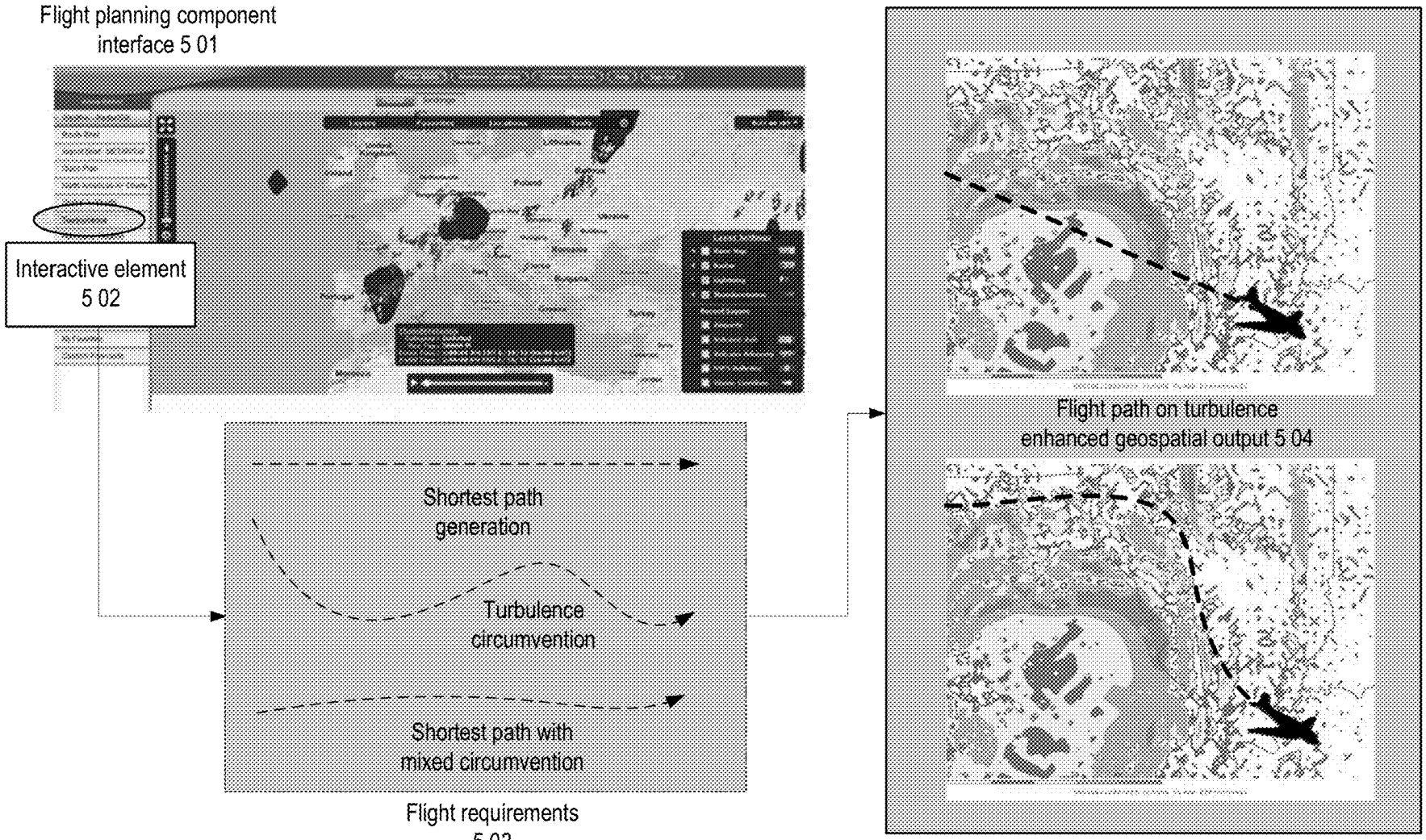
FIG. 5 demonstrates an example user interface where turbulence prediction is integrated into an existing and/or future flight planning tool, allowing users to alter flight path creation to account for projected turbulence in some embodiments of the DTEC.

FIG. 5 shows an example of how the DTEC may be incorporated into existing and/or prospect flight planning tools. The DTEC may be included with online services, with desktop services, with mobile applications, and/or the like. In this embodiment of the disclosure, a flight planning tool has an interface 501 representative of an online flight planning service with user profile information. As an interactive element 502, the DTEC may allow users to factor integrated turbulence prediction into flight path creation. The DTEC may allow users to consider several ways of incorporating turbulence prediction into their flight path considering their flight requirements 503. In this example, the DTEC may offer shortest path generation where turbulence may not be a considering factor in flight path creation, turbulence circumvention where turbulence avoidance is a serious flight consideration, some turbulence circumvention with emphasis on shortest path generation where turbulence avoidance warrants some consideration, but may not be a primary goal and/or the like. The DTEC may then generate an enhanced, integrated turbulence forecast within the specified flight path region 504 and suggest flight path alterations with respect to the level of turbulence circumvention desired.

Figure 6:
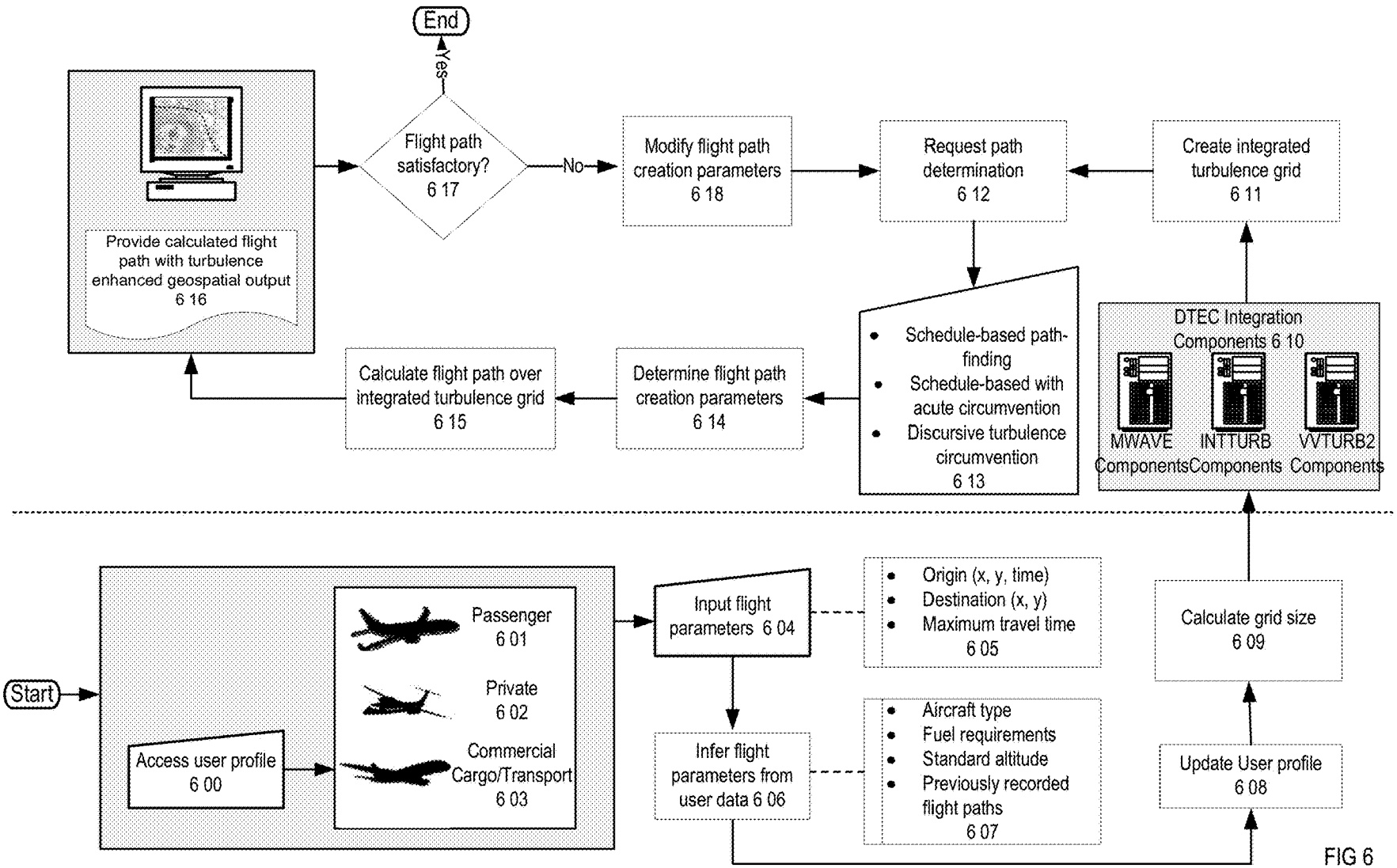
FIG. 6 shows a logic flow diagram illustrating an example of a DTEC integrating turbulence modeling into flight path creation, facilitating user preference in flight planning variation in some embodiments of the DTEC.

FIG. 6 shows one example of an expanded logic flow diagram of flight path considerations when the DTEC is part of an integrated flight planning tool. In one embodiment of the disclosure, the flight planning service may access/input user profile information 600 which may include such information type of aircraft and/or flight service such as passenger 601, private 602 and/or commercial cargo/transport 603, the consideration of which may influence turbulence avoidance (i.e. commercial cargo transport may prioritize shortest path with minimal evasion while passenger may emphasize discursive turbulence circumvention over speed or directness). The DTEC may request additional user profile information for flight path construction 604. In some embodiments of the disclosure, such information may include the origin grid point and departure time of the flight, the destination grid point, and/or the maximum travel time the flight can utilize in constructing its path 605. In some embodiments of the disclosure, the DTEC may infer user information from previously stored user profile data and/or prior flight path generation 606. In some embodiments, this information may include the aircraft type, its fuel requirements, its standard flying altitude, previous planned flight paths, and/or the like 608. In some embodiments, user profile and flight creation information that is both input and/or inferred by the DTEC may be used to update the user profile data for future DTEC use 608. In some embodiments of the disclosure, the DTEC may use other stored profile information where similar parameters resulted in successful flight path creation. In some embodiments of the disclosure, the DTEC may use additional input, such as those from sources external to the flight planning tool, such as historical flight plan data and/or the like. The DTEC may then calculate the grid size of the region 609 over which the DTEC may consider flight path creation, using input such as the origin, destination, maximum flight time, and/or facilities of the aircraft and/or type of flight. In some embodiments of the disclosure, two dimensional grid space may be considered for initial path planning purposes. In some embodiments of the disclosure, three dimensional grid space may be considered for path planning purposes. In some embodiments of the disclosure, two dimensional grid space may be considered for initial path planning purposes, which may then be integrated with additional dimensional information as necessary to accurately determine available grid space inside which the flight path may still meet flight path parameters.

In some embodiments of the disclosure, this initial input component may then be followed by DTEC turbulence integration 610 of the generated geospatial grid region, some examples of which have been described in FIGS. 2, 3, and 4. The DTEC may create an overlay to the generated grid region 611 and may request additional information about the desired parameters of the flight path through this grid region 612. In some embodiments of the disclosure, these parameters may include schedule-based path-finding (shortest path immediacy), schedule-based but with circumvention of acute turbulence (shortest path avoiding high hazard turbulence areas), discursive turbulence circumvention (navigating out of turbulence areas), and/or any combination of or intermediate stage to these parameters. The DTEC may then use available input as described in the input component to determine all flight path creation parameters 614. The DTEC may then create a flight path over the integrated turbulence grid region 615, considering flight path creation parameters 613. The DTEC may then display the proposed flight path to the user as a terminal overlay, standard or high definition map overlay and/or the like 616, as is applicable to the flight planning tool. If the flight path is satisfactory 617, the user may then exit the flight path planning component of the DTEC as an incorporated flight planning tool option, In some embodiments of the disclosure, the DTEC may allow the user to export the determined flight path to other media, save the flight path to the user profile, share the flight path with additional users, and/or the like. In some embodiments of the disclosure, if the proposed flight path is not satisfactory 617, the DTEC may allow the user to modify flight path creation parameters 618. In some embodiments of the disclosure, the user may reenter a flight path creation component as specified in earlier steps 612. In some embodiments of the disclosure, users may be allowed to visually manipulate flight path options using the proposed flight path turbulence grid overlay. In some embodiments of the disclosure, the user may be able to reenter flight path creation, visually manipulate the proposed flight path and/or combine these methods in any intermediate path modification.

Figure 7:
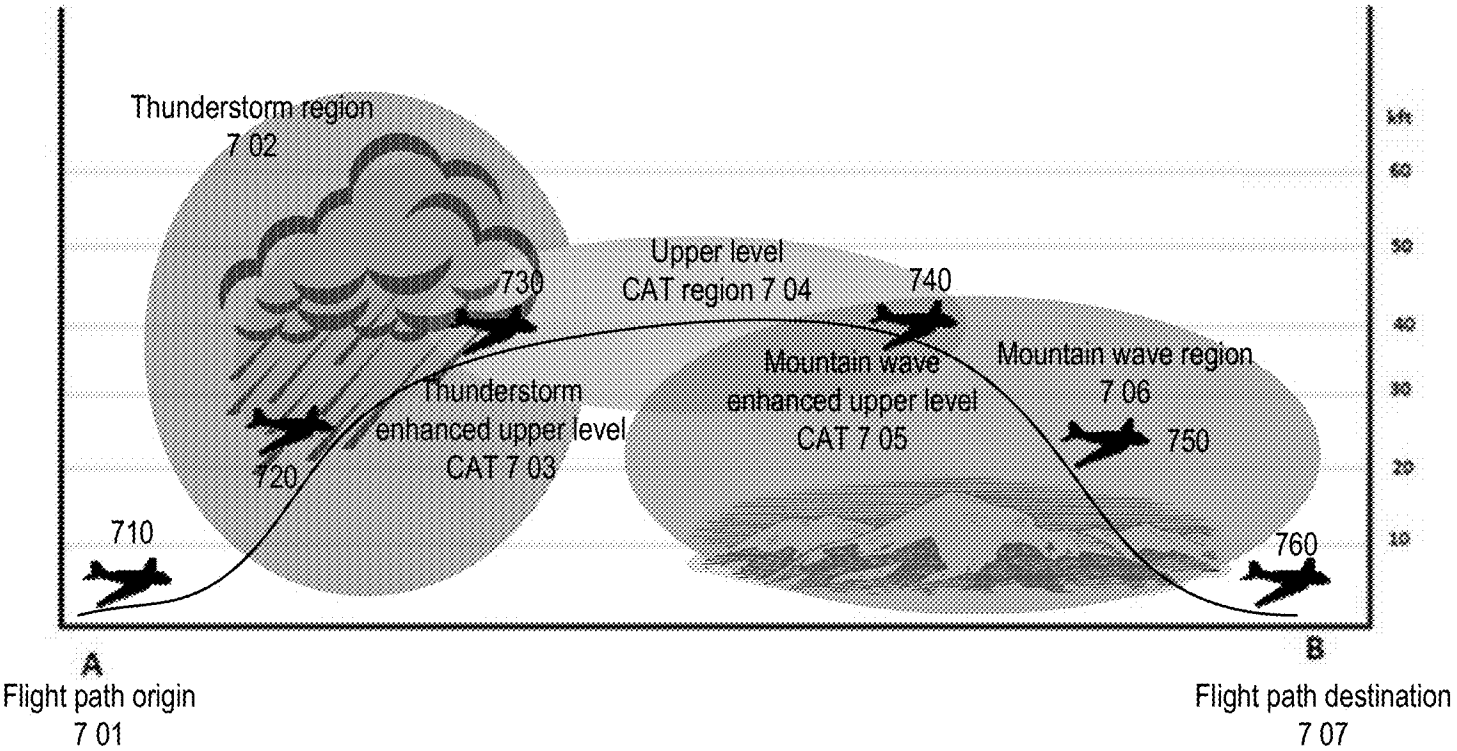
FIG. 7 shows an overview diagram illustrating an example of a vertical air region and the overlay of turbulent areas affecting aircraft at various altitudes and times, where overlapping regions illustrate enhanced turbulence in some embodiments of the DTEC.

FIG. 7 shows an example of a vertical slice dissection of a proposed flight path through which an aircraft may pass through multiple turbulence types and where an aircraft may experience enhanced turbulence integration as calculated by the DTEC. In this example, the aircraft experiences no turbulence at either origin A 701 or destination B 707, but as the aircraft rises through the atmosphere along the projected flight path, it may begin to encounter turbulence regions. In this example, between 20 and 30 kilofeet (kft), the aircraft at position 720 has encountered a thunderstorm region 702. As the aircraft moves directionally forward along its flight path, it reaches the upper level 704 where CAT may be pronounced. In this example, the aircraft at position 730 is in an enhanced thunderstorm and upper level CAT region where integrated turbulence as calculated by the DTEC may show greater turbulence hazard than either turbulence regions, separately or combined in a conventional summation. In this example, at position 740 the aircraft has moved into an enhanced upper level and mountain wave turbulence region 705 which, as calculated by the DTEC, may show greater turbulence hazard than either turbulence regions, separately or combined in a conventional summation. At position 750, the aircraft descends in a mountain turbulence region where mountain and gravity wave turbulence may be pronounced. At position 760, the aircraft has arrived at its destination, having experienced multi-hazard turbulence events in both singular and overlap turbulence regions.

Figure 8:
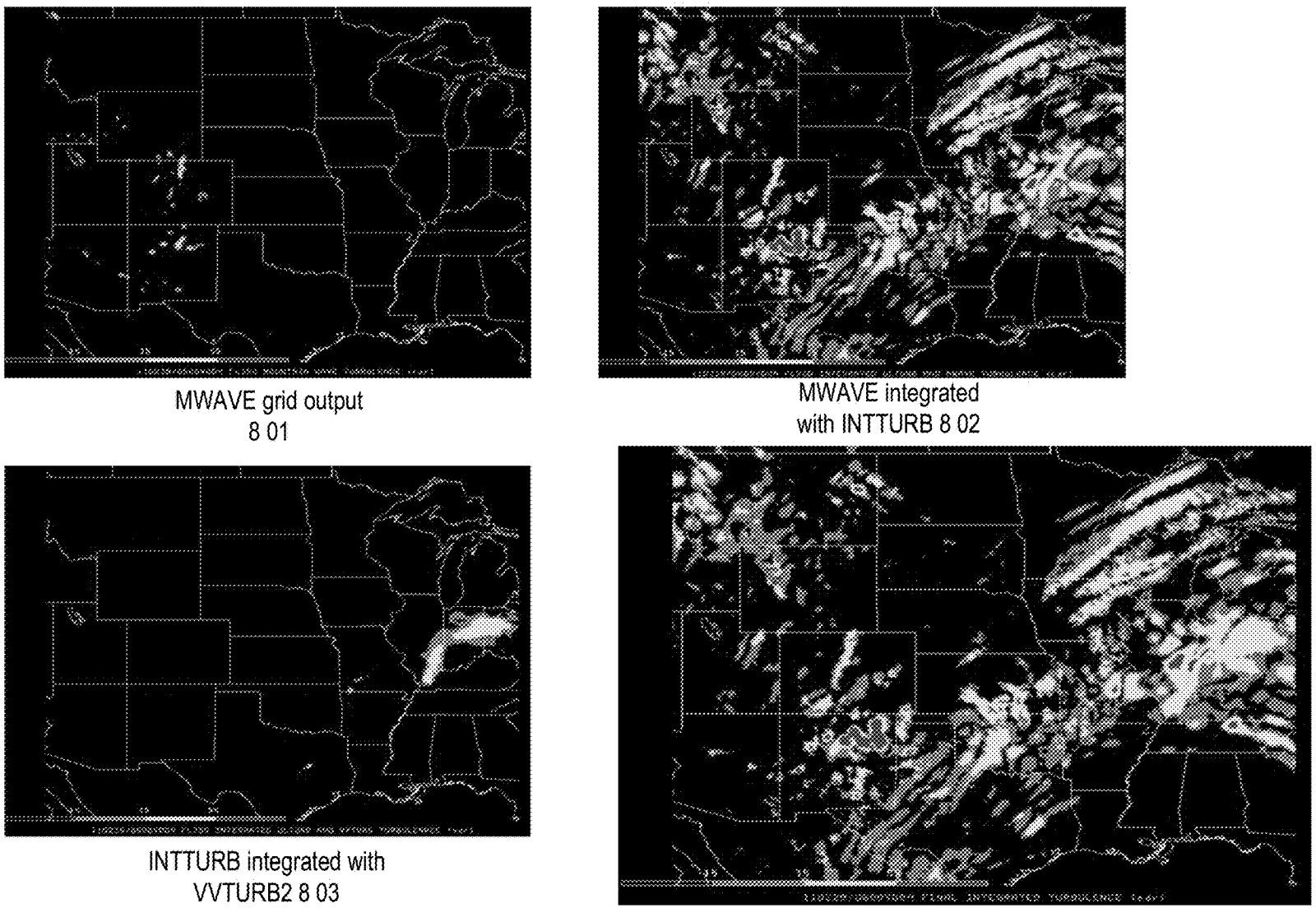
FIG. 8 shows example grid outputs of the mathematical models both pre and post integration, illustrating how enhanced turbulence is more than graphical intersection and represents both cumulative and heightened turbulence in overlay zones in some embodiments of the DTEC.

FIG. 8 shows an example grid output of one embodiment of the DTEC, where integration components may produce staged map overlays of each component of the DTEC turbulence calculation process. In some embodiments of the DTEC, the DTEC may show an initial MWAVE grid output 801, incorporating MWAVE turbulence calculations into a singular, non-enhanced turbulence map overlay. In one embodiment of the DTEC, the map overlay may be color-coded to indicate areas of turbulence hazard where clear represents no turbulence, green represents light turbulence hazard, yellow represents moderate turbulence hazard, and red represents severe turbulence hazard. In some embodiments of the disclosure, the DTEC may output a forecast as a four-dimensional grid of EDR values in multiple file formats, such as GRIB2 and/or geometric vector data such as Geographic Information System (GIS) shapefiles, for use in any GIS display, software, integrator, and/or the like. In one embodiment of the disclosure, the DTEC may display the results of the integration of its MWAVE and INTTURB components 802, with enhanced turbulence regions. In some embodiments of the DTEC, the output may be a color-coded map overlay, export files for use in geospatial display systems, and/or the like. In one embodiment of the disclosure, the DTEC may then display the integration of its INTTURB component with its VVTURB2 component 803. In some embodiments of the DTEC, the output may be a color-coded map overlay, export files for use in geospatial display systems, and/or the like. In one embodiment of the disclosure, the DTEC may display a finalized output of turbulence integration component 804, as described in FIGS. 2, 3, and 4. In some embodiments of the DTEC, the output may be a color-coded map overlay, export files for use in geospatial display systems, and/or the like. In some embodiments of the disclosure, these outputs may be available as separate data feeds, software/tool options, export files and/or the like. In some embodiments of the disclosure, these outputs may be available internally to the DTEC and only integrated outputs available externally in the form of data feeds, software/tool options, export files, and/or the like.

Figure 9:
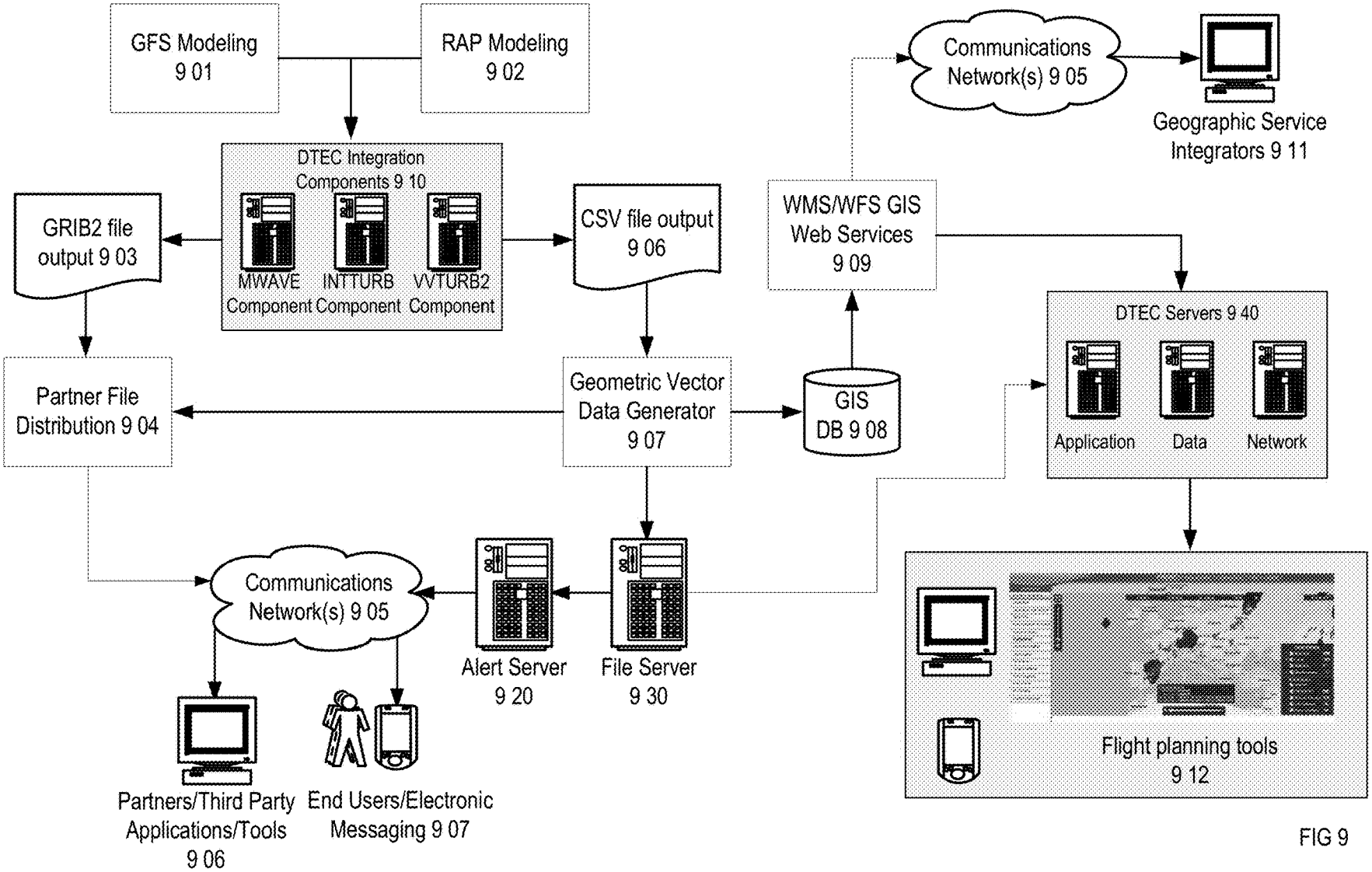
FIG. 9 shows an example data flow diagram of various output media provided by the DTEC and the use of its data in multiple intermediate and end stage applications in some embodiments of the DTEC.

FIG. 9 demonstrates one example of how DTEC integration component(s) may incorporate external data feeds and may provide various partners, third party software applications/tools, end users, integrators, internal and external flight planning services, and/or the like with integrated turbulence output in the form of comma-separated value (CSV), geometric vector data files, gridded binary (GRIB) format, data feeds, and/or the like. In one embodiment, the DTEC receives and/or requests global models/modeling data for a variety of weather and/or geographic models, including but not limited to global models and/or regional models. In some embodiments, Global Forecast System (GFS) modeling 901 from the National Oceanic and Atmospheric Administration (NOAA) is utilized as input. In some embodiments, the DTEC receives Rapid Refresh (RAP) 902 modeling from the NOAA as input. In some embodiments, the DTEC receives GEM (Global Environmental Multiscale Model) as input. In some embodiments, the DTEC receives ECMWF modeling as input. In one embodiment, the DTEC receives GFS, RAP, GEM, ECMWF, and/or similar modeling information as input. Some embodiments of the DTEC are model agnostic. In some embodiments the DTEC produces one or more GRIB2 file(s) 903 and/or record outputs that may be appended in GRIB format for use in file distribution by DTEC partners 904. In some embodiments, DTEC partners may distribute DTEC output through various communication networks 905 such as local area networks (LAN) and/or external networks such as the internet which may provide DTEC partners, third party applications/tools 906, and/or end users 907 with DTEC output. In some embodiments of the DTEC, such output may be in propagated GRIB files as provided to DTEC partners. In some embodiments of the DTEC, such output may be converted to a visual form for display on a web browser, smart phone application, software package and/or the like. In some embodiments of the DTEC, electronic messaging 907 such as email, SMS text, push notifications, and/or the like may be employed to alert end users of important data updates from the DTEC, DTEC partners, and/or other parties providing DTEC output data.

In some embodiments, the DTEC may provide a file or data stream as output, in which values of the DTEC during component production, including but not limited to EDR finalization, may be recorded or provided. One example of a DTEC CSV output file is provided below, showing an in-flight time sequence of forecasted turbulence:

vector data files, such as shapefiles, for storage in GIS database(s) 908. In some embodiments of the DTEC, Web Mapping Services (WMS) and/or Web Feature Services (WFS) 909 may obtain the geometric vector data files from GIS database(s) and provide geographic service integrators 911 with DTEC output data through various communication networks 905 as described. In some embodiments of the DTEC, file server(s) 908 and/or WMS may incorporate the DTEC output data into a DTEC integrated server 940 with application, data, and/or network components. A DTEC integrated server may employ such output data from DTEC determination components in proprietary software tools, web services, mobile applications and/or the like. In one embodiment of the DTEC, a DTEC integrated server may employ DTEC component output for use in flight planning tools 912, such as AviationSentry Online®.

Figure 10A:
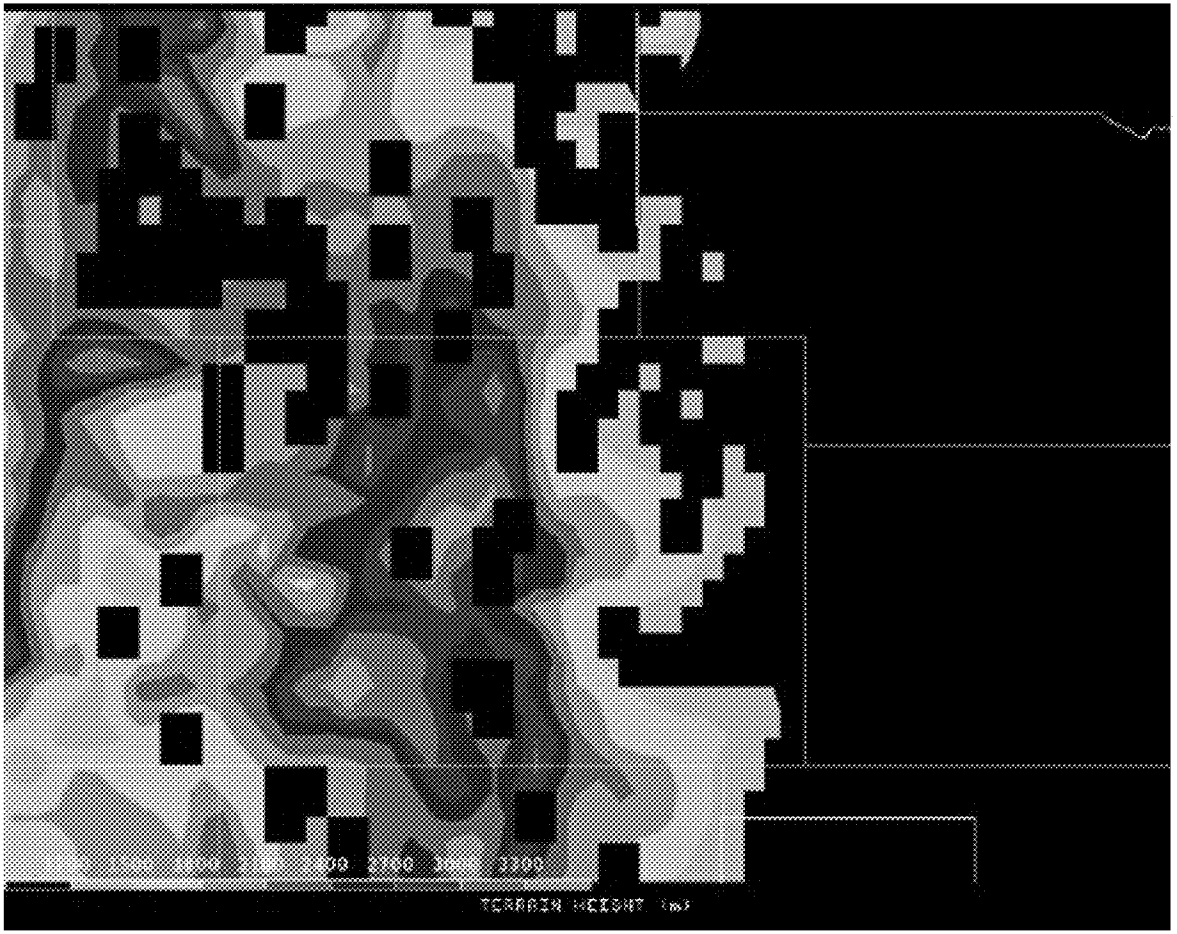
FIGS. 10A-B and 11A-D show various example and/or visual input/output component aspects of the DTEC.

FIG. 10A shows an example terrain height map 1001 in meters over the Colorado area in the 0.25 deg latitude/longitude grid world terrain database. In this embodiment of the DTEC, black areas are regions where the terrain is relatively flat.

Figure 10B:
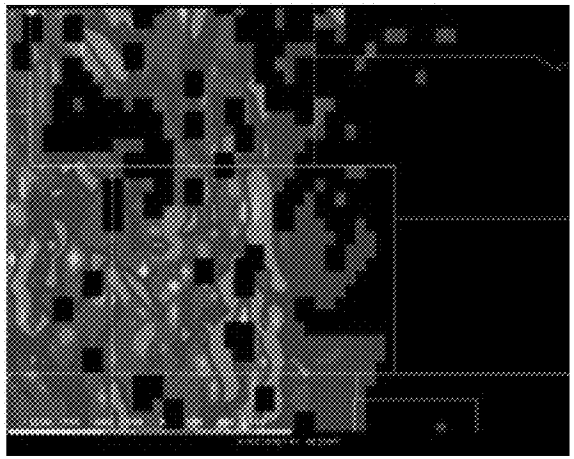
Figure 10B:
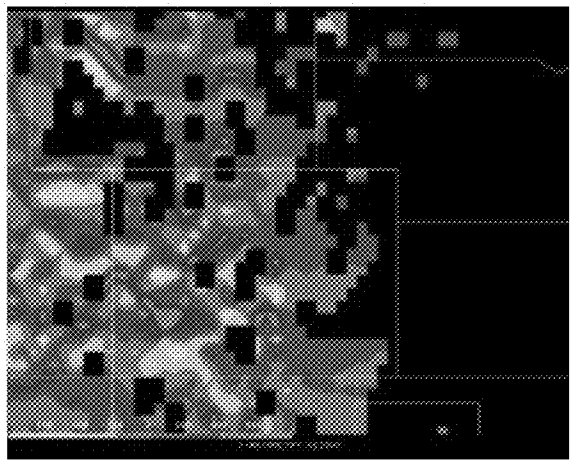

FIG. 10B shows two examples of asymmetry in computed terrain height as described in 10A along x and y directions. In one embodiment of the DTEC, asymmetry is computed as the negative height change in the east (x) direction 1002. In one embodiment of the DTEC, asymmetry is computed as the negative height change in the north (y) direction 1003.

Flight PHX-MSP dd mm yyyy Leave: 0413Z Arrive: 0646Z
Turbulence Forecast (EDR*100)

| Time | Latitude | Longitude | Altitude (kft) | MWAVE | COMTURB | VVTURB | INTTURB | VVINTTURB | Final | Explanation |
|---|---|---|---|---|---|---|---|---|---|---|
| 415 | 33.5 | −111.8 | 50 | 0 | 0 | 0 | 0 | 1 | 1 | |
| 425 | 34.5 | −111.6 | 250 | 0 | 0 | 0 | 0 | 26 | 26 | Near-storm turbulence |
| 435 | 35.4 | −110.3 | 370 | 0 | 0 | 0 | 0 | 1 | 1 | |
| 445 | 36.2 | −109 | 370 | 0 | 0 | 1 | 25 | 1 | 25 | Mountain wave and free gravity wave amplitudes combine |
| 455 | 36.9 | −107.7 | 370 | 0 | 0 | 0 | 0 | 0 | 0 | |
| 505 | 37.3 | −106 | 370 | 0 | 0 | 0 | 0 | 34 | 34 | Storm top turbulence |
| 515 | 38.1 | −104.7 | 370 | 0 | 0 | 1 | 35 | 1 | 35 | Mountain wave and free gravity wave amplitudes combine |
| 525 | 38.9 | −103.6 | 370 | 0 | 0 | 1 | 0 | 1 | 1 | |
| 535 | 39.9 | −102.3 | 370 | 0 | 45 | 0 | 45 | 0 | 45 | |
| 545 | 40.9 | −101 | 370 | 0 | 0 | 1 | 0 | 1 | 1 | |
| 555 | 41.8 | −99.7 | 370 | 0 | 51 | 1 | 51 | 1 | 51 | |
| 605 | 42.6 | −98.5 | 370 | 0 | 34 | 0 | 34 | 0 | 34 | |
| 615 | 43.5 | −97 | 370 | 0 | 30 | 1 | 30 | 1 | 30 | |
| 625 | 44.4 | −95.3 | 290 | 0 | 18 | 43 | 18 | 43 | 43 | |
| 635 | 44.7 | −94 | 100 | 0 | 0 | 24 | 0 | 24 | 24 | |
| 645 | 44.8 | −93.2 | 20 | 0 | 19 | 0 | 19 | 51 | 51 | Near-storm turbulence |

In some embodiments of the DTEC, a file or feed (e.g., a CSV file) output from the DTEC may be provided as input to a geometric vector data generator 907, which may provide additional data output options. In some embodiments of the DTEC, the geometric vector data generator may output geometric vector data files to a file server 930 which may provide the data output to an alert server 920 which may provide the output a communications networks 905 to such partners, third parties, software applications, end users and/or the like as described. In some embodiments of the DTEC, the geometric vector data generator may output geometric FIG. 11A shows one example of a 3-hour RAP model forecast 1101 showing Streamlines and isotachs (kts) of the forecast flow at 250 mb (near FL350).

Figure 11A:
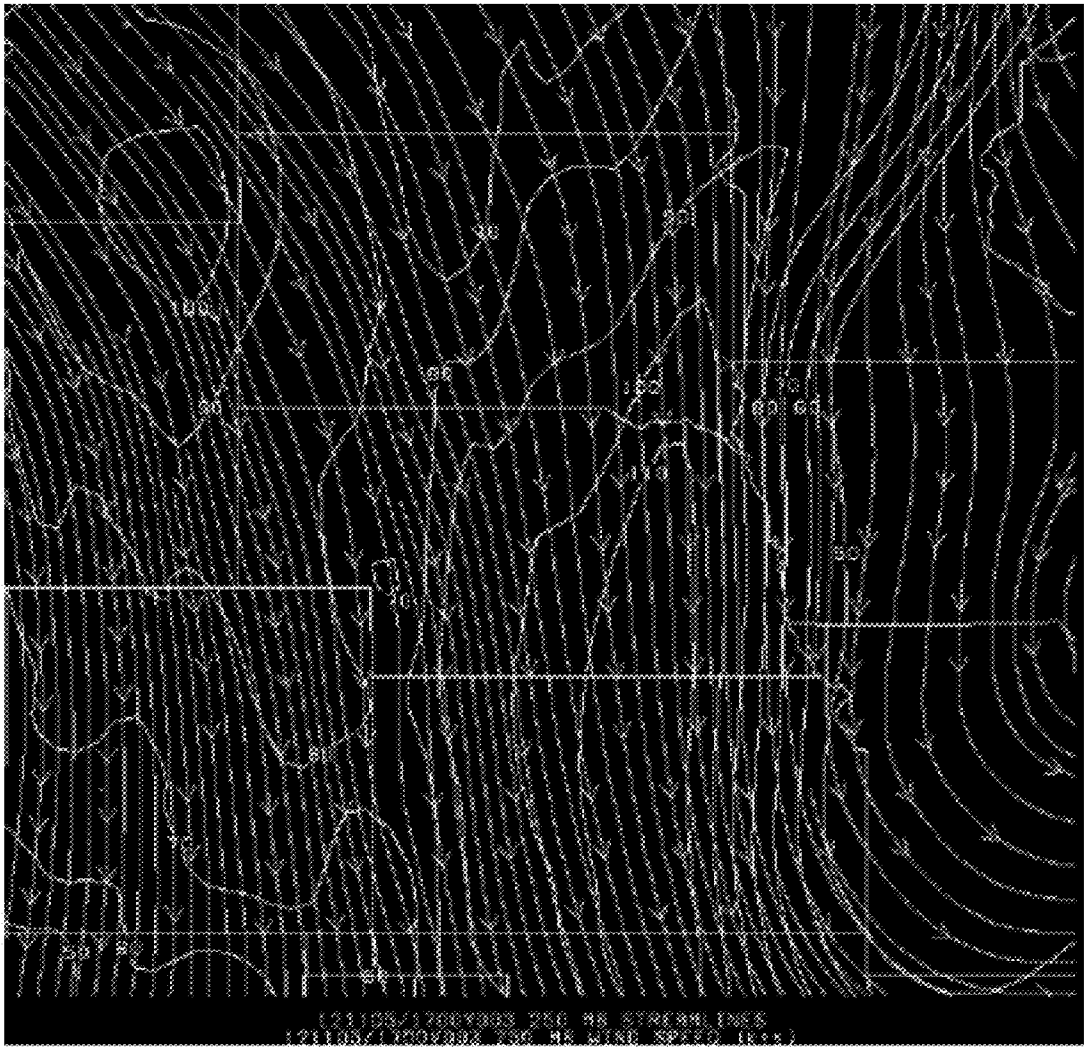
Figure 11B:
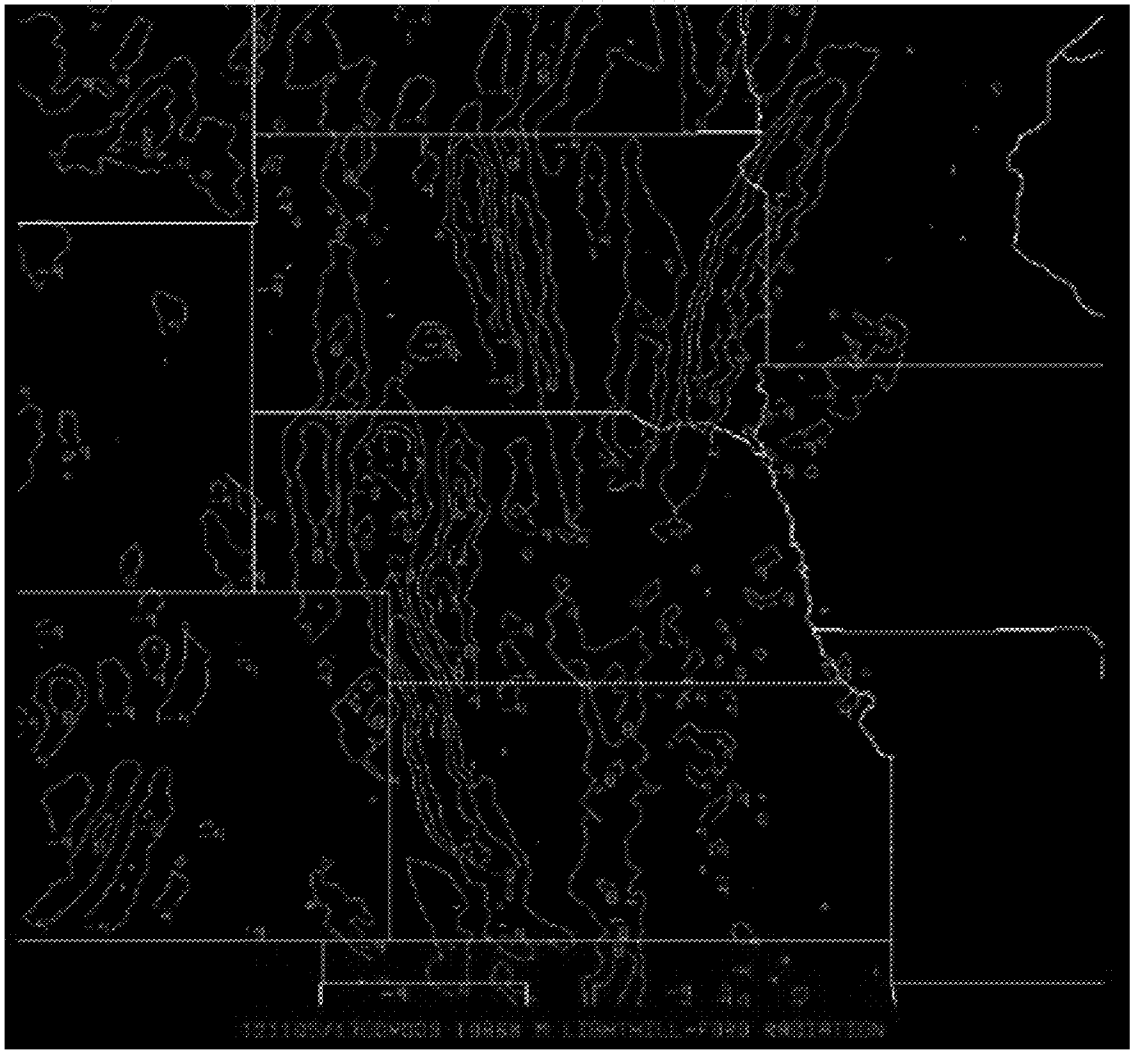

FIG. 11B shows one example of Lighthill-Ford radiation 1102 computed at 10668 m (FL350) for the forecast flow shown in FIG. 11A. Lighthill-Ford radiation is the gravity wave diagnostic in ULTURB, a component of the DTEC, in one embodiment of the DTEC.

Figure 11C:
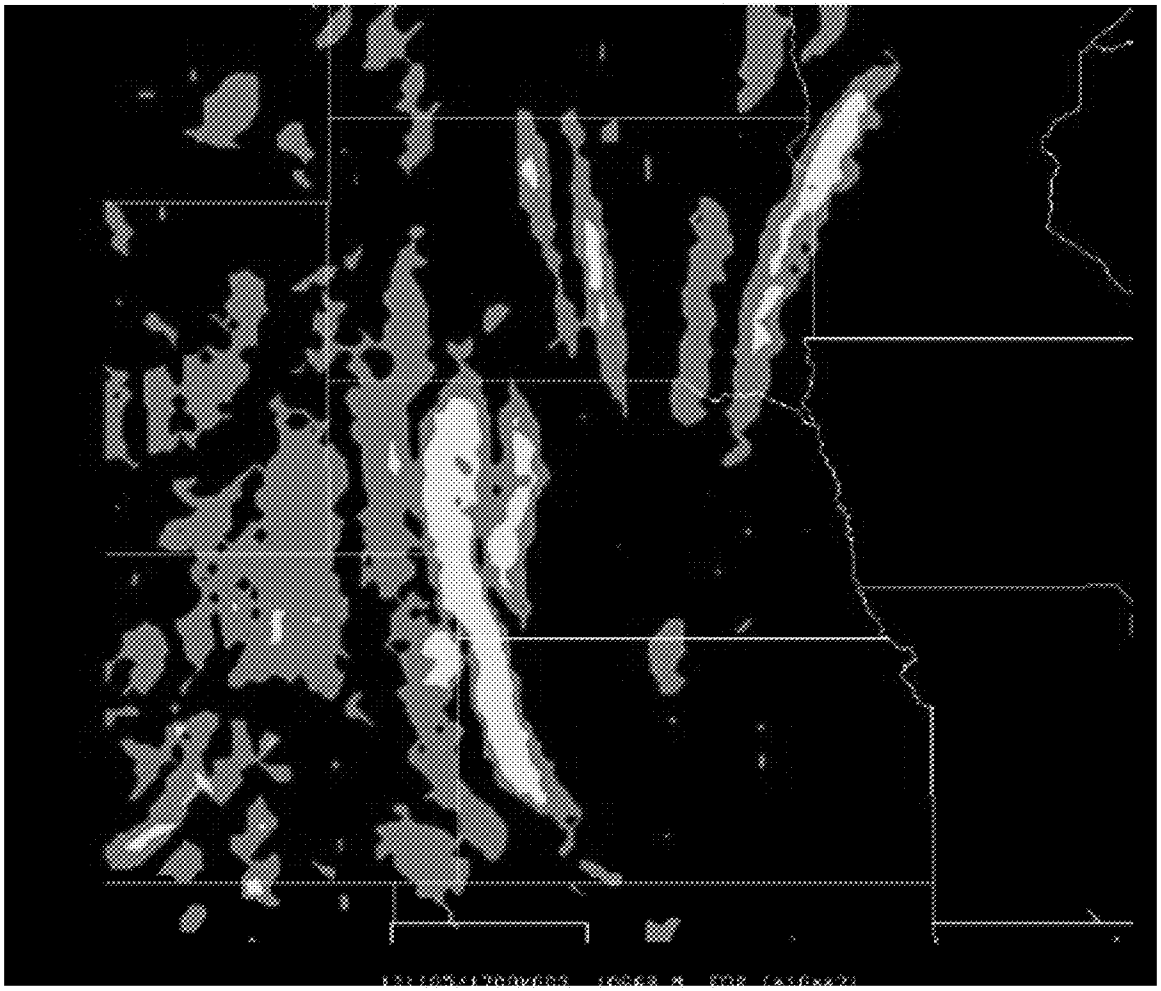

FIG. 11C shows one example of ULTURB turbulence forecast 1103 in EDR values for the forecast flow described in FIG. 11A. ULTURB, a component of the DTEC in one embodiment, combines the gravity wave diagnostic described in FIG. 11B, the Richardson number, and the vertical wind shear.

Figure 11D:
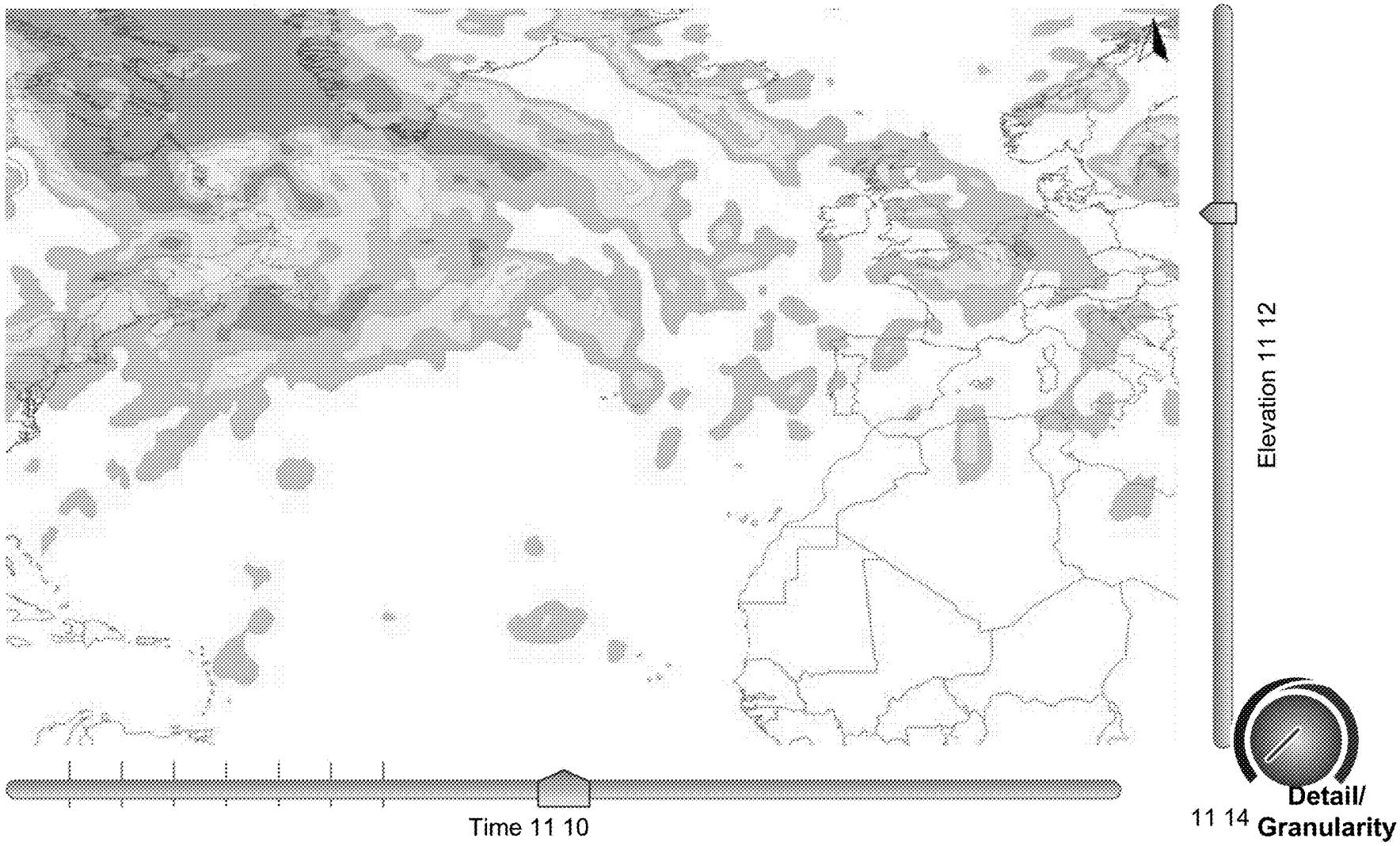

FIG. 11D provides an example of output generated by the DTEC, a 4D grid of EDR values, which may be made available in several forms including, by way of non-limiting example, GRIB2 format and GIS shapefiles. As discussed above, EDR value is the Eddy Dissipation Rate and is defined as the rate at which kinetic energy from turbulence is absorbed by breaking down the eddies smaller and smaller until all the energy is converted to heat by viscous forces. EDR is expressed as kinetic energy per unit mass per second in units of velocity squared per second ($m^2/s^3$). The EDR is the cube root of the turbulent kinetic energy (TKE). When adding the EDR values together from VVTURB2 and INTTURB, the values may be converted back to TKE, added together, and converted back to EDR (take the cube root of the sum).

FIG. 11D also illustrates various interface features that may be used to navigate the four-dimensional grid, such as a time slider 1110 to move through various calculated time grids, an elevation slider 1112 to view various elevations, and a detail widget, to adjust the granularity/detail of the displayed turbulence interface.

Figure 12:
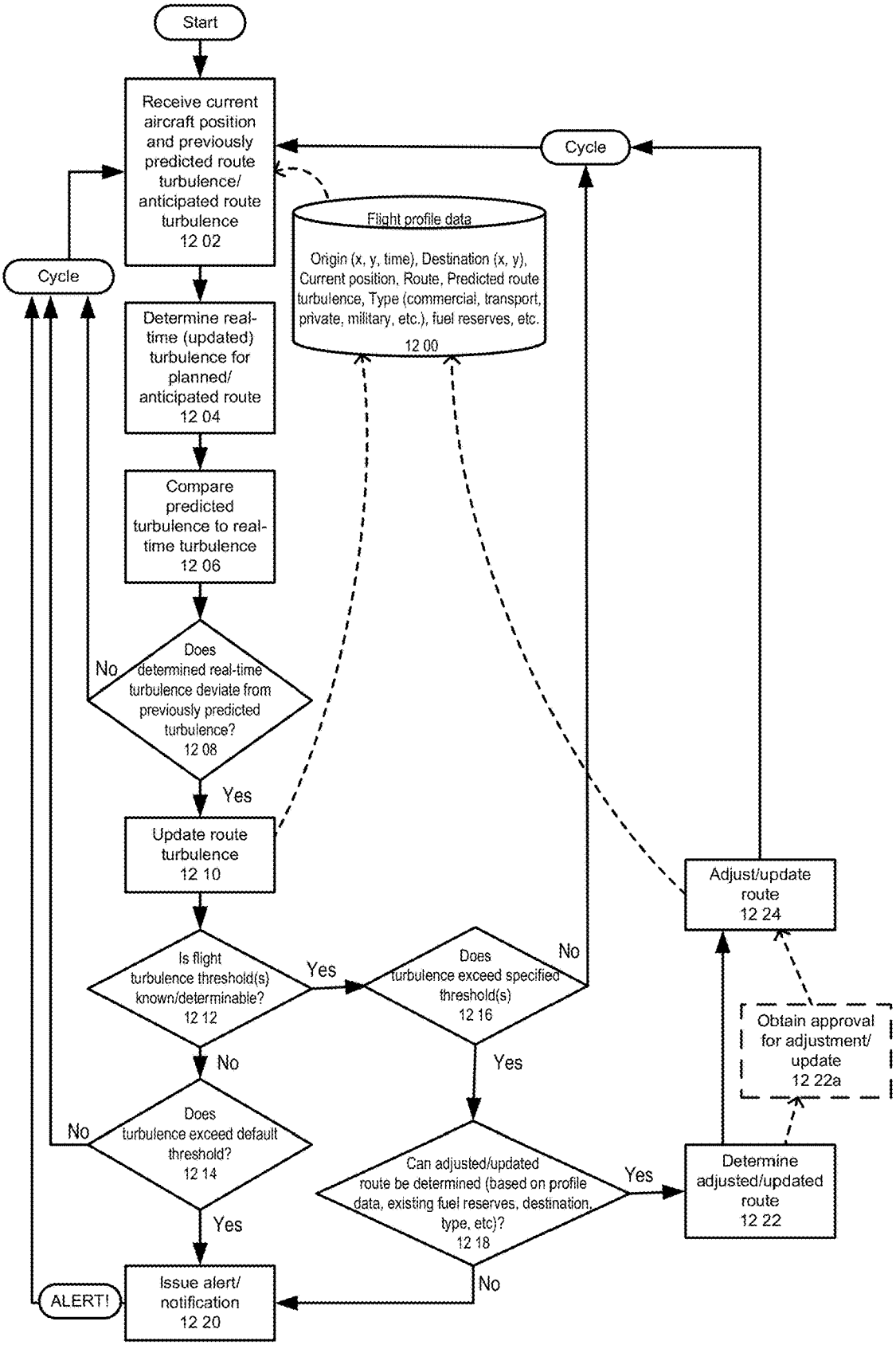
FIG. 12 provides an example logic flow for a real-time flight alerting and planning component of the DTEC.

FIG. 12 provides an example logic flow for aspects of a real-time flight alerting and planning component in one embodiment of the DTEC. As discussed, the DTEC may provide flight planning tools. Additionally or alternatively, the DTEC may provide flight plan adjustments/modifications and/or alerts if weather/turbulence determinations change, for example, if an airplane were on a particular course that, based on real-time turbulence determinations, had become potentially dangerous.

As shown in the figure, the DTEC alerting component receives (and or retrieves via response to a database query) current aircraft position 1202 (e.g., flight profile data 1200 from a flight profile database), and may also receive the previously predicted turbulence for that route (or for an anticipated route if the actual flight plan is not provided). The DTEC then determines real-time turbulence for the planned route 1204 and compares the predicted turbulence to the real-time turbulence 1206. If the newly determined real-time turbulence does not deviate notably 1208 from the previously predicted/anticipated turbulence, then the process cycles, e.g., for a certain period (1 min, 2 min, 5 min, 10 min, etc.) or for some other measure such as location of one or more aircraft, weather events, and/or the like. If the newly determined real-time turbulence is a notable deviation or significant difference from the previously predicted turbulence 1208, then the turbulence is updated 1210 and the process continues. Note that the threshold difference or deviation may be set by the DTEC or DTEC user/subscriber, and in some embodiments may be any numerical change, while in other embodiments may be a change or certain magnitude or percentage.

When the turbulence is updated, the DTEC determines if there is a known or determinable turbulence threshold 1212 for the flight/aircraft. For example, a commercial passenger aircraft that subscribes to the DTEC may have set a particular turbulence threshold in the profile, reflecting that passenger aircraft may wish to avoid significant turbulence for safety and comfort reasons, while a cargo aircraft may have a much higher threshold and be willing to undertake more turbulence to save time and/or money. The threshold may also be predicted/determined based on the airframe and/or airfoil type, the user, the flight plan, fuel resources, alternative routes, etc. For flights/aircraft that the turbulence threshold either is not known or is not determinable 1212, the DTEC may have a default (i.e., safety) threshold 1214, and if that default threshold is exceeded 1214, may issue an alert or notification 1220 to the aircraft (and/or ground control).

If the flight turbulence threshold is known 1212 (i.e., the flight has a subscription or is otherwise registered with the DTEC), the DTEC determines whether the turbulence exceeds the specified threshold 1216, and if so, determines if the flight's route can be adjusted or updated 1218 by the DTEC (e.g., using the flight path component discussed in FIG. 5 and FIG. 6) to find the optimal path based on the desired turbulence profile/threshold and various flight parameters, such as fuel reserves, destination, aircraft type, etc. If the DTEC is unable or is not configured to provide an alternative or adjusted flight plan 1218, an alert or notification 1220 is generated/issued. If the DTEC can adjust or update the flight's route 1218, the adjusted/modified route is determined 1222 and the flight plan is adjusted accordingly 1224, and updated 1200. Note that, in some embodiments, an adjusted or modified flight plan (or a selection of plans) may be provided for approval or selection 1222*a*.

In some embodiments, the DTEC server may issue PHP/SQL commands to query a database table (such as FIG. 13, Profile 1319*c*) for profile data. An example profile data query, substantially in the form of PHP/SQL commands, is provided below:

```
<?PHP
header ('Content-Type: text/plain');
mysql_connect ("254.93.179.112",$DBserver, $password) ; //
access database server
mysql_select_db ("DTEC_DB.SQL"); // select database table to
search
//create query
$query = "SELECT field1 field2 field3 FROM ProfileTable
WHERE user LIKE '%'
   $prof";
$result = mysql_query ($query); // perform the search query
mysql_close ("DTEC_DB.SQL"); // close database access
?>
```

The DTEC server may store the profile data in a DTEC database. For example, the DTEC server may issue PHP/SQL commands to store the data to a database table (such as FIG. 13, Profile 1319*c*). An example profile data store command, substantially in the form of PHP/SQL commands, is provided below:

```
<?PHP
header ('Content-Type: text/plain') ;
mysql_connect ("254.92.185.103",$DBserver, $password); //
access database server
mysql_select ("DTEC_DB.SQL"); // select database to append
mysql_query ("INSERT INTO ProfileTable (fieldname1,
fieldname2, fieldname3)
VALUES ($fieldvar1, $fieldvar2, $fieldvar3)"); //
add data to table in database
mysql_close ("DTEC_DB.SQL"); // close connection to database
?>
```

Various embodiments of the DTEC may be used to provide real-time, pre-flight and/or in-flight turbulence reporting, planning and response. The integrated, unified turbulence system provided by the DTEC may be used in flight equipment and/or ground equipment. The DTEC may provide weather/aviation decision support (e.g., via graphical displays) and/or provide alerts/triggers. Although it is discussed in terms of re-routing in time of increased turbulence, in some embodiments, the DTEC may identify more efficient paths based on real-time updates where there is decreased turbulence over a shorter physical distance, and may update a flight plan accordingly. The DTEC identifies 4D areas for flight hazards, and a user may choose or set their profile based on particular hazards (e.g., a passenger airline would have a different hazard/turbulence profile than an air freight company, and a large airliner would have a different profile from a small plane or helicopter). Various cost calculations and risk calculations may also be used in determining alerts and/or flight paths. In some embodiments, real-time feedback may come from plane-mounted instrument sensors and provide updates to predicted turbulence. Such information may be used to refine component configurations for turbulence determination. Although examples were discussed in the context of jet airliners, it is to be understood that the DTEC may be utilized for low-level services, such as helicopters, unmanned aerial vehicles, as well as high speed and/or military aircraft, and may even have potential ground applications, especially in mountainous terrain. The DTEC may work with air traffic control, particularly in management of routing. In some embodiments, the DTEC may input directly in avionics systems to guide planes.

Prior to the DTEC, forecasts of turbulence, if even available, were generally qualitative (e.g., light/heavy), independent of aircraft type, and did not include all sources of turbulence (e.g., they specifically exclude thunderstorms) or interactions of turbulence, thus making them unusable for most practical applications such as flight planning. The integrated turbulence forecast of the DTEC is unique because it dynamically determines the location and level at which each comprehensive turbulence determination is made, based on the meteorological conditions at that point in space and time. In some embodiments, the result is a single, integrated forecast that includes all sources of turbulence, and is produced in quantitative units, such as Eddy Dissipation Rate (EDR), thus making it suitable for practical uses, such as flight planning applications, and allows for categorical flexibility specific to an aircraft.

In some embodiments, the DTEC integrates three DTEC turbulence components, ULTURB, BLTURB, and MWAVE into one component/program called INTTURB. In some additional or alternative embodiments, the DTEC integrates VVTURB with ULTURB and BLTURB into a component/program called VVINTTURB. Output from all components may in EDR, an aircraft-independent metric of turbulence intensity. The DTEC may assign an EDR value at each model grid point and at each flight level. Observations of turbulence may also be used for further tuning of the forecast where and when they are available.

Various embodiments of the DTEC are contemplated by this disclosure, with the below exemplary, non-limiting embodiments A1-C84 provided to illustrate aspects of some implementations of embodiments of the DTEC.

A1. A dynamic turbulence engine controller processor-implemented flight planning method, comprising: receiving anticipated flight plan parameter data; obtaining terrain data based on the flight plan parameter data; obtaining atmospheric data based on the flight plan parameter data; determining a plurality of four-dimensional grid points based on the flight plan parameter data; for each point of the plurality of four-dimensional grid point: determining via a processor a non-dimensional mountain wave amplitude and mountain top wave drag, determining an upper level non-dimensional gravity wave amplitude, determining a buoyant turbulent kinetic energy, determining a boundary layer eddy dissipation rate, determining storm velocity and eddy dissipation rate from updrafts, determining maximum updraft speed at grid point equilibrium level, determining storm divergence while the updraft speed is above the equilibrium level and identifying storm top, determining storm overshoot and storm drag, determining Doppler speed, determining eddy dissipation rate above the storm top, and determining eddy dissipation rate from downdrafts; determining the turbulent kinetic energy for each grid point; identifying an at least one flight plan based on the flight plan parameter data and the determined turbulent kinetic energy; and providing the identified at least one flight plan.

A2. The method of embodiment A1, wherein the flight plan parameter data includes aircraft data.

A3. The method of embodiment A2, wherein the aircraft data includes airframe information.

A4. The method of embodiment A2 or A3, wherein the aircraft data includes airfoil information.

A5. The method of any of embodiments A1-A4, wherein the flight plan parameter data includes take-off time.

A6. The method of any of embodiments A1-A5, wherein the flight plan parameter data includes take-off location.

A7. The method of any of embodiments A1-A6 wherein the flight plan parameter data includes destination location.

A8. The method of any of embodiments A1-A7, wherein the flight plan parameter data includes cargo information.

A9. The method of any of embodiments A1-A8, wherein the flight plan parameter data indicates the flight is a passenger flight.

A10. The method of any of embodiments A1-A9, wherein the flight plan parameter data indicates the flight is a cargo flight.

A11. A DTEC platform flight planning apparatus, comprising a processor and a memory disposed in communication with the processor and storing processor-issuable instructions to: receive anticipated flight plan parameter data; obtain terrain data based on the flight plan parameter data; obtain atmospheric data based on the flight plan parameter data; determine a plurality of four-dimensional grid points based on the flight plan parameter data; determine a non-dimensional mountain wave amplitude and mountain top wave drag; determine an upper level non-dimensional gravity wave amplitude; determine a buoyant turbulent kinetic energy; determine a boundary layer eddy dissipation rate; determine storm velocity and eddy dissipation rate from updrafts; determine maximum updraft speed at grid point equilibrium level; determine storm divergence while the updraft speed is above the equilibrium level and identify storm top; determine storm overshoot and storm drag; determine Doppler speed; determine eddy dissipation rate above the storm top; determine eddy dissipation rate from downdrafts; determine the turbulent kinetic energy for each grid point; identify an at least one flight plan based on the flight plan parameter data and the determined turbulent kinetic energy; and provide the identified at least one flight plan.

A12. The apparatus of embodiment A11, wherein the flight plan parameter data includes aircraft data.

A13. The apparatus of embodiment A12, wherein the aircraft data includes airframe information.

A14. The apparatus of embodiment A12 or A13, wherein the aircraft data includes airfoil information.

A15. The apparatus of any of embodiments A11-A14, wherein the flight plan parameter data includes take-off time.

A16. The apparatus of any of embodiments A11-A15, wherein the flight plan parameter data includes take-off location.

A17. The apparatus of any of embodiments A11-A16, wherein the flight plan parameter data includes destination location.

A18. The apparatus of any of embodiments A11-A17, wherein the flight plan parameter data includes cargo information.

A19. The apparatus of any of embodiments A11-A18, wherein the flight plan parameter data indicates the flight is a passenger flight.

A20. The apparatus of any of embodiment A11-A19, wherein the flight plan parameter data indicates the flight is a cargo flight.

A21. A processor-readable tangible medium storing processor-issuable DTEC flight plan generating instructions to: receive anticipated flight plan parameter data; obtain terrain data based on the flight plan parameter data; obtain atmospheric data based on the flight plan parameter data; determine a plurality of four-dimensional grid points based on the flight plan parameter data; determine a non-dimensional mountain wave amplitude and mountain top wave drag; determine an upper level non-dimensional gravity wave amplitude; determine a buoyant turbulent kinetic energy; determine a boundary layer eddy dissipation rate; determine storm velocity and eddy dissipation rate from updrafts; determine maximum updraft speed at grid point equilibrium level; determine storm divergence while the updraft speed is above the equilibrium level and identify storm top; determine storm overshoot and storm drag; determine Doppler speed; determine eddy dissipation rate above the storm top; determine eddy dissipation rate from downdrafts; determine the turbulent kinetic energy for each grid point; and identify an at least one flight plan based on the flight plan parameter data and the determined turbulent kinetic energy.

A22. The medium of embodiment A21, wherein the flight plan parameter data includes aircraft data.

A23. The medium of embodiment A22, wherein the aircraft data includes airframe information.

A24. The medium of embodiment A22 or A23, wherein the aircraft data includes airfoil information.

A25. The medium of any of embodiments A21-A24, wherein the flight plan parameter data includes take-off time.

A26. The medium of any of embodiments A21-A25, wherein the flight plan parameter data includes take-off location.

A27. The medium of any of embodiments A21-A26, wherein the flight plan parameter data includes destination location.

A28. The medium of any of embodiments A21-A27, wherein the flight plan parameter data includes cargo information.

A29. The medium of any of embodiments A21-A28, wherein the flight plan parameter data indicates the flight is a passenger flight.

A30. The medium of any of embodiments A21-A29, wherein the flight plan parameter data indicates the flight is a cargo flight.

A31. A dynamic turbulence platform flight planning system, comprising: means to receive anticipated flight plan parameter data; means to obtain terrain data based on the flight plan parameter data; means to obtain atmospheric data based on the flight plan parameter data; means to determine a plurality of four-dimensional grid points based on the flight plan parameter data; means to determine a non-dimensional mountain wave amplitude and mountain top wave drag; means to determine an upper level non-dimensional gravity wave amplitude; means to determine a buoyant turbulent kinetic energy; means to determine a boundary layer eddy dissipation rate; means to determine storm velocity and eddy dissipation rate from updrafts; means to determine maximum updraft speed at grid point equilibrium level; means to determine storm divergence while the updraft speed is above the equilibrium level and identify storm top; means to determine storm overshoot and storm drag; means to determine Doppler speed; means to determine eddy dissipation rate above the storm top; means to determine eddy dissipation rate from downdrafts; means to determine the turbulent kinetic energy for each grid point; means to identify an at least one flight plan based on the flight plan parameter data and the determined turbulent kinetic energy; and means to provide the identified at least one flight plan.

A32. The system of embodiment A31, wherein the flight plan parameter data includes aircraft data.

A33. The system of embodiment A32, wherein the aircraft data includes airframe information.

A34. The system of embodiment A32, wherein the aircraft data includes airfoil information.

A35. The system of any of embodiments A31-A34, wherein the flight plan parameter data includes take-off time.

A36. The system of any of embodiments A31-A35, wherein the flight plan parameter data includes take-off location.

A37. The system of any of embodiments A31-A36, wherein the flight plan parameter data includes destination location.

A38. The system of any of embodiments A31-A37, wherein the flight plan parameter data includes cargo information.

A39. The system of any of embodiments A31-A38, wherein the flight plan parameter data indicates the flight is a passenger flight.

A40. The system of any of embodiments A31-A39, wherein the flight plan parameter data indicates the flight is a cargo flight.

A41. A DTEC platform flight planning system, comprising: means to receive anticipated flight plan data; means to obtain atmospheric data based on the flight plan data; means to determine a plurality of grid points based on the flight plan data; means to determine turbulent kinetic energy for each grid point; means to identify an at least one flight plan based on the flight plan data and the determined turbulent kinetic energy; and means to provide the identified at least one flight plan.

A42. The system of embodiment A41, comprising: means to determine a non-dimensional mountain wave amplitude and mountain top wave drag.

A43. The system of embodiment A41 or A42, comprising: means to determine an upper level non-dimensional gravity wave amplitude.

A44. The system of any of embodiments A41-A43, comprising: means to determine a buoyant turbulent kinetic energy.

A45. The system of any of embodiments A41-A44, comprising: means to determine a boundary layer eddy dissipation rate.

A46. The system of any of embodiments A41-A45, comprising: means to determine storm velocity.

A47. The system of any of embodiments A41-A46, comprising: means to determine eddy dissipation rate from updrafts.

A48. The system of any of embodiments A41-A47, comprising: means to determine maximum updraft speed.

A49. The system of any of embodiments A41-A47, comprising: means to determine maximum updraft speed at grid point equilibrium level.

A50. The system of any of embodiments A41-A49, comprising: means to determine storm divergence.

A51. The system of any of embodiments A41-A49, comprising: means to determine storm divergence while the updraft speed is above the equilibrium level.

A52. The system of any of embodiments A41-A51, comprising: means to identify storm top.

A53. The system of any of embodiments A41-A49, comprising: means to determine storm divergence while the updraft speed is above the equilibrium level and identify storm top.

A54. The system of any of embodiments A41-A53, comprising: means to determine storm overshoot and storm drag.

A55. The system of any of embodiments A41-A54, comprising: means to determine Doppler speed.

A56. The system of any of embodiments A41-A55, comprising: means to determine eddy dissipation rate above the storm top.

A57. The system of any of embodiments A41-A56, comprising: means to determine eddy dissipation rate from downdrafts.

A58. The system of any of embodiments A41-A57, wherein the flight plan data includes aircraft data.

A59. The system of embodiment A58, wherein the aircraft data includes at least one of airframe information and airfoil information.

A60. The system of any of embodiments A41-A59, wherein the flight plan data includes take-off time.

A61. The system of any of embodiments A41-A60, wherein the flight plan data includes take-off location.

A62. The system of any of embodiments A41-A61, wherein the flight plan data includes destination location.

A63. The system of any of embodiments A41-A62, wherein the flight plan data includes cargo information.

A64. The system of any of embodiments A41-A63, wherein the flight plan parameter data indicates the flight is a passenger flight.

A65. The system of any of embodiments A41-A63, wherein the flight plan parameter data indicates the flight is a cargo flight.

B1. A dynamic turbulence engine processor-implemented method, comprising: determining a plurality of four-dimensional grid points for a specified temporal geographic space-time area; obtaining terrain data based on the temporal geographic space-time area; obtaining atmospheric data based on the temporal geographic space-time area; for each point of the plurality of four-dimensional grid point, determining via a processor a non-dimensional mountain wave amplitude and mountain top wave drag; determining an upper level non-dimensional gravity wave amplitude; determining a buoyant turbulent kinetic energy; determining a boundary layer eddy dissipation rate; determining storm velocity and eddy dissipation rate from updrafts; determining maximum updraft speed at grid point equilibrium level; determining storm divergence while the updraft speed is above the equilibrium level and identifying storm top; determining storm overshoot and storm drag; determining Doppler speed; determining eddy dissipation rate above the storm top; determining eddy dissipation rate from downdrafts; determining at least one of the turbulent kinetic energy and the total eddy dissipation rate for each grid point; and providing a four-dimensional grid map overlay with comprehensive turbulence data for the specified temporal geographic space-time area.

B2. The method of embodiment B1, wherein the atmospheric data comprises temperature data.

B3. The method of embodiment B1 or B2, wherein the atmospheric data comprises wind data.

B4. The method of any of embodiments B1-B3, wherein the atmospheric data comprises humidity data.

B5. The method of any of embodiment B1-B4, wherein the atmospheric data comprises numerical weather forecast model data.

B6. The method of any of embodiments B1-B5, wherein the atmospheric data comprises aircraft sensor data.

B7. The method of any of embodiments B1-B6, wherein the atmospheric data comprises pilot report data.

B8. The method of any of embodiments B1-B7, further comprising providing a user interface for the four-dimensional grid map overlay with comprehensive turbulence data.

B9. The method of embodiment B8, wherein the user interface is displayed on a two-dimensional display and the user interface includes an at least one widget for navigating through at least one further dimension.

B10. The method of embodiment B8, wherein the user interface includes a granularity widget that allows a user to adjust the displayed detail.

B11. A dynamic turbulence engine system, comprising: means to determine a plurality of four-dimensional grid points for a specified temporal geographic space-time area; means to obtain terrain data based on the temporal geographic space-time area; means to obtain atmospheric data based on the temporal geographic space-time area; for each point of the plurality of four-dimensional grid point, means to determine a non-dimensional mountain wave amplitude and mountain top wave drag; means to determine an upper level non-dimensional gravity wave amplitude; means to determine a buoyant turbulent kinetic energy; means to determine a boundary layer eddy dissipation rate; means to determine storm velocity and eddy dissipation rate from updrafts; means to determine maximum updraft speed at grid point equilibrium level; means to determine storm divergence while the updraft speed is above the equilibrium level and identifying storm top; means to determine storm overshoot and storm drag; means to determine Doppler speed; means to determine eddy dissipation rate above the storm top; means to determine eddy dissipation rate from downdrafts; means to determine at least one of the turbulent kinetic energy and the total eddy dissipation rate for each grid point; and means to provide a four-dimensional grid map overlay with comprehensive turbulence data for the specified temporal geographic space-time area.

B12. The system of embodiment Bu, wherein the atmospheric data comprises temperature data.

B13. The system of embodiment Bu or B12, wherein the atmospheric data comprises wind data.

B14. The system of any of embodiments B11-B13, wherein the atmospheric data comprises humidity data.

B15. The system of any of embodiments B11-B14, wherein the atmospheric data comprises numerical weather forecast model data.

B16. The system of any of embodiments B11-B15, wherein the atmospheric data comprises aircraft sensor data.

B17. The system of any of embodiments B11-B16, wherein the atmospheric data comprises pilot report data.

B18. The system of any of embodiments B11-B17, further comprising: means to provide a user interface for the four-dimensional grid map overlay with comprehensive turbulence data.

B19. The system of embodiment B18, wherein the user interface is configured for display on a two-dimensional display and the user interface includes an at least one widget for navigating through at least one further dimension.

B20. The system of embodiment B18, wherein the user interface includes a granularity widget that allows a user to adjust the displayed detail.

B21. A processor-readable tangible medium storing processor-issuable dynamic turbulence engine grid map overlay generating instructions to: determine a plurality of four-dimensional grid points for a specified temporal geographic space-time area; obtain terrain data based on the temporal geographic space-time area; obtain atmospheric data based on the temporal geographic space-time area; for each point of the plurality of four-dimensional grid point, determine a non-dimensional mountain wave amplitude and mountain top wave drag; determine an upper level non-dimensional gravity wave amplitude; determine a buoyant turbulent kinetic energy; determine a boundary layer eddy dissipation rate; determine storm velocity and eddy dissipation rate from updrafts; determine maximum updraft speed at grid point equilibrium level; determine storm divergence while the updraft speed is above the equilibrium level and identifying storm top; determine storm overshoot and storm drag; determine Doppler speed; determine eddy dissipation rate above the storm top; determine eddy dissipation rate from downdrafts; determine at least one of the turbulent kinetic energy and the total eddy dissipation rate for each grid point; and provide a four-dimensional grid map overlay with comprehensive turbulence data for the specified temporal geographic space-time area.

B22. The medium of embodiment B21, wherein the atmospheric data comprises temperature data.

B23. The medium of embodiment B21 or B22, wherein the atmospheric data comprises wind data.

B24. The medium of any of embodiments B21-B23, wherein the atmospheric data comprises humidity data.

B25. The medium of any of embodiments B21-B24, wherein the atmospheric data comprises numerical weather forecast model data.

B26. The medium of any of embodiments B21-B25, wherein the atmospheric data comprises aircraft sensor data.

B27. The medium of any of embodiments B21-B26, wherein the atmospheric data comprises pilot report data.

B28. The medium of any of embodiments B21-B27, further comprising instructions to: provide a user interface for the four-dimensional grid map overlay with comprehensive turbulence data.

B29. The medium of embodiment B28, wherein the user interface is configured for display on a two-dimensional display and the user interface includes an at least one widget for navigating through at least one further dimension.

B30. The medium of embodiment B28, wherein the user interface includes a granularity widget that allows a user to adjust the displayed detail.

B31. A dynamic turbulence engine apparatus, comprising a processor and a memory disposed in communication with the processor and storing processor-issuable instructions to: determine a plurality of four-dimensional grid points for a specified temporal geographic space-time area; obtain terrain data based on the temporal geographic space-time area; obtain atmospheric data based on the temporal geographic space-time area; for each point of the plurality of four-dimensional grid point, determine a non-dimensional mountain wave amplitude and mountain top wave drag; determine an upper level non-dimensional gravity wave amplitude; determine a buoyant turbulent kinetic energy; determine a boundary layer eddy dissipation rate; determine storm velocity and eddy dissipation rate from updrafts; determine maximum updraft speed at grid point equilibrium level; determine storm divergence while the updraft speed is above the equilibrium level and identifying storm top; determine storm overshoot and storm drag; determine Doppler speed; determine eddy dissipation rate above the storm top; determine eddy dissipation rate from downdrafts; determine at least one of the turbulent kinetic energy and the total eddy dissipation rate for each grid point; and provide a four-dimensional grid map overlay with comprehensive turbulence data for the specified temporal geographic space-time area.

B32. The system of embodiment B31, wherein the atmospheric data comprises temperature data.

B33. The apparatus of embodiment B31 or B32, wherein the atmospheric data comprises wind data.

B34. The apparatus of any of embodiments B31-B33, wherein the atmospheric data comprises humidity data.

B35. The apparatus of any of embodiment B31-B34, wherein the atmospheric data comprises numerical weather forecast model data.

B36. The apparatus of any of embodiments B31-B35, wherein the atmospheric data comprises aircraft sensor data.

B37. The apparatus of any of embodiments B31-B36, wherein the atmospheric data comprises pilot report data.

B38. The apparatus of any of embodiments B31-B37, further comprising instructions to: provide a user interface for the four-dimensional grid map overlay with comprehensive turbulence data.

B39. The apparatus of embodiment B38, wherein the user interface is displayed on a two-dimensional display and the user interface includes an at least one widget for navigating through at least one further dimension.

B40. The apparatus of embodiment B38, wherein the user interface includes a granularity widget that allows a user to adjust the displayed detail.

B41. A dynamic turbulence engine system, comprising: means to determine a plurality of grid points for an area; means to determine at least one of the turbulent kinetic energy and the total eddy dissipation rate for each grid point; and means to provide a grid map overlay with comprehensive turbulence data for the area.

B42. The system of embodiment B41, wherein the grid points are four-dimensional grid points.

B43. The system of embodiment B41 or B42, wherein the area is specified.

B44. The system of any of embodiments B41-B43, wherein the area is a space-time area.

B45. The system of any of embodiments B41-B44, wherein the area is a temporal geographic area.

B46. The system of any of embodiments B41-B43, wherein the area is a temporal geographic space-time area B47. The system of any of embodiments B41-B46, wherein the grid map overlay is a four-dimensional grid map overlay B48. The system of any of embodiments B41-B47, comprising: means to obtain area terrain data.

B49. The system of any of embodiments B41-B48, comprising: means to obtain area atmospheric data.

B50. The system of any of embodiments B41-B49, comprising: means to determine non-dimensional mountain wave amplitude.

B51. The system of any of embodiments B41-B50, comprising: means to determine mountain top wave drag.

B52. The system of any of embodiments B41-B51, comprising: means to determine upper level non-dimensional gravity wave amplitude.

B53. The system of any of embodiments B41-B52, comprising: means to determine buoyant turbulent kinetic energy.

B54. The system of any of embodiments B41-B53, comprising: means to determine boundary layer eddy dissipation rate.

B55. The system of any of embodiments B41-B54, comprising: means to determine storm velocity.

B56. The system of any of embodiments B41-B55, comprising: means to determine eddy dissipation rate from updrafts.

B57. The system of any of embodiments B41-B56, comprising: means to determine maximum updraft speed at equilibrium level.

B58. The system of any of embodiments B41-B57, comprising: means to determine storm divergence.

B59. The system of any of embodiments B41-B57, comprising: means to determine storm divergence while the updraft speed is above the equilibrium level.

B60. The system of any of embodiments B41-B59, comprising: means to identify storm top.

B61. The system of any of embodiments B41-B60, comprising: means to determine storm overshoot.

B62. The system of any of embodiments B41-B61, comprising: means to determine storm drag.

B63. The system of any of embodiments B41-B62, comprising: means to determine Doppler speed.

B64. The system of any of embodiments B41-B63, comprising: means to determine eddy dissipation rate above the storm top.

B65. The system of any of embodiments B41-B64, comprising: means to determine eddy dissipation rate from downdrafts.

B66. The system of any of embodiments B41-B65, comprising: means to determine grid point non-dimensional mountain wave amplitude.

B67. The system of any of embodiments B41-B66, comprising: means to determine grid point mountain top wave drag.

B68. The system of any of embodiments B41-B67, comprising: means to determine grid point upper level non-dimensional gravity wave amplitude.

B69. The system of any of embodiments B41-B68, comprising: means to determine grid point buoyant turbulent kinetic energy.

B70. The system of any of embodiments B41-B69, comprising: means to determine grid point boundary layer eddy dissipation rate.

B71. The system of any of embodiments B41-B70, comprising: means to determine grid point storm velocity.

B72. The system of any of embodiments B41-B71, comprising: means to determine grid point eddy dissipation rate from updrafts.

B73. The system of any of embodiments B41-B72, comprising: means to determine maximum updraft speed at grid point equilibrium level.

B74. The system of any of embodiments B41-B73, comprising: means to determine grid point storm divergence.

B75. The system of any of embodiments B41-B74, comprising: means to determine grid point storm divergence while the updraft speed is above the equilibrium level.

B76. The system of any of embodiments B41-B75, comprising: means to identify grid point storm top.

B77. The system of any of embodiments B41-B76, comprising: means to determine grid point storm overshoot.

B78. The system of any of embodiments B41-B77, comprising: means to determine grid point storm drag.

B79. The system of any of embodiments B41-B78, comprising: means to determine grid point Doppler speed.

B80. The system of any of embodiments B41-B79, comprising: means to determine grid point eddy dissipation rate above the storm top.

B81. The system of any of embodiments B41-B80, comprising: means to determine grid point eddy dissipation rate from downdrafts.

B82. The system of any of embodiments B41-B81, wherein the atmospheric data comprises temperature data.

B83. The system of any of embodiments B41-B82, wherein the atmospheric data comprises wind data.

B84. The system of any of embodiments B41-B83, wherein the atmospheric data comprises humidity data.

B85. The system of any of embodiments B41-B84, wherein the atmospheric data comprises numerical weather forecast model data.

B86. The system of any of embodiments B41-B85, wherein the atmospheric data comprises aircraft sensor data.

B87. The system of any of embodiments B41-B86, wherein the atmospheric data comprises pilot report data.

B88. The system of any of embodiments B41-B87, further comprising:

means to provide a user interface for a four-dimensional grid map overlay with comprehensive turbulence data.

B89. The system of embodiment B88, wherein the user interface is configured for display on a two-dimensional display and the user interface includes an at least one widget for navigating through at least one further dimension.

B90. The system of embodiment B88, wherein the user interface includes a granularity widget that allows a user to adjust the displayed detail.

C1. A DTEC manager real-time flight plan modification processor-implemented method, comprising: receiving a flight profile for an aircraft, the flight profile including an at least one initial route; identifying an initial predicted comprehensive turbulence for the at least one initial route; determining a real-time comprehensive turbulence for the at least one initial route; determining turbulence threshold compliance based on the real-time comprehensive turbulence and at least one of the flight profile and the initial predicted comprehensive turbulence; and generating a turbulence exception if the real-time comprehensive turbulence exceeds threshold turbulence parameters.

C2. The method of embodiment C1, wherein the turbulence exception comprises an alert for the aircraft.

C3. The method of embodiment C1, wherein the turbulence exception comprises determining an at least one adjusted route.

C4. The method of embodiment C3, wherein the determination of the at least one adjusted route is based on flight profile data.

C5. The method of embodiment C4, wherein the flight profile data comprises at least one of flight service type, aircraft airframe, and available fuel reserves.

C6. The method of embodiment C4, wherein the flight profile data comprises flight destination location.

C7. The method of embodiment C1, wherein comprehensive turbulence determination comprises: determining a plurality of four-dimensional grid points for a specified temporal geographic space-time area; obtaining terrain data based on the temporal geographic space-time area; obtaining atmospheric data based on the temporal geographic space-time area; for each point of the plurality of four-dimensional grid point, determining via a processor a non-dimensional mountain wave amplitude and mountain top wave drag; determining an upper level non-dimensional gravity wave amplitude; determining a buoyant turbulent kinetic energy; determining a boundary layer eddy dissipation rate; determining storm velocity and eddy dissipation rate from updrafts; determining maximum updraft speed at grid point equilibrium level; determining storm divergence while the updraft speed is above the equilibrium level and identifying storm top; determining storm overshoot and storm drag; determining Doppler speed; determining eddy dissipation rate above the storm top; determining eddy dissipation rate from downdrafts; and determining at least one of the turbulent kinetic energy and the total eddy dissipation rate for each grid point.

C8. The method of embodiment C7, wherein the atmospheric data comprises at least one of temperature data, wind data, and humidity data.

C9. The method of embodiment C7, wherein the atmospheric data comprises numerical weather forecast model data.

C10. The method of embodiment C7, wherein the atmospheric data comprises aircraft sensor data.

C11. A dynamic turbulence manager real-time flight plan modification apparatus, comprising a processor and a memory disposed in communication with the processor and storing processor-issuable instructions to: receive a flight profile for an aircraft, the flight profile including an at least one initial route; identify an initial predicted comprehensive turbulence for the at least one initial route; determine a real-time comprehensive turbulence for the the at least one initial route; determine turbulence threshold compliance based on the real-time comprehensive turbulence and at least one of the flight profile and the initial predicted comprehensive turbulence; and generate a turbulence exception if the real-time comprehensive turbulence exceeds threshold turbulence parameters.

C12. The apparatus of embodiment C11, wherein the turbulence exception comprises an alert for the aircraft.

C13. The apparatus of embodiment C11, wherein the turbulence exception comprises determining an at least one adjusted route.

C14. The apparatus of embodiment C13, wherein the determination of the at least one adjusted route is based on flight profile data.

C15. The apparatus of embodiment C14, wherein the flight profile data comprises at least one of flight service type, aircraft airframe, and available fuel reserves.

C16. The apparatus of embodiment C14, wherein the flight profile data comprises flight destination location.

C17. The apparatus of embodiment C11, wherein comprehensive turbulence determination comprises instructions to: determine a plurality of four-dimensional grid points for a specified temporal geographic space-time area; obtain terrain data based on the temporal geographic space-time area; obtain atmospheric data based on the temporal geographic space-time area; for each point of the plurality of four-dimensional grid point: determine a non-dimensional mountain wave amplitude and mountain top wave drag, determine an upper level non-dimensional gravity wave amplitude, determine a buoyant turbulent kinetic energy, determine a boundary layer eddy dissipation rate, determine storm velocity and eddy dissipation rate from updrafts, determine maximum updraft speed at grid point equilibrium level, determine storm divergence while the updraft speed is above the equilibrium level and identifying storm top, determine storm overshoot and storm drag, determine Doppler speed, determine eddy dissipation rate above the storm top, determine eddy dissipation rate from downdrafts; and determine at least one of the turbulent kinetic energy and the total eddy dissipation rate for each grid point.

C18. The apparatus of embodiment C17, wherein the atmospheric data comprises at least one of temperature data, wind data, and humidity data.

C19. The apparatus of embodiment C17, wherein the atmospheric data comprises numerical weather forecast model data.

C20. The apparatus of embodiment C17, wherein the atmospheric data comprises aircraft sensor data.

C21. A processor-readable tangible medium storing processor-issuable dynamic turbulence manager real-time flight plan modification instructions to: receive a flight profile for an aircraft, the flight profile including an at least one initial route; identify an initial predicted comprehensive turbulence for the at least one initial route; determine a real-time comprehensive turbulence for the at least one initial route; determine turbulence threshold compliance based on the real-time comprehensive turbulence and at least one of the flight profile and the initial predicted comprehensive turbulence; and generate a turbulence exception if the real-time comprehensive turbulence exceeds threshold turbulence parameters.

C22. The medium of embodiment C21, wherein the turbulence exception comprises an alert for the aircraft.

C23. The medium of embodiment C21, wherein the turbulence exception comprises determining an at least one adjusted route.

C24. The medium of embodiment C23, wherein the determination of the at least one adjusted route is based on flight profile data.

C25. The medium of embodiment C24, wherein the flight profile data comprises at least one of flight service type, aircraft airframe, and available fuel reserves.

C26. The medium of embodiment C24, wherein the flight profile data comprises flight destination location.

C27. The medium of embodiment C21, wherein comprehensive turbulence determination comprises instructions to: determine a plurality of four-dimensional grid points for a specified temporal geographic space-time area; obtain terrain data based on the temporal geographic space-time area; obtain atmospheric data based on the temporal geographic space-time area; for each point of the plurality of four-dimensional grid point, determine a non-dimensional mountain wave amplitude and mountain top wave drag; determine an upper level non-dimensional gravity wave amplitude; determine a buoyant turbulent kinetic energy; determine a boundary layer eddy dissipation rate; determine storm velocity and eddy dissipation rate from updrafts; determine maximum updraft speed at grid point equilibrium level; determine storm divergence while the updraft speed is above the equilibrium level and identifying storm top; determine storm overshoot and storm drag; determine Doppler speed; determine eddy dissipation rate above the storm top; determine eddy dissipation rate from downdrafts; and determine at least one of the turbulent kinetic energy and the total eddy dissipation rate for each grid point.

C28. The medium of embodiment C27, wherein the atmospheric data comprises at least one of temperature data, wind data, and humidity data.

C29. The medium of embodiment C27, wherein the atmospheric data comprises numerical weather forecast model data.

C30. The medium of embodiment C27, wherein the atmospheric data comprises aircraft sensor data.

C31. A dynamic turbulence manager real-time flight plan modification system, comprising: means to receive a flight profile for an aircraft, the flight profile including an at least one initial route; means to identify an initial predicted comprehensive turbulence for the at least one initial route; means to determine a real-time comprehensive turbulence for the at least one initial route; means to determine turbulence threshold compliance based on the real-time comprehensive turbulence and at least one of the flight profile and the initial predicted comprehensive turbulence; and means to generate a turbulence exception if the real-time comprehensive turbulence exceeds threshold turbulence parameters.

C32. The system of embodiment C31, wherein the turbulence exception comprises an alert for the aircraft.

C33. The system of embodiment C31 or C32, wherein the turbulence exception comprises determining an at least one adjusted route.

C34. The system of embodiment C33, wherein the determination of the at least one adjusted route is based on flight profile data.

C35. The system of embodiment C34, wherein the flight profile data comprises at least one of flight service type, aircraft airframe, and available fuel reserves.

C36. The system of embodiment C34 or C35, wherein the flight profile data comprises flight destination location.

C37. The system of any of embodiments C31-C36, comprising: means to determine a plurality of four-dimensional grid points for a specified temporal geographic space-time area.

C38. The system of any of embodiments C31-C37, comprising: means to obtain terrain data.

C39. The system of any of embodiments C31-C38, comprising: means to obtain atmospheric data.

C40. The system of any of embodiments C31-C39, comprising: means to determine a non-dimensional mountain wave amplitude.

C41. The system of any of embodiments C31-C40, comprising: means to determine mountain top wave drag.

C42. The system of any of embodiments C31-C41, comprising: means to determine an upper level non-dimensional gravity wave amplitude.

C43. The system of any of embodiments C31-C42, comprising: means to determine a buoyant turbulent kinetic energy.

C44. The system of any of embodiments C31-C43, comprising: means to determine a boundary layer eddy dissipation rate.

C45. The system of any of embodiments C31-C44, comprising: means to determine storm velocity.

C46. The system of any of embodiments C31-C45, comprising: means to determine eddy dissipation rate from updrafts.

C47. The system of any of embodiments C31-C46, comprising: means to determine storm velocity and eddy dissipation rate from updrafts.

C48. The system of any of embodiments C31-C47, comprising: means to determine maximum updraft speed.

C49. The system of any of embodiments C31-C48, comprising: means to determine maximum updraft speed at equilibrium level.

C50. The system of any of embodiments C31-C49, comprising: means to determine storm divergence.

C51. The system of any of embodiments C31-C50, comprising: means to determine storm divergence while the updraft speed is above the equilibrium level.

C52. The system of any of embodiments C31-C51, comprising: means to identify storm top.

C53. The system of any of embodiments C31-C52, comprising: means to determine storm divergence while the updraft speed is above the equilibrium level and identify storm top.

C54. The system of any of embodiments C31-C53, comprising: means to determine storm overshoot.

C55. The system of any of embodiments C31-C54, comprising: means to determine storm drag.

C56. The system of any of embodiments C31-C55, comprising: means to determine Doppler speed.

C57. The system of any of embodiments C31-C56, comprising: means to determine eddy dissipation rate above storm top.

C58. The system of any of embodiments C31-C57, comprising: means to determine eddy dissipation rate from downdrafts.

C59. The system of any of embodiments C31-C58, comprising at least one of: means to determine turbulent kinetic energy; and means to determine total eddy dissipation rate.

C60. The system of any of embodiments C31-C59, comprising: means to determine grid point non-dimensional mountain wave amplitude.

C61. The system of any of embodiments C31-C60, comprising: means to determine grid point mountain top wave drag.

C62. The system of any of embodiments C31-C61, comprising: means to determine grid point upper level non-dimensional gravity wave amplitude.

C63. The system of any of embodiments C31-C62, comprising: means to determine grid point buoyant turbulent kinetic energy.

C64. The system of any of embodiments C31-C63, comprising: means to determine grid point boundary layer eddy dissipation rate.

C65. The system of any of embodiments C31-C64, comprising: means to determine grid point storm velocity.

C66. The system of any of embodiments C31-C65, comprising: means to determine grid point eddy dissipation rate from updrafts.

C67. The system of any of embodiments C31-C66, comprising: means to determine grid point storm velocity and eddy dissipation rate from updrafts.

C68. The system of any of embodiments C31-C67, comprising: means to determine grid point maximum updraft speed.

C69. The system of any of embodiments C31-C68, comprising: means to determine grid point maximum updraft speed at grid point equilibrium level.

C70. The system of any of embodiments C31-C69, comprising: means to determine grid point storm divergence.

C71. The system of any of embodiments C31-C70, comprising: means to determine grid point storm divergence while the updraft speed is above the equilibrium level.

C72. The system of any of embodiments C31-C71, comprising: means to identify grid point storm top.

C73. The system of any of embodiments C31-C72, comprising: means to determine grid point storm divergence while the updraft speed is above the equilibrium level and identify storm top.

C74. The system of any of embodiments C31-C73, comprising: means to determine grid point storm overshoot.

C75. The system of any of embodiments C31-C74, comprising: means to determine grid point storm drag.

C76. The system of any of embodiments C31-C75, comprising: means to determine grid point Doppler speed.

C77. The system of any of embodiments C31-C76, comprising: means to determine grid point eddy dissipation rate above storm top.

C78. The system of any of embodiments C31-C77, comprising: means to determine grid point eddy dissipation rate from downdrafts.

C79. The system of any of embodiments C31-C78, comprising: means to determine grid point turbulent kinetic energy.

C80. The system of any of embodiments C31-C79, comprising: means to determine grid point total eddy dissipation rate.

C81. The system of any of embodiments C31-C80, comprising, for each point of the plurality of four-dimensional grid point, means to: determine a non-dimensional mountain wave amplitude and mountain top wave drag; determine an upper level non-dimensional gravity wave amplitude; determine a buoyant turbulent kinetic energy; determine a boundary layer eddy dissipation rate; determine storm velocity and eddy dissipation rate from updrafts; determine maximum updraft speed at grid point equilibrium level; determine storm divergence while the updraft speed is above the equilibrium level and identifying storm top; determine storm overshoot and storm drag; determine Doppler speed; determine eddy dissipation rate above the storm top; determine eddy dissipation rate from downdrafts; and determine at least one of the turbulent kinetic energy and the total eddy dissipation rate for each grid point.

C82. The system of any of embodiments C31-C81, wherein the atmospheric data comprises at least one of temperature data, wind data, and humidity data.

C83. The system of any of embodiments C31-C82, wherein the atmospheric data comprises numerical weather forecast model data.

C84. The system of any of embodiments C31-C83, wherein the atmospheric data comprises aircraft sensor data.

DTEC Controller

Figure 13:
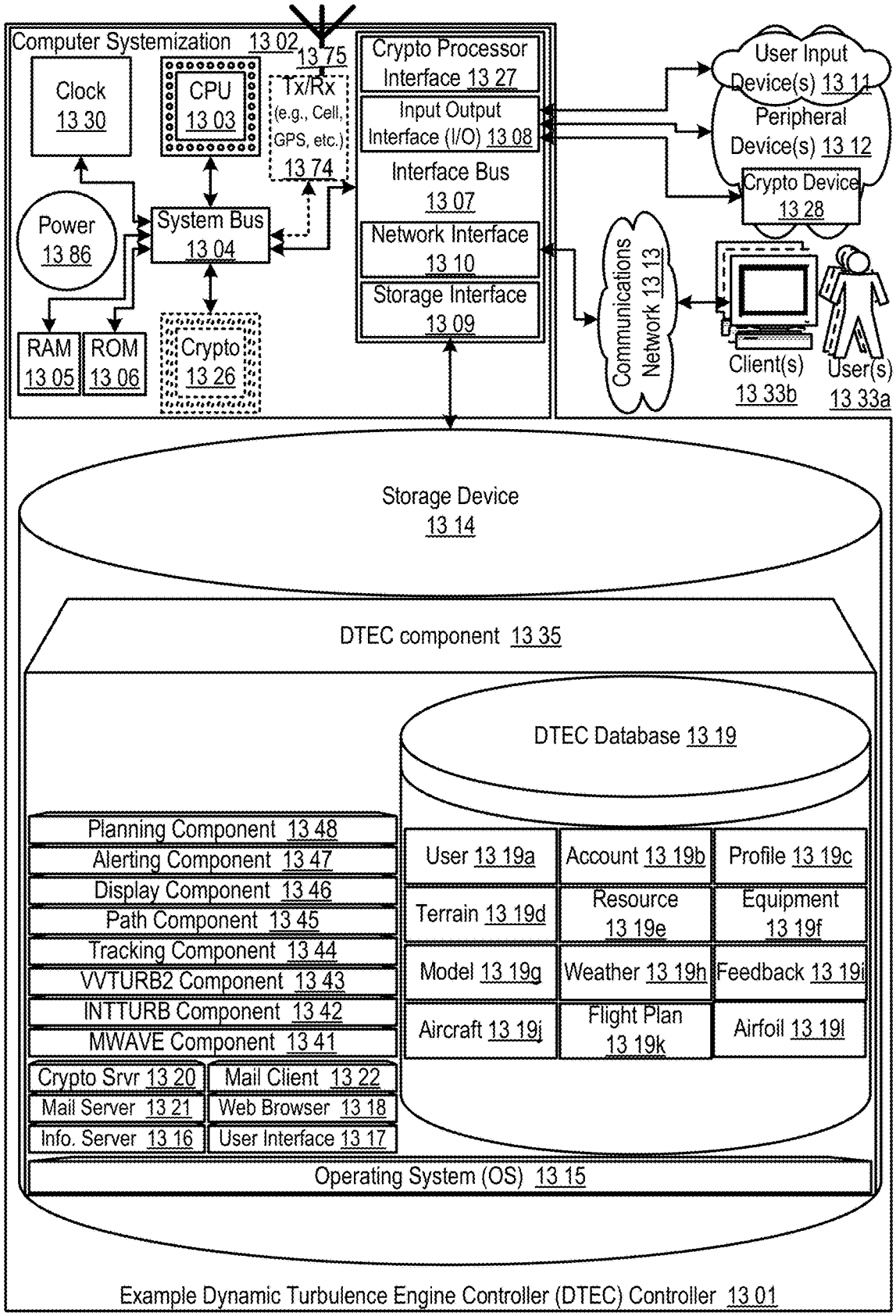
FIG. 13 shows a block diagram illustrating embodiments of a DTEC controller.

FIG. 13 shows a block diagram illustrating embodiments of a DTEC controller 1301. In this embodiment, the DTEC controller 1301 may serve to aggregate, process, store, search, serve, identify, instruct, generate, match, and/or facilitate interactions with a computer through various technologies, and/or other related data.

Typically, users, e.g., 1333*a*, which may be people and/or other systems, may engage information technology systems (e.g., computers) to facilitate information processing. In turn, computers employ processors to process information; such processors 1303 may be referred to as central processing units (CPU). One form of processor is referred to as a microprocessor. CPUs use communicative circuits to pass binary encoded signals acting as instructions to enable various operations. These instructions may be operational and/or data instructions containing and/or referencing other instructions and data in various processor accessible and operable areas of memory 1329 (e.g., registers, cache memory, random access memory, etc.). Such communicative instructions may be stored and/or transmitted in batches (e.g., batches of instructions) as programs and/or data components to facilitate desired operations. These stored instruction codes, e.g., programs, may engage the CPU circuit components and other motherboard and/or system components to perform desired operations. One type of program is a computer operating system, which, may be executed by CPU on a computer; the operating system enables and facilitates users to access and operate computer information technology and resources. Some resources that may be employed in information technology systems include: input and output mechanisms through which data may pass into and out of a computer; memory storage into which data may be saved; and processors by which information may be processed. These information technology systems may be used to collect data for later retrieval, analysis, and manipulation, which may be facilitated through a database program. These information technology systems provide interfaces that allow users to access and operate various system components.

In one embodiment, the DTEC controller 1301 may be connected to and/or communicate with entities such as, but not limited to: one or more users from user input devices 1311; peripheral devices 1312; an optional cryptographic processor device 1328; and/or a communications network 1313. For example, the DTEC controller 1301 may be connected to and/or communicate with users, e.g., 1333*a*, operating client device(s), e.g., 1333*b*, including, but not limited to, personal computer(s), server(s) and/or various mobile device(s) including, but not limited to, cellular telephone(s), smartphone(s) (e.g., iPhone®, Blackberry®, Android OS-based phones etc.), tablet computer(s) (e.g., Apple iPad™, HP Slate™, Motorola Xoom™, etc.), eBook reader(s) (e.g., Amazon Kindle™, Barnes and Noble's Nook™ eReader, etc.), laptop computer(s), notebook(s), netbook(s), gaming console(s) (e.g., XBOX Live™, Nintendo® DS, Sony PlayStation® Portable, etc.), portable scanner(s), and/or the like.

Networks are commonly thought to comprise the interconnection and interoperation of clients, servers, and intermediary nodes in a graph topology. It should be noted that the term "server" as used throughout this application refers generally to a computer, other device, program, or combination thereof that processes and responds to the requests of remote users across a communications network. Servers serve their information to requesting "clients." The term "client" as used herein refers generally to a computer, program, other device, user and/or combination thereof that is capable of processing and making requests and obtaining and processing any responses from servers across a communications network. A computer, other device, program, or combination thereof that facilitates, processes information and requests, and/or furthers the passage of information from a source user to a destination user is commonly referred to as a "node." Networks are generally thought to facilitate the transfer of information from source points to destinations. A node specifically tasked with furthering the passage of information from a source to a destination is commonly called a "router." There are many forms of networks such as Local Area Networks (LANs), Pico networks, Wide Area Networks (WANs), Wireless Networks (WLANs), etc. For example, the Internet is generally accepted as being an interconnection of a multitude of networks whereby remote clients and servers may access and interoperate with one another.

The DTEC controller 1301 may be based on computer systems that may comprise, but are not limited to, components such as: a computer systemization 1302 connected to memory 1329.

Computer Systemization

A computer systemization 1302 may comprise a clock 1330, central processing unit ("CPU(s)" and/or "processor (s)" (these terms are used interchangeable throughout the disclosure unless noted to the contrary)) 1303, a memory 1329 (e.g., a read only memory (ROM) 1306, a random access memory (RAM) 1305, etc.), and/or an interface bus 1307, and most frequently, although not necessarily, are all interconnected and/or communicating through a system bus 1304 on one or more (mother)board(s) 1302 having conductive and/or otherwise transportive circuit pathways through which instructions (e.g., binary encoded signals) may travel to effectuate communications, operations, storage, etc. The computer systemization may be connected to a power source 1386; e.g., optionally the power source may be internal. Optionally, a cryptographic processor 1326 and/or transceivers (e.g., ICs) 1374 may be connected to the system bus. In another embodiment, the cryptographic processor and/or transceivers may be connected as either internal and/or external peripheral devices 1312 via the interface bus I/O. In turn, the transceivers may be connected to antenna(s) 1375, thereby effectuating wireless transmission and reception of various communication and/or sensor protocols; for example the antenna(s) may connect to: a Texas Instruments WiLink WL1283 transceiver chip (e.g., providing 802.11n, Bluetooth 3.0, FM, global positioning system (GPS) (thereby allowing DTEC controller to determine its location)); Broadcom BCM4329 FKUBG transceiver chip (e.g., providing 802.11n, Bluetooth 2.1+EDR, FM, etc.); a Broadcom BCM4750IUB8 receiver chip (e.g., GPS); an Infineon Technologies X-Gold 618-PMB9800 (e.g., providing 2G/3G HSDPA/HSUPA communications); and/or the like. The system clock typically has a crystal oscillator and generates a base signal through the computer systemization's circuit pathways. The clock is typically coupled to the system bus and various clock multipliers that will increase or decrease the base operating frequency for other components interconnected in the computer systemization. The clock and various components in a computer systemization drive signals embodying information throughout the system. Such transmission and reception of instructions embodying information throughout a computer systemization may be commonly referred to as communications. These communicative instructions may further be transmitted, received, and the cause of return and/or reply communications beyond the instant computer systemization to: communications networks, input devices, other computer systemizations, peripheral devices, and/or the like. It should be understood that in alternative embodiments, any of the above components may be connected directly to one another, connected to the CPU, and/or organized in numerous variations employed as exemplified by various computer systems.

The CPU comprises at least one high-speed data processor adequate to execute program components for executing user and/or system-generated requests. Often, the processors themselves will incorporate various specialized processing units, such as, but not limited to: integrated system (bus) controllers, memory management control units, floating point units, and even specialized processing sub-units like graphics processing units, digital signal processing units, and/or the like. Additionally, processors may include internal fast access addressable memory, and be capable of mapping and addressing memory 1329 beyond the processor itself; internal memory may include, but is not limited to: fast registers, various levels of cache memory (e.g., level 1, 2, 3, etc.), RAM, etc. The processor may access this memory through the use of a memory address space that is accessible via instruction address, which the processor can construct and decode allowing it to access a circuit path to a specific memory address space having a memory state. The CPU may be a microprocessor such as: AMD's Athlon, Duron and/or Opteron; ARM's application, embedded and secure processors; IBM and/or Motorola's DragonBall and PowerPC; IBM's and Sony's Cell processor; Intel's Celeron, Core (2) Duo, Itanium, Pentium, Xeon, and/or XScale; and/or the like processor(s). The CPU interacts with memory through instruction passing through conductive and/or transportive conduits (e.g., (printed) electronic and/or optic circuits) to execute stored instructions (i.e., program code) according to conventional data processing techniques. Such instruction passing facilitates communication within the DTEC controller and beyond through various interfaces. Should processing requirements dictate a greater amount speed and/or capacity, distributed processors (e.g., Distributed DTEC), mainframe, multi-core, parallel, and/or supercomputer architectures may similarly be employed. Alternatively, should deployment requirements dictate greater portability, smaller Personal Digital Assistants (PDAs) may be employed.

Depending on the particular implementation, features of the DTEC may be achieved by implementing a microcontroller such as CAST's R8051 XC2 microcontroller; Intel's MCS 51 (i.e., 8051 microcontroller); and/or the like. Also, to implement certain features of the DTEC, some feature implementations may rely on embedded components, such as: Application-Specific Integrated Circuit ("ASIC"), Digital Signal Processing ("DSP"), Field Programmable Gate Array ("FPGA"), and/or the like embedded technology. For example, any of the DTEC component collection (distributed or otherwise) and/or features may be implemented via the microprocessor and/or via embedded components; e.g., via ASIC, coprocessor, DSP, FPGA, and/or the like. Alternately, some implementations of the DTEC may be implemented with embedded components that are configured and used to achieve a variety of features or signal processing.

Depending on the particular implementation, the embedded components may include software solutions, hardware solutions, and/or some combination of both hardware/software solutions. For example, DTEC features discussed herein may be achieved through implementing FPGAs, which are a semiconductor devices containing programmable logic components called "logic blocks", and programmable interconnects, such as the high performance FPGA Virtex series and/or the low cost Spartan series manufactured by Xilinx. Logic blocks and interconnects can be programmed by the customer or designer, after the FPGA is manufactured, to implement any of the DTEC features. A hierarchy of programmable interconnects allow logic blocks to be interconnected as needed by the DTEC system designer/administrator, somewhat like a one-chip programmable breadboard. An FPGA's logic blocks can be programmed to perform the operation of basic logic gates such as AND, and XOR, or more complex combinational operators such as decoders or simple mathematical operations. In most FPGAs, the logic blocks also include memory elements, which may be circuit flip-flops or more complete blocks of memory. In some circumstances, the DTEC may be developed on regular FPGAs and then migrated into a fixed version that more resembles ASIC implementations. Alternate or coordinating implementations may migrate DTEC controller features to a final ASIC instead of or in addition to FPGAs. Depending on the implementation all of the aforementioned embedded components and microprocessors may be considered the "CPU" and/or "processor" for the DTEC.

Power Source

The power source 1386 may be of any standard form for powering small electronic circuit board devices such as the following power cells: alkaline, lithium hydride, lithium ion, lithium polymer, nickel cadmium, solar cells, and/or the like. Other types of AC or DC power sources may be used as well. In the case of solar cells, in one embodiment, the case provides an aperture through which the solar cell may capture photonic energy. The power cell 1386 is connected to at least one of the interconnected subsequent components of the DTEC thereby providing an electric current to all subsequent components. In one example, the power source 1386 is connected to the system bus component 1304. In an alternative embodiment, an outside power source 1386 is provided through a connection across the I/O 1308 interface. For example, a USB and/or IEEE 1394 connection carries both data and power across the connection and is therefore a suitable source of power.

Interface Adapters

Interface bus(ses) 1307 may accept, connect, and/or communicate to a number of interface adapters, conventionally although not necessarily in the form of adapter cards, such as but not limited to: input output interfaces (I/O) 1308, storage interfaces 1309, network interfaces 1310, and/or the like. Optionally, cryptographic processor interfaces 1327 similarly may be connected to the interface bus. The interface bus provides for the communications of interface adapters with one another as well as with other components of the computer systemization. Interface adapters are adapted for a compatible interface bus. Interface adapters conventionally connect to the interface bus via a slot architecture. Conventional slot architectures may be employed, such as, but not limited to: Accelerated Graphics Port (AGP), Card Bus, (Extended) Industry Standard Architecture ((E)ISA), Micro Channel Architecture (MCA), NuBus, Peripheral Component Interconnect (Extended) (PCI(X)), PCI Express, Personal Computer Memory Card International Association (PCMCIA), and/or the like.

Storage interfaces 1309 may accept, communicate, and/or connect to a number of storage devices such as, but not limited to: storage devices 1314, removable disc devices, and/or the like. Storage interfaces may employ connection protocols such as, but not limited to: (Ultra) (Serial) Advanced Technology Attachment (Packet Interface) ((Ultra) (Serial) ATA(PI)), (Enhanced) Integrated Drive Electronics ((E)IDE), Institute of Electrical and Electronics Engineers (IEEE) 1394, fiber channel, Small Computer Systems Interface (SCSI), Universal Serial Bus (USB), and/or the like.

Network interfaces 1310 may accept, communicate, and/or connect to a communications network 1313. Through a communications network 1313, the DTEC controller is accessible through remote clients 1333*b* (e.g., computers with web browsers) by users 1333*a*. Network interfaces may employ connection protocols such as, but not limited to: direct connect, Ethernet (thick, thin, twisted pair 10/100/1000 Base T, and/or the like), Token Ring, wireless connection such as IEEE 802.11a-x, and/or the like. Should processing requirements dictate a greater amount speed and/or capacity, distributed network controllers (e.g., Distributed DTEC), architectures may similarly be employed to pool, load balance, and/or otherwise increase the communicative bandwidth required by the DTEC controller. A communications network may be any one and/or the combination of the following: a direct interconnection; the Internet; a Local Area Network (LAN); a Metropolitan Area Network (MAN); an Operating Missions as Nodes on the Internet (OMNI); a secured custom connection; a Wide Area Network (WAN); a wireless network (e.g., employing protocols such as, but not limited to a Wireless Application Protocol (WAP), I-mode, and/or the like); and/or the like. A network interface may be regarded as a specialized form of an input output interface. Further, multiple network interfaces 1310 may be used to engage with various communications network types 1313. For example, multiple network interfaces may be employed to allow for the communication over broadcast, multicast, and/or unicast networks.

Input Output interfaces (I/O) 1308 may accept, communicate, and/or connect to user input devices 1311, peripheral devices 1312, cryptographic processor devices 1328, and/or the like. I/O may employ connection protocols such as, but not limited to: audio: analog, digital, monaural, RCA, stereo, and/or the like; data: Apple Desktop Bus (ADB), IEEE 1394a-b, serial, universal serial bus (USB); infrared; joystick; keyboard; midi; optical; PC AT; PS/2; parallel; radio; video interface: Apple Desktop Connector (ADC), BNC, coaxial, component, composite, digital, Digital Visual Interface (DVI), high-definition multimedia interface (HDMI), RCA, RF antennae, S-Video, VGA, and/or the like; wireless transceivers: 802.11a/b/g/n/x; Bluetooth; cellular (e.g., code division multiple access (CDMA), high speed packet access (HSPA(+)), high-speed downlink packet access (HSDPA), global system for mobile communications (GSM), long term evolution (LTE), WiMax, etc.); and/or the like. One typical output device may include a video display, which typically comprises a Cathode Ray Tube (CRT) or Liquid Crystal Display (LCD) based monitor with an interface (e.g., DVI circuitry and cable) that accepts signals from a video interface, may be used. The video interface composites information generated by a computer systemization and generates video signals based on the composited information in a video memory frame. Another output device is a television set, which accepts signals from a video interface. Typically, the video interface provides the composited video information through a video connection interface that accepts a video display interface (e.g., an RCA composite video connector accepting an RCA composite video cable; a DVI connector accepting a DVI display cable, etc.).

User input devices 1311 often are a type of peripheral device 1312 (see below) and may include: card readers, dongles, finger print readers, gloves, graphics tablets, joysticks, keyboards, microphones, mouse (mice), remote controls, retina readers, touch screens (e.g., capacitive, resistive, etc.), trackballs, trackpads, sensors (e.g., accelerometers, ambient light, GPS, gyroscopes, proximity, etc.), styluses, and/or the like.

Peripheral devices 1312 may be connected and/or communicate to I/O and/or other facilities of the like such as network interfaces, storage interfaces, directly to the interface bus, system bus, the CPU, and/or the like. Peripheral devices may be external, internal and/or part of the DTEC controller. Peripheral devices may include: antenna, audio devices (e.g., line-in, line-out, microphone input, speakers, etc.), cameras (e.g., still, video, webcam, etc.), dongles (e.g., for copy protection, ensuring secure transactions with a digital signature, and/or the like), external processors (for added capabilities; e.g., crypto devices 1328), force-feedback devices (e.g., vibrating motors), network interfaces, printers, scanners, storage devices, transceivers (e.g., cellular, GPS, etc.), video devices (e.g., goggles, monitors, etc.), video sources, visors, and/or the like. Peripheral devices often include types of input devices (e.g., cameras).

It should be noted that although user input devices and peripheral devices may be employed, the DTEC controller may be embodied as an embedded, dedicated, and/or monitor-less (i.e., headless) device, wherein access would be provided over a network interface connection.

Cryptographic units such as, but not limited to, microcontrollers, processors 1326, interfaces 1327, and/or devices 1328 may be attached, and/or communicate with the DTEC controller. A MC68HC16 microcontroller, manufactured by Motorola Inc., may be used for and/or within cryptographic units. The MC68HC16 microcontroller utilizes a 16-bit multiply-and-accumulate instruction in the 16 MHz configuration and requires less than one second to perform a 512-bit RSA private key operation. Cryptographic units support the authentication of communications from interacting agents, as well as allowing for anonymous transactions. Cryptographic units may also be configured as part of the CPU. Equivalent microcontrollers and/or processors may also be used. Other commercially available specialized cryptographic processors include: the Broadcom's CryptoNetX and other Security Processors; nCipher's nShield, SafeNet's Luna PCI (e.g., 7100) series; Semaphore Communications' 40 MHz Roadrunner 184; Sun's Cryptographic Accelerators (e.g., Accelerator 6000 PCIe Board, Accelerator 500 Daughtercard); Via Nano Processor (e.g., L2100, L2200, U2400) line, which is capable of performing 500+MB/s of cryptographic instructions; VLSI Technology's 33 MHz 6868; and/or the like.

Memory

Generally, any mechanization and/or embodiment allowing a processor to affect the storage and/or retrieval of information is regarded as memory 1329. However, memory is a fungible technology and resource, thus, any number of memory embodiments may be employed in lieu of or in concert with one another. It is to be understood that the DTEC controller and/or a computer systemization may employ various forms of memory 1329. For example, a computer systemization may be configured wherein the operation of on-chip CPU memory (e.g., registers), RAM, ROM, and any other storage devices are provided by a paper punch tape or paper punch card mechanism; however, such an embodiment would result in an extremely slow rate of operation. In a typical configuration, memory 1329 will include ROM 1306, RAM 1305, and a storage device 1314. A storage device 1314 may be any conventional computer system storage. Storage devices may include a drum; a (fixed and/or removable) magnetic disk drive; a magneto-optical drive; an optical drive (i.e., Blueray, CD ROM/RAM/Recordable (R)/ReWritable (RW), DVD R/RW, HD DVD R/RW etc.); an array of devices (e.g., Redundant Array of Independent Disks (RAID)); solid state memory devices (USB memory, solid state drives (SSD), etc.); other processor-readable storage mediums; and/or other devices of the like. Thus, a computer systemization generally requires and makes use of memory.

Component Collection

The memory 1329 may contain a collection of program and/or database components and/or data such as, but not limited to: operating system component(s) 1315 (operating system); information server component(s) 1316 (information server); user interface component(s) 1317 (user interface); Web browser component(s) 1318 (Web browser); database(s) 1319; mail server component(s) 1321; mail client component(s) 1322; cryptographic server component(s) 1320 (cryptographic server); the DTEC component(s) 1335; and/or the like (i.e., collectively a component collection). These components may be stored and accessed from the storage devices and/or from storage devices accessible through an interface bus. Although non-conventional program components such as those in the component collection, typically, are stored in a local storage device 1314, they may also be loaded and/or stored in memory such as: peripheral devices, RAM, remote storage facilities through a communications network, ROM, various forms of memory, and/or the like.

Operating System

The operating system component 1315 is an executable program component facilitating the operation of the DTEC controller. Typically, the operating system facilitates access of I/O, network interfaces, peripheral devices, storage devices, and/or the like. The operating system may be a highly fault tolerant, scalable, and secure system such as: Apple Macintosh OS X (Server); AT&T Plan 9; Be OS; Unix and Unix-like system distributions (such as AT&T's UNIX; Berkley Software Distribution (BSD) variations such as FreeBSD, NetBSD, OpenBSD, and/or the like; Linux distributions such as Red Hat, Ubuntu, and/or the like); and/or the like operating systems. However, more limited and/or less secure operating systems also may be employed such as Apple Macintosh OS, IBM OS/2, Microsoft DOS, Microsoft Windows 2000/2003/3.1/95/98/CE/Millennium/NT/Vista/XP (Server), Palm OS, and/or the like. An operating system may communicate to and/or with other components in a component collection, including itself, and/or the like. Most frequently, the operating system communicates with other program components, user interfaces, and/or the like. For example, the operating system may contain, communicate, generate, obtain, and/or provide program component, system, user, and/or data communications, requests, and/or responses. The operating system, once executed by the CPU, may enable the interaction with communications networks, data, I/O, peripheral devices, program components, memory, user input devices, and/or the like. The operating system may provide communications protocols that allow the DTEC controller to communicate with other entities through a communications network 1313. Various communication protocols may be used by the DTEC controller as a subcarrier transport mechanism for interaction, such as, but not limited to: multicast, TCP/IP, UDP, unicast, and/or the like.

Information Server

An information server component 1316 is a stored program component that is executed by a CPU. The information server may be a conventional Internet information server such as, but not limited to Apache Software Foundation's Apache, Microsoft's Internet Information Server, and/or the like. The information server may allow for the execution of program components through facilities such as Active Server Page (ASP), ActiveX, (ANSI) (Objective-) C (++), C# and/or .NET, Common Gateway Interface (CGI) scripts, dynamic (D) hypertext markup language (HTML), FLASH, Java, JavaScript, Practical Extraction Report Language (PERL), Hypertext Pre-Processor (PHP), pipes, Python, wireless application protocol (WAP), WebObjects, and/or the like. The information server may support secure communications protocols such as, but not limited to, File Transfer Protocol (FTP); HyperText Transfer Protocol (HTTP); Secure Hypertext Transfer Protocol (HTTPS), Secure Socket Layer (SSL), messaging protocols (e.g., America Online (AOL) Instant Messenger (AIM), Application Exchange (APEX), ICQ, Internet Relay Chat (IRC), Microsoft Network (MSN) Messenger Service, Presence and Instant Messaging Protocol (PRIM), Internet Engineering Task Force's (IETF's) Session Initiation Protocol (SIP), SIP for Instant Messaging and Presence Leveraging Extensions (SIMPLE), open XML-based Extensible Messaging and Presence Protocol (XMPP) (i.e., Jabber or Open Mobile Alliance's (OMA's) Instant Messaging and Presence Service (IMPS)), Yahoo! Instant Messenger Service, and/or the like. The information server provides results in the form of Web pages to Web browsers, and allows for the manipulated generation of the Web pages through interaction with other program components. After a Domain Name System (DNS) resolution portion of an HTTP request is resolved to a particular information server, the information server resolves requests for information at specified locations on the DTEC controller based on the remainder of the HTTP request. For example, a request such as http://123.124.125.126/myInformation.html might have the IP portion of the request "123.124.125.126" resolved by a DNS server to an information server at that IP address; that information server might in turn further parse the http request for the "/myInformation.html" portion of the request and resolve it to a location in memory containing the information "myInformation.html." Additionally, other information serving protocols may be employed across various ports, e.g., FTP communications across port 21, and/or the like. An information server may communicate to and/or with other components in a component collection, including itself, and/or facilities of the like. Most frequently, the information server communicates with the DTEC database 1319, operating systems, other program components, user interfaces, Web browsers, and/or the like.

Access to the DTEC database may be achieved through a number of database bridge mechanisms such as through scripting languages as enumerated below (e.g., CGI) and through inter-application communication channels as enumerated below (e.g., CORBA, WebObjects, etc.). Any data requests through a Web browser are parsed through the bridge mechanism into appropriate grammars as required by the DTEC. In one embodiment, the information server would provide a Web form accessible by a Web browser. Entries made into supplied fields in the Web form are tagged as having been entered into the particular fields, and parsed as such. The entered terms are then passed along with the field tags, which act to instruct the parser to generate queries directed to appropriate tables and/or fields. In one embodiment, the parser may generate queries in standard SQL by instantiating a search string with the proper join/select commands based on the tagged text entries, wherein the resulting command is provided over the bridge mechanism to the DTEC as a query. Upon generating query results from the query, the results are passed over the bridge mechanism, and may be parsed for formatting and generation of a new results Web page by the bridge mechanism. Such a new results Web page is then provided to the information server, which may supply it to the requesting Web browser.

Also, an information server may contain, communicate, generate, obtain, and/or provide program component, system, user, and/or data communications, requests, and/or responses.

User Interface

Computer interfaces in some respects are similar to automobile operation interfaces. Automobile operation interface elements such as steering wheels, gearshifts, and speedometers facilitate the access, operation, and display of automobile resources, and status. Computer interaction interface elements such as check boxes, cursors, menus, scrollers, and windows (collectively and commonly referred to as widgets) similarly facilitate the access, capabilities, operation, and display of data and computer hardware and operating system resources, and status. Operation interfaces are commonly called user interfaces. Graphical user interfaces (GUIs) such as the Apple Macintosh Operating System's Aqua, IBM's OS/2, Microsoft's Windows 2000/2003/3.1/95/98/CE/Millenium/NT/XP/Vista/7 (i.e., Aero), Unix's X-Windows (e.g., which may include additional Unix graphic interface libraries and layers such as K Desktop Environment (KDE), mythTV and GNU Network Object Model Environment (GNOME)), web interface libraries (e.g., ActiveX, AJAX, (D)HTML, FLASH, Java, JavaScript, etc. interface libraries such as, but not limited to, Dojo, jQuery(UI), MooTools, Prototype, script.aculo.us, SWFObject, Yahoo! User Interface, any of which may be used and) provide a baseline and means of accessing and displaying information graphically to users.

A user interface component 1317 is a stored program component that is executed by a CPU. The user interface may be a conventional graphic user interface as provided by, with, and/or atop operating systems and/or operating environments such as already discussed. The user interface may allow for the display, execution, interaction, manipulation, and/or operation of program components and/or system facilities through textual and/or graphical facilities. The user interface provides a facility through which users may affect, interact, and/or operate a computer system. A user interface may communicate to and/or with other components in a component collection, including itself, and/or facilities of the like. Most frequently, the user interface communicates with operating systems, other program components, and/or the like. The user interface may contain, communicate, generate, obtain, and/or provide program component, system, user, and/or data communications, requests, and/or responses.

Web Browser

A Web browser component 1318 is a stored program component that is executed by a CPU. The Web browser may be a conventional hypertext viewing application such as Microsoft Internet Explorer or Netscape Navigator. Secure Web browsing may be supplied with 128 bit (or greater) encryption by way of HTTPS, SSL, and/or the like. Web browsers allowing for the execution of program components through facilities such as ActiveX, AJAX, (D)HTML, FLASH, Java, JavaScript, web browser plug-in APIs (e.g., FireFox, Safari Plug-in, and/or the like APIs), and/or the like. Web browsers and like information access tools may be integrated into PDAs, cellular telephones, and/or other mobile devices. A Web browser may communicate to and/or with other components in a component collection, including itself, and/or facilities of the like. Most frequently, the Web browser communicates with information servers, operating systems, integrated program components (e.g., plug-ins), and/or the like; e.g., it may contain, communicate, generate, obtain, and/or provide program component, system, user, and/or data communications, requests, and/or responses. Also, in place of a Web browser and information server, a combined application may be developed to perform similar operations of both. The combined application would similarly affect the obtaining and the provision of information to users, user agents, and/or the like from the DTEC enabled nodes. The combined application may be nugatory on systems employing standard Web browsers.

Mail Server

A mail server component 1321 is a stored program component that is executed by a CPU 1303. The mail server may be a conventional Internet mail server such as, but not limited to sendmail, Microsoft Exchange, and/or the like. The mail server may allow for the execution of program components through facilities such as ASP, ActiveX, (ANSI) (Objective-) C (++), C# and/or .NET, CGI scripts, Java, JavaScript, PERL, PHP, pipes, Python, WebObjects, and/or the like. The mail server may support communications protocols such as, but not limited to: Internet message access protocol (IMAP), Messaging Application Programming Interface (MAPI)/Microsoft Exchange, post office protocol (POPS), simple mail transfer protocol (SMTP), and/or the like. The mail server can route, forward, and process incoming and outgoing mail messages that have been sent, relayed and/or otherwise traversing through and/or to the DTEC.

Access to the DTEC mail may be achieved through a number of APIs offered by the individual Web server components and/or the operating system.

Also, a mail server may contain, communicate, generate, obtain, and/or provide program component, system, user, and/or data communications, requests, information, and/or responses.

Mail Client

A mail client component 1322 is a stored program component that is executed by a CPU 1303. The mail client may be a conventional mail viewing application such as Apple Mail, Microsoft Entourage, Microsoft Outlook, Microsoft Outlook Express, Mozilla, Thunderbird, and/or the like. Mail clients may support a number of transfer protocols, such as: IMAP, Microsoft Exchange, POPS, SMTP, and/or the like. A mail client may communicate to and/or with other components in a component collection, including itself, and/or facilities of the like. Most frequently, the mail client communicates with mail servers, operating systems, other mail clients, and/or the like; e.g., it may contain, communicate, generate, obtain, and/or provide program component, system, user, and/or data communications, requests, information, and/or responses. Generally, the mail client provides a facility to compose and transmit electronic mail messages.

Cryptographic Server

A cryptographic server component 1320 is a stored program component that is executed by a CPU 1303, cryptographic processor 1326, cryptographic processor interface 1327, cryptographic processor device 1328, and/or the like. Cryptographic processor interfaces will allow for expedition of encryption and/or decryption requests by the cryptographic component; however, the cryptographic component, alternatively, may run on a conventional CPU. The cryptographic component allows for the encryption and/or decryption of provided data. The cryptographic component allows for both symmetric and asymmetric (e.g., Pretty Good Protection (PGP)) encryption and/or decryption. The cryptographic component may employ cryptographic techniques such as, but not limited to: digital certificates (e.g., X.509 authentication framework), digital signatures, dual signatures, enveloping, password access protection, public key management, and/or the like. The cryptographic component will facilitate numerous (encryption and/or decryption) security protocols such as, but not limited to: checksum, Data Encryption Standard (DES), Elliptical Curve Encryption (ECC), International Data Encryption Algorithm (IDEA), Message Digest5 (MD5, which is a one way hash operation), passwords, Rivest Cipher (RC5), Rijndael, RSA (which is an Internet encryption and authentication system that uses an algorithm developed in 1977 by Ron Rivest, Adi Shamir, and Leonard Adleman), Secure Hash Algorithm (SHA), Secure Socket Layer (SSL), Secure Hypertext Transfer Protocol (HTTPS), and/or the like. Employing such encryption security protocols, the DTEC may encrypt all incoming and/or outgoing communications and may serve as node within a virtual private network (VPN) with a wider communications network. The cryptographic component facilitates the process of "security authorization" whereby access to a resource is inhibited by a security protocol wherein the cryptographic component effects authorized access to the secured resource. In addition, the cryptographic component may provide unique identifiers of content, e.g., employing and MD5 hash to obtain a unique signature for a digital audio file. A cryptographic component may communicate to and/or with other components in a component collection, including itself, and/or facilities of the like. The cryptographic component supports encryption schemes allowing for the secure transmission of information across a communications network to enable the DTEC component to engage in secure transactions if so desired. The cryptographic component facilitates the secure accessing of resources on the DTEC and facilitates the access of secured resources on remote systems; i.e., it may act as a client and/or server of secured resources. Most frequently, the cryptographic component communicates with information servers, operating systems, other program components, and/or the like. The cryptographic component may contain, communicate, generate, obtain, and/or provide program component, system, user, and/or data communications, requests, and/or responses.

The DTEC Database

The DTEC database component 1319 may be embodied in a database and its stored data. The database is a stored program component, which is executed by the CPU; the stored program component portion configuring the CPU to process the stored data. The database may be a conventional, fault tolerant, relational, scalable, secure database such as Oracle or Sybase. Relational databases are an extension of a flat file. Relational databases consist of a series of related tables. The tables are interconnected via a key field. Use of the key field allows the combination of the tables by indexing against the key field; i.e., the key fields act as dimensional pivot points for combining information from various tables. Relationships generally identify links maintained between tables by matching primary keys. Primary keys represent fields that uniquely identify the rows of a table in a relational database. More precisely, they uniquely identify rows of a table on the "one" side of a one-to-many relationship.

Alternatively, the DTEC database may be implemented using various standard data-structures, such as an array, hash, (linked) list, struct, structured text file (e.g., XML), table, and/or the like. Such data-structures may be stored in memory and/or in (structured) files. In another alternative, an object-oriented database may be used, such as Frontier, ObjectStore, Poet, Zope, and/or the like. Object databases can include a number of object collections that are grouped and/or linked together by common attributes; they may be related to other object collections by some common attributes. Object-oriented databases perform similarly to relational databases with the exception that objects are not just pieces of data but may have other types of capabilities encapsulated within a given object. If the DTEC database is implemented as a data-structure, the use of the DTEC database 1319 may be integrated into another component such as the DTEC component 1335. Also, the database may be implemented as a mix of data structures, objects, and relational structures. Databases may be consolidated and/or distributed in countless variations through standard data processing techniques. Portions of databases, e.g., tables, may be exported and/or imported and thus decentralized and/or integrated.

In one embodiment, the database component 1319 includes several tables **1319*a*-1. A User table 1319*a* may include fields such as, but not limited to: user_id, ssn, dob, first_name, last_name, age, state, address_firstline, address_secondline, zipcode, devices_list, contact_info, contact_type, alt_contact_info, alt_contact_type, user_equipment, user_plane, user_profile, and/or the like. An Account table 1319*b*** may include fields such as, but not limited to: acct_id, acct_user, acct_history, acct_access, acct_status, acct_subscription, acct_profile, and/or the like.

A Profile table **1319*c* may include fields such as, but not limited to: prof_id, prof_assets, prof_history, prof_details, profile_aircraft, and/or the like. A Terrain table 1319*d* may include fields such as, but not limited to: terrain_id, terrain_details, terrain_parameters, terrain_var, and/or the like. A Resource table 1319*e* may include fields such as, but not limited to: resource_id, resource_location, resource_acct, and/or the like. An Equipment table 1319*f* may include fields such as, but not limited to: equip_id, equip_location, equip_acct, equip_contact, equip_type, and/or the like. A Model table 1319*g* may include fields such as, but not limited to: model_id, model_assc, model_feedback, model_param, model_var, and/or the like. A Weather data table 1319*h* may include fields such as, but not limited to: weather_data_id, weather_source, weather_location, weather_data_type, weather_acct, weather_var, and/or the like. In one embodiment, the weather_data table is populated through one or more weather_data feeds. A Feedback table 1319*i*** may include fields such as, but not limited to: feedback_id, feedback_source, source_location, feedback_time, feedback_acct, and/or the like.

An Aircraft table **1319*j* may include fields such as, but not limited to: aircraft_id, aircraft_type, aircraft_profile, aircraft_fuel_capacity, aircraft_route, aircraft_use, aircraft_owner, aircraft_location, aircraft_acct, aircraft_flightplan, aircraft_parameters, aircraft_airfoil, aircraft_alerts, and/or the like. A Flight Nan table 1319*k* may include fields such as, but not limited to: flightplan_id, flightplan_source, flightplan_start_location, flightplan_start_time, flightplan_end_location, flightplan_end_time, flightplan_acct, flightplan_aircraft, flightplan_profile, flightplan_type, flightplan_alerts, flightplan_parameters, and/or the like. An Airfoil table 13191** may include fields such as, but not limited to: airfoil_id, airfoil_source, airfoil_aircraft, airfoil_icing_profile, airfoil_icing_determination, airfoil_profile, airfoil_type, airfoil_pi, airfoil_alerts, airfoil_parameters, and/or the like.

In one embodiment, the DTEC database may interact with other database systems. For example, employing a distributed database system, queries and data access by search DTEC component may treat the combination of the DTEC database, an integrated data security layer database as a single database entity.

In one embodiment, user programs may contain various user interface primitives, which may serve to update the DTEC. Also, various accounts may require custom database tables depending upon the environments and the types of clients the DTEC may need to serve. It should be noted that any unique fields may be designated as a key field throughout. In an alternative embodiment, these tables have been decentralized into their own databases and their respective database controllers (i.e., individual database controllers for each of the above tables). Employing standard data processing techniques, one may further distribute the databases over several computer systemizations and/or storage devices. Similarly, configurations of the decentralized database controllers may be varied by consolidating and/or distributing the various database components **1319*a*-1**. The DTEC may be configured to keep track of various settings, inputs, and parameters via database controllers.

The DTEC database may communicate to and/or with other components in a component collection, including itself, and/or facilities of the like. Most frequently, the DTEC database communicates with the DTEC component, other program components, and/or the like. The database may contain, retain, and provide information regarding other nodes and data.

The DTECs

The DTEC component 1335 is a stored program component that is executed by a CPU. In one embodiment, the DTEC component incorporates any and/or all combinations of the aspects of the DTEC discussed in the previous figures. As such, the DTEC affects accessing, obtaining and the provision of information, services, transactions, and/or the like across various communications networks.

The DTEC component may transform weather data input via DTEC components into real-time and/or predictive turbulence feeds and displays, and/or the like and use of the DTEC. In one embodiment, the DTEC component 1335 takes inputs (e.g., weather forecast data, models, terrain, sensor data, and/or the like) etc., and transforms the inputs via various components (e.g., MWAVE component 1341; INTTURB component 1342; VVTURB2 component 1343; a Tracking component 1344; a Pathing component 1345; a Display component 1346; an Alerting component 1347; a Planning component 1348; and/or the like), into outputs (e.g., predictive flight path turbulence, real-time turbulence data feed, flight path modifications/optimizations, turbulence alerts, and/or the like).

The DTEC component enabling access of information between nodes may be developed by employing standard development tools and languages such as, but not limited to: Apache components, Assembly, ActiveX, binary executables, (ANSI) (Objective-) C (++), C# and/or .NET, database adapters, CGI scripts, Java, JavaScript, mapping tools, procedural and object oriented development tools, PERL, PHP, Python, shell scripts, SQL commands, web application server extensions, web development environments and libraries (e.g., Microsoft's ActiveX; Adobe AIR, FLEX & FLASH; AJAX; (D)HTML; Dojo, Java; JavaScript; jQuery(UI); MooTools; Prototype; script.aculo.us; Simple Object Access Protocol (SOAP); SWFObject; Yahoo! User Interface; and/or the like), WebObjects, and/or the like. In one embodiment, the DTEC server employs a cryptographic server to encrypt and decrypt communications. The DTEC component may communicate to and/or with other components in a component collection, including itself, and/or facilities of the like. Most frequently, the DTEC component communicates with the DTEC database, operating systems, other program components, and/or the like. The DTEC may contain, communicate, generate, obtain, and/or provide program component, system, user, and/or data communications, requests, and/or responses.

Distributed DTECs

The structure and/or operation of any of the DTEC node controller components may be combined, consolidated, and/or distributed in any number of ways to facilitate development and/or deployment. Similarly, the component collection may be combined in any number of ways to facilitate deployment and/or development. To accomplish this, one may integrate the components into a common code base or in a facility that can dynamically load the components on demand in an integrated fashion.

The component collection may be consolidated and/or distributed in countless variations through standard data processing and/or development techniques. Multiple instances of any one of the program components in the program component collection may be instantiated on a single node, and/or across numerous nodes to improve performance through load-balancing and/or data-processing techniques. Furthermore, single instances may also be distributed across multiple controllers and/or storage devices; e.g., databases. All program component instances and controllers working in concert may do so through standard data processing communication techniques.

The configuration of the DTEC controller will depend on the context of system deployment. Factors such as, but not limited to, the budget, capacity, location, and/or use of the underlying hardware resources may affect deployment requirements and configuration. Regardless of if the configuration results in more consolidated and/or integrated program components, results in a more distributed series of program components, and/or results in some combination between a consolidated and distributed configuration, data may be communicated, obtained, and/or provided. Instances of components consolidated into a common code base from the program component collection may communicate, obtain, and/or provide data. This may be accomplished through intra-application data processing communication techniques such as, but not limited to: data referencing (e.g., pointers), internal messaging, object instance variable communication, shared memory space, variable passing, and/or the like.

If component collection components are discrete, separate, and/or external to one another, then communicating, obtaining, and/or providing data with and/or to other components may be accomplished through inter-application data processing communication techniques such as, but not limited to: Application Program Interfaces (API) information passage; (distributed) Component Object Model ((D)COM), (Distributed) Object Linking and Embedding ((D)OLE), and/or the like), Common Object Request Broker Architecture (CORBA), Jini local and remote application program interfaces, JavaScript Object Notation (JSON), Remote Method Invocation (RMI), SOAP, process pipes, shared files, and/or the like. Messages sent between discrete component components for inter-application communication or within memory spaces of a singular component for intra-application communication may be facilitated through the creation and parsing of a grammar. A grammar may be developed by using development tools such as lex, yacc, XML, and/or the like, which allow for grammar generation and parsing capabilities, which in turn may form the basis of communication messages within and between components.

For example, a grammar may be arranged to recognize the tokens of an HTTP post command, e.g.:

w3c -post http:// . . . Value1 where Value1 is discerned as being a parameter because "http://" is part of the grammar syntax, and what follows is considered part of the post value. Similarly, with such a grammar, a variable "Value1" may be inserted into an "http://" post command and then sent. The grammar syntax itself may be presented as structured data that is interpreted and/or otherwise used to generate the parsing mechanism (e.g., a syntax description text file as processed by lex, yacc, etc.). Also, once the parsing mechanism is generated and/or instantiated, it itself may process and/or parse structured data such as, but not limited to: character (e.g., tab) delineated text, HTML, structured text streams, XML, and/or the like structured data. In another embodiment, inter-application data processing protocols themselves may have integrated and/or readily available parsers (e.g., JSON, SOAP, and/or like parsers) that may be employed to parse (e.g., communications) data. Further, the parsing grammar may be used beyond message parsing, but may also be used to parse: databases, data collections, data stores, structured data, and/or the like. Again, the desired configuration will depend upon the context, environment, and requirements of system deployment.

For example, in some implementations, the DTEC controller may be executing a PHP script implementing a Secure Sockets Layer ("SSL") socket server via the information server, which listens to incoming communications on a server port to which a client may send data, e.g., data encoded in JSON format. Upon identifying an incoming communication, the PHP script may read the incoming message from the client device, parse the received JSON-encoded text data to extract information from the JSON-encoded text data into PHP script variables, and store the data (e.g., client identifying information, etc.) and/or extracted information in a relational database accessible using the Structured Query Language ("SQL"). An exemplary listing, written substantially in the form of PHP/SQL commands, to accept JSON-encoded input data from a client device via a SSL connection, parse the data to extract variables, and store the data to a database, is provided below:

```
<?PHP
header ('Content-Type: text/plain');
// set ip address and port to listen to for incoming data
$address = '192.168.0.100';
$port = 255;
// create a server-side SSL socket, listen for/accept incoming
communication
$sock = socket_create (AF_INET, SOCK STREAM, 0);
socket_bind ($sock, $address, $port) or die
('Could not bind to address');
socket_listen($sock);
$client = socket_accept ($sock);
// read input data from client device in 1024 byte blocks
until end of message
do {
   $input = "";
   $input = socket_read ($client, 1024);
   $data .= $input;
} while($input != "");
// parse data to extract variables
$obj = json_decode ($data, true);
// store input data in a database
```

-continued

```
mysql_connect ("201.408.185.132",$DBserver, $password); //
access database server
mysql_select ("CLIENT_DB.SQL"); // select database to append
mysql_query ("INSERT INTO UserTable (transmission)
VALUES ($data)"); // add data to UserTable table in a
CLIENT database
mysql_close ("CLIENT_DB.SQL"); // close connection
to database
?>
```

Also, the following resources may be used to provide example embodiments regarding SOAP parser implementation:

http://www.xav.com/perl/site/lib/SOAP/Parser.html
http://publib.boulder.ibm.com/infocenter/tivihelp/v2r1/index.jsp?topic=/com.ibm.IBMDI.doc/referenceguide295.htm and other parser implementations:

http://publib.boulder.ibm.com/infocenter/tivihelp/v2r1/index.jsp?topic=/com.ibm.IBMDI.doc/referenceguide259.htm all of which are hereby expressly incorporated by reference herein.

In order to address various issues and advance the art, the entirety of this application for DYNAMIC TURBULENCE ENGINE CONTROLLER APPARATUSES, METHODS AND SYSTEMS (including the Cover Page, Title, Headings, Field, Background, Summary, Brief Description of the Drawings, Detailed Description, Claims, Abstract, Figures, Appendices and/or otherwise) shows by way of illustration various embodiments in which the claimed innovations may be practiced. The advantages and features of the application are of a representative sample of embodiments only, and are not exhaustive and/or exclusive. They are presented only to assist in understanding and teach the claimed principles. It should be understood that they are not representative of all claimed innovations. As such, certain aspects of the disclosure have not been discussed herein. That alternate embodiments may not have been presented for a specific portion of the innovations or that further undescribed alternate embodiments may be available for a portion is not to be considered a disclaimer of those alternate embodiments. It will be appreciated that many of those undescribed embodiments incorporate the same principles of the innovations and others are equivalent. Thus, it is to be understood that other embodiments may be utilized and functional, logical, operational, organizational, structural and/or topological modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the innovations, and inapplicable to others. In addition, the disclosure includes other innovations not presently claimed. Applicant reserves all rights in those presently unclaimed innovations, including the right to claim such innovations, file additional applications, continuations, continuations in part, divisions, and/or the like thereof. As such, it should be understood that advantages, embodiments, examples, functional, features, logical, operational, organizational, structural, topological, and/or other aspects of the disclosure are not to be considered limitations on the disclosure as defined by the claims or limitations on equivalents to the claims. It is to be understood that, depending on the particular needs and/or characteristics of a DTEC individual and/or enterprise user, database configuration and/or relational model, data type, data transmission and/or network framework, syntax structure, and/or the like, various embodiments of the DTEC may be implemented that enable a great deal of flexibility and customization. For example, aspects of the DTEC may be adapted for integration with flight planning and route optimization. While various embodiments and discussions of the DTEC have been directed to predictive turbulence, however, it is to be understood that the embodiments described herein may be readily configured and/or customized for a wide variety of other applications and/or implementations.

What is claimed is:

1. A dynamic turbulence processor-implemented method for providing a comprehensive turbulence grid map, comprising:

determining a plurality of multi-dimensional grid points for a given spatial-temporal region from input flight plan parameter data;

determining a non-dimensional mountain wave amplitude for each grid point in the spatial-temporal region from input topological data and the input flight plan parameter data using a mountain wave turbulence component (MWAVE) of a dynamic turbulence engine controller (DTEC);

determining an upper level non-dimensional gravity wave amplitude for each grid point in the spatial-temporal region from the input topological data and the input flight plan parameter data using an integrated turbulence calculation component (INTTURB) of the DTEC;

determining atmospheric data for the spatial-temporal region from sensors associated with any one or more of aircraft sensor, weather station, and satellite;

determining a vertical velocity turbulence for each grid point in the spatial-temporal region from the input topological data, the input flight plan parameter data, and the atmospheric data using a vertical velocity turbulence with perimeter turbulence integration component (VVTURB2) of the DTEC;

determining comprehensive turbulence data for the spatial-temporal region, the comprehensive turbulence data including at least one of a turbulent kinetic energy and a total eddy dissipation rate for each grid point in the spatial-temporal region, the comprehensive turbulence data determination based on determined non-dimensional mountain wave amplitude data, determined upper level non-dimensional gravity wave amplitude data, and determined vertical velocity turbulence data; and providing a comprehensive turbulence grid map including comprehensive turbulence data for the spatial-temporal region to a terminal display in an aircraft.

2. The processor-implemented method of claim 1, further comprising: determining terrain data for the spatial-temporal region, wherein the comprehensive turbulence data determination is based in part on the terrain data.

3. The processor-implemented method of claim 1, wherein the atmospheric data includes at least one of: temperature data for the region, wind data for the region, humidity data for the region, pilot report data for the region, numerical weather forecast model data for the region, and/or aircraft sensor data for the region.

4. The processor-implemented method of claim 1, further comprising determining at least one of: grid point non-dimensional mountain wave amplitude, grid point mountain top wave drag, grid point upper level non-dimensional gravity wave amplitude, grid point buoyant turbulent kinetic energy, grid point boundary layer eddy dissipation rate, grid point storm velocity, grid point eddy dissipation rate from updrafts, maximum updraft speed at grid point equilibrium level, grid point storm divergence, grid point storm divergence while updraft speed is above equilibrium level, grid point storm top, grid point storm overshoot, grid point storm drag, grid point Doppler speed, grid point eddy dissipation rate above storm top, and/or grid point eddy dissipation rate from downdrafts.

5. The processor-implemented method of claim 1, further comprising: providing a user interface for the comprehensive turbulence grid map.

6. The processor-implemented method of claim 5, wherein the user interface is configured for display on a two-dimensional display device.

7. The processor-implemented method of claim 6, wherein the user interface includes an at least one widget configured for navigation through at least one further dimension.

8. The processor-implemented method of claim 5, wherein the user interface includes a granularity widget configured to allow a user to adjust displayed detail of the grid map overlay.

9. A dynamic turbulence engine apparatus, comprising:

an aircraft terminal display;

a processor; and a memory disposed in communication with the processor and storing processor-issuable instructions to:

determine a plurality of grid points for an area from input flight plan parameter data;

determine comprehensive turbulence data for the area including at least one of a turbulent kinetic energy and a total eddy dissipation rate for each grid point in the area, the comprehensive turbulence data determination based on: current atmospheric data for the area obtained from sensors associated with any one or more of aircraft sensor, weather station, and satellite, a non-dimensional mountain wave amplitude for each grid point determined using a mountain wave turbulence component (MWAVE) of the processor, an upper level non-dimensional gravity wave amplitude for each grid point using an integrated turbulence calculation component (INTTURB) of the processor, and a vertical velocity turbulence for each grid point using a vertical velocity turbulence with perimeter turbulence integration component (VVTURB2) of the processor; and provide a displayable grid map overlay with comprehensive turbulence data for the area onto the aircraft terminal display.

10. The apparatus of claim 9, wherein the comprehensive turbulence data determination is further based on area terrain data.

11. The apparatus of claim 9, wherein the area is a space-time area.

12. The apparatus of claim 9, wherein the grid points are four-dimensional grid points.

13. The apparatus of claim 9, wherein the grid map overlay is a four-dimensional grid map overlay.

14. The apparatus of claim 9, wherein the comprehensive turbulence data determination is further based on at least one of: mountain top wave drag data, buoyant turbulent kinetic energy data, boundary layer eddy dissipation rate data, storm velocity data, eddy dissipation rate from updrafts data, maximum updraft speed at equilibrium level data, and/or storm divergence data.

15. The apparatus of claim 9, wherein the memory further stores processor-issuable instructions to determine at least one of: storm divergence while updraft speed is above equilibrium level, storm overshoot, storm top, storm drag, and/or Doppler speed.

16. The apparatus of claim 9, wherein the memory further stores processor-issuable instructions to determine at least one of: eddy dissipation rate above the storm top, and/or eddy dissipation rate from downdrafts.

17. The apparatus of claim 9, wherein the memory further stores processor-issuable instructions to determine at least one of: grid point non-dimensional mountain wave amplitude, grid point mountain top wave drag, grid point upper level non-dimensional gravity wave amplitude, grid point buoyant turbulent kinetic energy, grid point boundary layer eddy dissipation rate, grid point storm velocity, grid point eddy dissipation rate from updrafts, maximum updraft speed at grid point equilibrium level, grid point storm divergence, grid point storm divergence while updraft speed is above equilibrium level, grid point storm top, grid point storm overshoot, grid point storm drag, grid point Doppler speed, grid point eddy dissipation rate above storm top, and/or grid point eddy dissipation rate from downdrafts.

18. The apparatus of claim 9, wherein the current atmospheric data includes at least one of: temperature data, wind data, humidity data, pilot report data, numerical weather forecast model data, and/or aircraft sensor data.

19. A non-transitory processor-readable medium comprising instructions for provision of a comprehensive turbulence grid map overlay, the instructions when executed causing at least one processing device to:

determine a plurality of four-dimensional grid points for a temporal geographic area from input flight plan parameter data;

determine comprehensive turbulence data for the temporal geographic area including at least one of a turbulent kinetic energy and a total eddy dissipation rate for each four-dimensional grid point in the temporal geographic area, the comprehensive turbulence data determination based on: atmospheric data for the area obtained from sensors associated with any one or more of aircraft sensor, weather station, and satellite, a non-dimensional mountain wave amplitude for each grid point determined using a mountain wave turbulence component (MWAVE) of the processing device, an upper level non-dimensional gravity wave amplitude for each grid point using an integrated turbulence calculation component (INTTURB) of the processing device, and a vertical velocity turbulence for each grid point using a vertical velocity turbulence with perimeter turbulence integration component (VVTURB2) of the processing device; and provide a grid map overlay with comprehensive turbulence data for the temporal geographic area onto an aircraft terminal display.

20. The non-transitory processor-readable medium of claim 19, further comprising instructions that when executed cause the at least one processing device to: determine temporal geographic area terrain data, wherein the comprehensive turbulence data determination is based in part on the temporal geographic area terrain data.

21. The non-transitory processor-readable medium of claim 19, further comprising instructions that when executed cause the at least one processing device to: determine temporal geographic area atmospheric data, wherein the comprehensive turbulence data determination is based in part on the temporal geographic area atmospheric data.

22. The non-transitory processor-readable medium of claim 21, wherein the area atmospheric data includes at least one of: temperature data for the temporal geographic area, wind data for the temporal geographic area, humidity data for the temporal geographic area, pilot report data for the temporal geographic area, numerical weather forecast model data for the temporal geographic area, and/or aircraft sensor data for the temporal geographic area.

23. The non-transitory processor-readable medium of claim 19, further comprising instructions that when executed cause the at least one processing device to determine at least one of: grid point non-dimensional mountain wave amplitude, grid point mountain top wave drag, grid point upper level non-dimensional gravity wave amplitude, grid point buoyant turbulent kinetic energy, grid point boundary layer eddy dissipation rate, grid point storm velocity, grid point eddy dissipation rate from updrafts, maximum updraft speed at grid point equilibrium level, grid point storm divergence, grid point storm divergence while updraft speed is above equilibrium level, grid point storm top, grid point storm overshoot, grid point storm drag, grid point Doppler speed, grid point eddy dissipation rate above storm top, and/or grid point eddy dissipation rate from downdrafts.

24. The non-transitory processor-readable medium of claim 19, further comprising instructions that when executed cause the at least one processing device to: provide a user interface for the grid map overlay with comprehensive turbulence data, wherein the user interface is configured for display on a two-dimensional display device.

25. The non-transitory processor-readable medium of claim 24, further comprising instructions that when executed cause the at least one processing device to: display at least one widget in the user interface, the at least one widget configured for navigation through at least one further dimension.

* * * * *